US010946544B2

(12) United States Patent
Brown et al.

(10) Patent No.: US 10,946,544 B2
(45) Date of Patent: Mar. 16, 2021

(54) MULTIFUNCTIONAL MACHINE

(71) Applicant: POSITEC POWER TOOLS (SUZHOU) CO., LTD., Suzhou (CN)

(72) Inventors: Warren Brown, Mount Evelyn (AU); Harry Szommer, Frankston North (AU); Graham Gerhardt, Warrandyte (AU); Hua Gu, Suzhou (CN); Haiquan Wu, Suzhou (CN); Hui Li, Suzhou (CN)

(73) Assignee: POSITEC POWER TOOLS (SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 16/230,446

(22) Filed: Dec. 21, 2018

(65) Prior Publication Data

US 2019/0118402 A1 Apr. 25, 2019

Related U.S. Application Data

(60) Division of application No. 14/230,802, filed on Mar. 31, 2014, now abandoned, which is a continuation of (Continued)

(30) Foreign Application Priority Data

Sep. 29, 2011 (CN) ..... 201110299618.9
Nov. 11, 2011 (CN) ..... 201110356357.X
(Continued)

(51) Int. Cl.
*B26D 7/26* (2006.01)
*B25F 3/00* (2006.01)
*B26D 1/12* (2006.01)

(52) U.S. Cl.
CPC ..... *B26D 7/2614* (2013.01); *B25F 3/00* (2013.01); *B26D 1/12* (2013.01)

(58) Field of Classification Search
CPC ..... B26D 7/2614; B26D 1/12; B25F 3/00; B24B 45/00; B24B 27/08; B24B 23/04
(Continued)

(56) References Cited

U.S. PATENT DOCUMENTS 3,554,197 A 1/1971 Dobbie
3,943,934 A 3/1976 Bent
(Continued)

FOREIGN PATENT DOCUMENTS

AU 2007203350 A1 2/2009
CN 1623726 A 6/2005
(Continued)

OTHER PUBLICATIONS

English language abstract and computer-generated English translation for CN 102554881 extracted from espacenet.com database on Dec. 21, 2015, 14 pages.
(Continued)

*Primary Examiner* — Jason Daniel Prone
(74) *Attorney, Agent, or Firm* — Howard & Howard Attorneys PLLC

(57) ABSTRACT

An oscillatory power tool that is capable of using various types of cutting tools is disclosed. The power tool includes an output shaft for mounting one of the cutting tools and driving the cutting tool in an oscillating rotary motion. An end of the output shaft has a driving section for engaging with a securing section of the cutting tool. The power tool further includes a fastener connected to the output shaft at the end and connectable to the securing section of the cutting tool for fastening the cutting tool to the end of the output shaft. The driving section has a fitting surface for contacting a surface of the securing section. Through a close fit between the friction surface and the surface of the securing section, the power tool can be connected with different types of
(Continued)

cutting tools, which greatly improves the universality and convenience of the power tool.

7 Claims, 34 Drawing Sheets

Related U.S. Application Data application No. PCT/CN2012/082300, filed on Sep. 28, 2012.

(30) Foreign Application Priority Data

Jan. 18, 2012 (CN) ..... 201210014641.3
Mar. 9, 2012 (CN) ..... 201210061584.4

(58) Field of Classification Search
USPC ..... 83/321, 771, 484, 835, 665, 666, 571; 606/178; 30/392–394; D8/70
See application file for complete search history.

(56) References Cited

U.S. PATENT DOCUMENTS

| | | | | |
|---|---|---|---|---|
| 3,952,412 | A | 4/1976 | Rhodes | |
| 4,507,999 | A | 4/1985 | Dezem | |
| 4,637,170 | A | 1/1987 | Block | |
| 4,729,193 | A | 3/1988 | Gant et al. | |
| 4,779,382 | A | 10/1988 | Rudolf et al. | |
| 4,836,069 | A | 6/1989 | Tran Dinh | |
| 5,038,478 | A | 8/1991 | Mezger et al. | |
| 5,058,909 | A | 10/1991 | Rudolf et al. | |
| 5,157,873 | A | 10/1992 | Rudolf et al. | |
| 5,366,312 | A | 11/1994 | Raines | |
| 5,456,011 | A | 10/1995 | Inkster | |
| 5,554,165 | A * | 9/1996 | Raitt | B27B 5/32 606/178 |
| 5,601,483 | A | 2/1997 | Rudolf et al. | |
| 5,697,835 | A | 12/1997 | Nitz et al. | |
| 5,718,621 | A | 2/1998 | Turley | |
| 5,722,171 | A * | 3/1998 | Schmidt | B26B 13/12 30/255 |
| 5,729,904 | A | 3/1998 | Trott | |
| 6,569,001 | B2 | 5/2003 | Rudolf et al. | |
| 6,802,764 | B2 | 10/2004 | Besch | |
| 6,865,813 | B2 | 3/2005 | Pollak | |
| 6,910,694 | B2 | 6/2005 | Hartmann et al. | |
| 6,949,110 | B2 | 9/2005 | Ark et al. | |
| 7,013,987 | B2 | 3/2006 | Nock et al. | |
| 7,344,435 | B2 | 3/2008 | Pollak et al. | |
| 7,497,860 | B2 | 3/2009 | Carusillo et al. | |
| 7,997,586 | B2 | 8/2011 | Ziegler et al. | |
| 8,182,316 | B2 | 5/2012 | Peisert | |
| 8,187,058 | B2 | 5/2012 | Blickle et al. | |
| 8,317,574 | B2 | 11/2012 | Blickle et al. | |
| 8,387,717 | B2 | 3/2013 | Kildevaeld | |
| 8,499,674 | B2 | 8/2013 | Holba et al. | |
| 8,640,580 | B2 * | 2/2014 | Bohne | B24B 23/04 83/13 |
| 8,734,450 | B2 | 5/2014 | Landon | |
| 8,881,409 | B2 | 11/2014 | Haman | |
| 8,915,499 | B2 | 12/2014 | Kaye, Jr. et al. | |
| 8,936,597 | B2 | 1/2015 | Wang et al. | |
| 9,027,452 | B2 | 5/2015 | Nagy et al. | |
| 9,061,410 | B2 | 6/2015 | Zhou et al. | |
| 9,067,293 | B2 | 6/2015 | Bernardi et al. | |
| 9,174,354 | B2 | 11/2015 | Zhou | |
| 9,272,435 | B2 * | 3/2016 | Bohne | B24B 23/04 |
| 9,339,904 | B2 * | 5/2016 | Erni | B24B 23/04 |
| 9,486,887 | B2 * | 11/2016 | Fankhauser | B27B 19/006 |
| 2003/0100251 | A1 | 5/2003 | Besch | |
| 2005/0011329 | A1 | 1/2005 | Briggs | |
| 2006/0123959 | A1 | 6/2006 | Bocast | |
| 2007/0094877 | A1 | 5/2007 | Bohne et al. | |
| 2008/0190259 | A1 | 8/2008 | Bohne | |
| 2009/0197514 | A1 * | 8/2009 | Peisert | B24B 23/04 30/392 |
| 2010/0052269 | A1 | 3/2010 | Zaiser et al. | |
| 2011/0227300 | A1 | 9/2011 | Zhang et al. | |
| 2012/0074657 | A1 | 3/2012 | Zhou | |
| 2012/0311876 | A1 | 12/2012 | Zhang | |
| 2013/0180747 | A1 | 7/2013 | Brown et al. | |
| 2013/0193655 | A1 * | 8/2013 | Kaye, Jr. | B24B 23/04 279/141 |
| 2014/0144662 | A1 | 5/2014 | Zhou | |
| 2014/0182873 | A1 * | 7/2014 | Fankhauser | B24B 45/00 279/141 |
| 2014/0191481 | A1 | 7/2014 | Kawakami et al. | |
| 2014/0230626 | A1 | 8/2014 | Puzio et al. | |
| 2014/0290072 | A1 | 10/2014 | Brown et al. | |
| 2014/0325855 | A1 | 11/2014 | Bozic | |
| 2015/0035239 | A1 * | 2/2015 | Maissen | B24B 23/04 279/141 |
| 2015/0143705 | A1 | 5/2015 | Bozic | |
| 2018/0243894 | A1 * | 8/2018 | Wang | B24B 23/04 |
| 2019/0184595 | A1 * | 6/2019 | Fellmann | B24B 45/00 |

FOREIGN PATENT DOCUMENTS

| | | | |
|---|---|---|---|
| CN | 201442260 | U | 4/2010 |
| CN | 201702760 | U | 1/2011 |
| CN | 102001087 | A | 4/2011 |
| CN | 102233564 | A | 11/2011 |
| CN | 102554881 | A | 7/2012 |
| GB | 2408709 | A | 6/2005 |
| WO | 2008128862 | A1 | 10/2008 |

OTHER PUBLICATIONS

English language abstract and computer-generated English translation for CN 201442260 extracted from espacenet.com database on Dec. 2,1 2015, 5 pages.
English language abstract for CN102001087A extracted from espacenet.com on Sep. 23, 2014, 1 page.
English language abstract for CN10223356A extracted from espacenet.com on Sep. 23, 2014, 1 page.
English language abstract for CN201702760U extracted from espacenet.com on Sep. 23, 2014, 1 page.
English language abstract for WO2008128862A1 extracted from espacenet.com on Sep. 24, 2014, 1 page.
English language abstract not found for CN 1623726; however, see English language abstract of corresponding document GB 2 408 709, 1 page.
International Search Report of WO2013044844A1 dated Jan. 3, 2013, 4 pages.

* cited by examiner

MULTIFUNCTIONAL MACHINE

CROSS REFERENCE TO RELATED APPLICATIONS

The subject patent application is a divisional of U.S. patent application Ser. No. 14/230,802, filed on Mar. 31, 2014, which is a continuation of International Patent Application No. PCT/CN2012/082300, filed on Sep. 28, 2012, which claims priority to and all the advantages of Chinese Patent Application Serial No. 201110299618.9, filed on Sep. 29, 2011, Chinese Patent Application Serial No. 201110356357.X, filed on Nov. 11, 2011, Chinese Patent Application Serial No. 201210014641.3, filed on Jan. 18, 2012, and Chinese Patent Application Serial No. 201210061584.4, filed on Mar. 9, 2012. The contents of U.S. patent application Ser. No. 14/230,802, International Patent Application No. PCT/CN2012/082300 and Chinese Patent Application Serial Nos. 201110299618.9, 201110356357.X, 201210014641.3, and 201210061584.4 are incorporated herein by reference in their entirety.

TECHNICAL FIELD

The invention relates to an oscillatory power tool, in particular to an oscillatory power tool capable of using various types of cutting tools.

DESCRIPTION OF THE RELATED ART

Oscillatory power tools are common handheld oscillatory power tools in the industry. The working principle is that the output shaft rotates and oscillates around its own axis to drive the cutting tool accessories installed at the tail end of the output shaft to oscillate. Common cutting tool accessories include straight saw blades, circular saw blades, triangular sanding discs, spade scrapers, etc. Therefore, different cutting tool accessories installed on the output shaft by the user can realize various operation functions, such as sawing, cutting, grinding and scrapping to be met different working demands. The traditional oscillatory power tool is provided with a form-fit mechanism for transmitting torque between the cutting tool and the output shaft. For example, a cutting tool is provided with a star-shaped opening with eight circular beads which are connected consecutively. Correspondingly, the tail end of the output shaft radially and convexly extends to form a convex portion with four circular beads. When the cutting tool is installed on the output shaft, the star-shaped opening is just sleeved on the circular beam-shaped convex portion, and then the cutting is fixed on the output shaft through screws.

However, the above mentioned oscillatory power tool is disadvantaged in that: the premise of installing the cutting tool on the output shaft is that the star-shaped opening of the cutting tool is matched with the convex portion of the output shaft; otherwise, cutting tools with openings in other shapes cannot be installed on the output shaft. So, the cutting tools capable of being connected to the output shaft are limited in type.

CONTENTS OF THE INVENTION

The technical problem to be solved in the invention is to provide an oscillatory power tool capable of connecting various types of cutting tools.

To achieve the above object, the present invention has the technical scheme that: an oscillatory power tool comprising:

an output shaft for mounting a cutting tool and driving the cutting tool in an oscillating rotary motion; a fastener for fastening the cutting tool to the output shaft; the cutting tool comprising a securing section being capable of connecting with the output shaft; an end of the output shaft having a driving section for engaging with the securing section of the cutting tool; the driving section having a fitting surface for contacting a surface of the securing section, the fitting surface being formed by a plurality of protrusions.

Compared with the prior art, the invention has the following beneficial effects: through close fit between the friction surface and the upper surface of the securing section, the oscillatory power tool can be connected with different types of cutting tools, thus greatly improving the universality and convenience of the oscillatory power tool; the friction force generated between the friction surface and the upper surface of the securing section is big enough, so the oscillatory power tool can transmit the oscillation torque on the output shaft to the cutting tools and prevent the cutting tools from slip.

Preferably, the oscillatory power tool further comprising a locating element and an elastic element, and the elastic element drives the locating element to always axially move towards a direction for contacting with the cutting tool.

Preferably, the various types of cutting tools comprise a first cutting tool and a second cutting tool, the first cutting tool comprises a first center surface which is parallel with the fitting surface and a first connecting hole for allowing the fastener to pass through; the second cutting tool comprises a second center surface which is parallel with the fitting surface and a second connecting hole for allowing the fastener to pass through; the locating element is capable of contacting at least part of the first connecting hole and at least part of the second connecting hole, and the locating element comprising a first cross-section within the first center surface and a second cross-section within the second center surface, the first cross-section is different from the second cross-section.

Preferably, the outline of the first cross-section is formed a first circumcircle; the outline of the second cross-section is formed a second circumcircle; the diameter of the first circumcircle is not equal with the diameter of the second circumcircle.

Preferably, the shape of the first cross-section is different from the shape of the second cross-section.

Preferably, the first cross-section and the second cross-section are located at different positions relative to the output shaft. And the shape of the first and the second cross-section may be in one of roundness, polygon and oval.

Preferably, the locating element comprises a centre hole for allowing the fastener to pass through and an outer peripheral surface around the centre hole, the outer peripheral surface comprises a first outline set axially for contacting the first connecting hole and a second outline set axially for contacting the second connecting hole.

Preferably, the outer peripheral surface comprises at least one conical surface, the first outline and the second outline are disposed on the conical surface.

Preferably, the outer peripheral surface at least comprises a first cylindrical surface and a second cylindrical surface; the first outline is disposed on the first cylindrical surface; the second outline is disposed on the second cylindrical surface.

Preferably, the first cylindrical surface and the second cylindrical surface are axially arranged at an interval or consecutively arranged in the axial direction.

Preferably, changes to the maximum radial size of the outer peripheral surface from the first outline to the second outline may be linear.

Preferably, changes to the maximum radial size of the outer peripheral surface from the first outline to the second outline may be nonlinear.

Preferably, the intersecting line is formed by the outer peripheral surface and the longitudinal sectional surface for allowing the center line of the center hole to pass through, and the intersecting line may be in one of a straight line, a curved line or an arced line.

Preferably, the locating element is a deforming element. The deforming element contacts the first connecting hole and forms a first circumcircle tangent to the first connecting hole in the first center surface; the deforming element contacts the second connecting hole and forms a second circumcircle tangent to the second connecting hole in the second center surface Preferably, the locating element comprises a form-fit portion for transporting torque from the output shaft to the cutting tool and an adapting portion for matching with the cutting tool.

Preferably, the adapting portion at least comprises a first adaptor and a second adaptor, the first adaptor and the second adaptor matching with different connecting holes with different shapes.

Preferably, the locating element comprises a plate shaped body, the form-fit portion is formed by a portion extended from the out circular peripheral of the plate shaped body along outer radial direction, the first adaptor and the second adaptor are formed by portions protruded from a side of the plate shaped body along axial direction.

Preferably, the form-fit portion comprises at least two form-fit elements extended from the out circular peripheral of the plate shaped body along the outer radial direction.

Preferably, the projection of the outline of the plate-like body on a plane vertical to the output shaft is polygonal.

Preferably, the second adaptor is disposed on one side of the first adaptor along axial direction, the radial dimension of the first adaptor is not equal with the radial dimension of the second adaptor.

Preferably, the first adaptor and the second adaptor on a plane vertical to the output shaft are different in the projection shape.

Preferably, at least one of the outlines of the first and the second adaptor may be conical surfaces or cylindrical surfaces.

Preferably, the projection of the outline of the first adaptor on a plane vertical to the output shaft is regular polygonal, and the second adaptor comprises at least two convex stands axially extending from the first adaptor.

Preferably, the locating element further comprises a third adaptor set relative to the first adaptor and the second adaptor along the axial direction, the radial dimension of the third adaptor is less than the radial dimension of the first adaptor or the second adaptor.

Preferably, the outline of the third adaptor is conical surface or cylindrical surface.

Preferably, the fastener comprises a pressing plate contacted to the cutting tool; the elastic element is disposed between the output shaft and the locating element.

Preferably, a stopping ring is disposed at the fastener to prevent the locating element from separation.

Preferably, the locating element is disposed in the output shaft; the elastic element is disposed between the output shaft and the locating element.

Preferably, a matching portion is disposed on the output shaft for matching with the form-fit portion. The elastic element is disposed between the output shaft and the locating element Preferably, a stopping ring is disposed at the fastener to prevent the locating element from separation.

Preferably, the oscillatory power tool comprises a locating element and an elastic element, the elastic element drives the locating element to always radially move towards a direction for contacting with the first connecting hole or the second connecting hole of the cutting tool.

Preferably, the various types of cutting tools comprise a first cutting tool and a second cutting tool, the first cutting tool comprises a first center surface paralleled with the fitting surface and a first connecting hole for the fastener passing through; the second cutting tool comprises a second center surface paralleled with the fitting surface and a second connecting hole for the fastener passing through, the locating element comprising at least two locating blocks disposed circumferentially, at least two locating blocks contacting with the first connecting hole and defining a first cross-section on the first center surface; the at least two locating blocks are contacted with the second connecting hole and defining a second cross-section on the second center surface, the location of the first cross-section is different from the location of the second cross-section relative to the output shaft.

Preferably, the friction surface is mainly formed by several prominent ribs. Preferably, the prominent ribs radially extend relative to the axis of the output shaft.

Preferably, the friction surface is formed by several axially protruding spindles. Preferably, the spindles are distributed in a cone or circular ring mode.

Preferably, the friction surface comprises a coating layer containing friction materials. Preferably, the coating layer is mainly made of metal materials.

Preferably, a depression is disposed on the driving part, and the oscillatory power tool further comprises a centering element matched with the depression.

Preferably, the centering element comprises a first surface, a second surface which is opposite to the first surface, a periphery wall connecting the first surface and the second surface, and a central positioning hole for penetration by a fastener, and a form-fit portion is disposed on the second surface matched with the securing section. Preferably, the first surface is a plane.

Preferably, at least two bumps are uniformly disposed on the periphery wall contacting the inner wall of the depression.

Preferably, the centering element is made of plastic or metal materials.

Preferably, the centering element is provided with expansion holes which are uniformly distributed in the circumference.

Preferably, the form-fit portion comprises a convex stand which surrounds the central positioning hole and axially extending from the second surface, and the side walls of the convex stand is regular polygons.

Preferably, the form-fit portion comprises at least three convex portions. The convex portions axially extend from the second surface and are distributed uniformly in the circumference. The convex portions are round tips which radially extend outward from the central positioning hole.

Preferably, the form-fit portion comprises at least three locking elements. The locking elements axially extend from the second surface and are distributed uniformly in the circumference, and located out of the central positioning hole.

Preferably, the cross-sections of the locking elements are shaped as any one of trapezoid, rectangle, triangle, arc, square, roundness and oval.

A centering element for an oscillatory power tool, the oscillatory power tool comprises an output shaft which drives a cutting tool to rotationally oscillate and a fastener which fixes the cutting tool on the output shaft, the cutting tool has a securing section capable of being connected to the output shaft, the tail end of the output shaft is provided with a driving portion which is matched with the securing section of the cutting tool the driving portion has a friction surface contacting the upper surface of the securing and a depression matched with the centering element, characterized in that the centering element comprising a first surface, a second surface which is opposite to the first surface, a periphery wall connecting the first surface and the second surface and a central positioning hole for penetration by a fastener, the second surface is provided with a form-fit portion which axially extends and is matched with the securing section, and the maximum distance between the first surface and the second surface is not greater than the axial depth of the depression.

The maximum distance between the first surface and the second surface is not greater than the axial depth of the depression, so the centering element does not impede the contact between the friction surface on the output shaft and the upper surface of the securing section on the cutting tool when assembled in the depression. The centering function is isolated from the fixation function and/or torque transmission function, thus reducing wear of the centering element. Relatively, the centering element can be made of relatively low-cost materials and correspondingly designed according to the cutting tools with various securing sections. Therefore, the cost is not increased on condition that the oscillatory power tool can be connected with various types of the cutting tools.

A fastening device for assembling various cutting tools on one oscillatory power tool is provided. The oscillatory power tool comprising an output shaft for installing the cutting tools and driving the cutting tools to rotationally oscillate, and the output shaft comprising a matching surface matched with the cutting tools; the various types of cutting tools comprising a first cutting tool and a second cutting tool, wherein the first cutting tool comprising a first securing section matched with the output shaft, and the first securing section comprising a first central surface parallel to the matching surface and a first connecting hole for penetration by a fastener; the second cutting tool comprising a second securing section matched with the output shaft; the second securing section comprising a second center surface parallel to the matching surface and a second connecting hole for penetration by the fastener, the fastening device comprising a fastener connected with the output shaft and a locating element arranged on the fastener, wherein the locating element is capable of contact at least part of the first connecting hole and at least part of the second connecting hole, and has the locating element comprising a first cross-section within the first center surface and a second cross-section within the second center surface, the first cross-section surface and is different from the second cross-section.

The fastening device is provided a locating element. The locating element can form different cross-sections on the corresponding center surface when contacting the first or second cutting tool, so the locating element can be adapted to many different types of cutting tools. Moreover, the locating element with the location function is provided, and then the location function is isolated from the fixation function and/or torque transmission function, thus reducing wear of the locating element.

Preferably, the locating element is a deforming element. The deforming element contacts the first connecting hole and forms a first circumcircle tangent to the first connecting hole in the first center surface; the deforming element contacts the second connecting hole and forms a second circumcircle tangent to the second connecting hole in the second center surface.

Preferably, the oscillatory power tool also comprises an elastic element, the elastic element drives the locating element to always axially move towards a direction for contacting with the first connecting hole or the second connecting hole, and the fastener comprises a pressing plate contacting the cutting tool. The elastic element is located between the pressing plate and the locating element.

DETAILED DESCRIPTION OF THE INVENTION

The invention relates to an oscillatory power tool for coupling many kinds of cutting tools. Wherein, exiting cutting tools are classified into many varieties. The specific embodiments of the invention only use several typical cutting tools to describe the creation concept of the invention. Of course, cutting tools not listed also apply to the invention. The invention is described in further detail with reference to attached drawings and specific embodiments.

Figure 1:
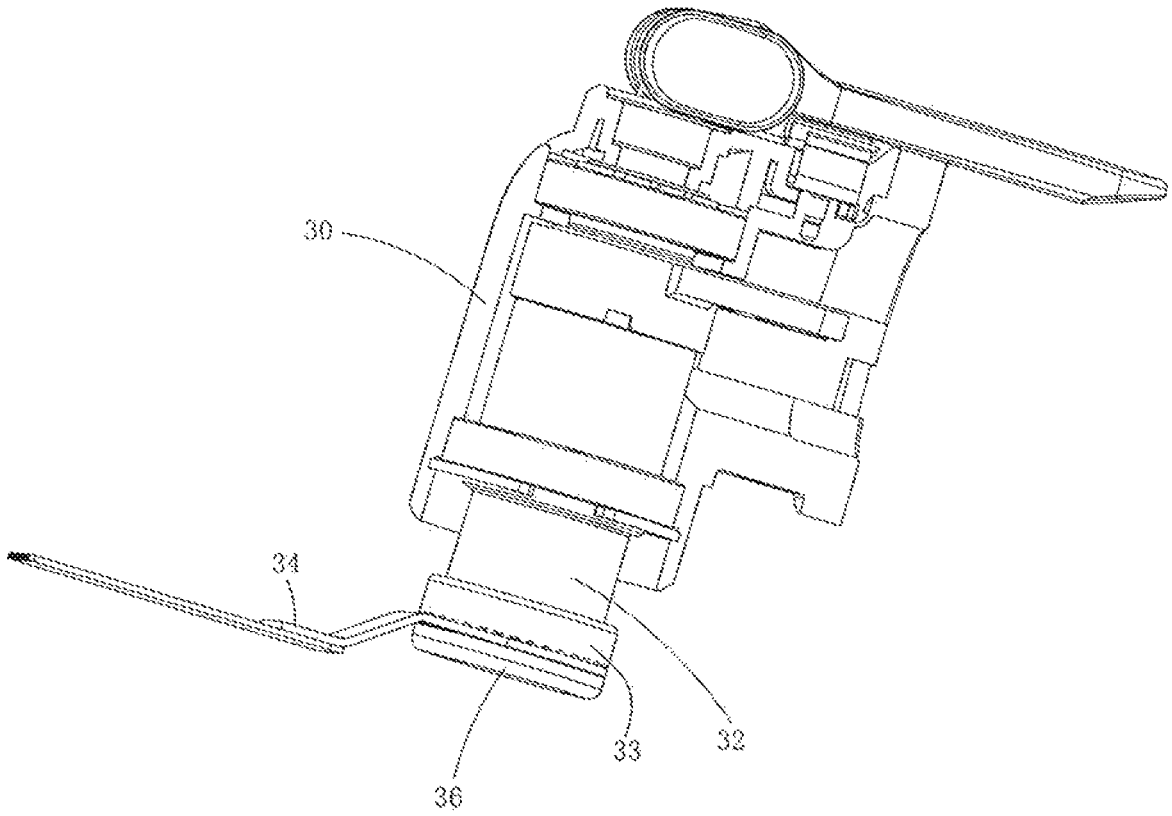
FIG. 1 is a schematic view of the head area without some of the housing in the first embodiment of the oscillatory power tool of the invention.

As shown in FIG. 1, the oscillatory power tool comprises a housing 30, a motor (not shown in the figure) installed in the housing 30, an output shaft 32 driven by the motor and a cutting tool 34 installed below the output shaft 32. A fastener 36 penetrates through the cutting tool 34 and then is connected to the tail end of the output shaft 32, such that the cutting tool 34 is fixed on the output shaft 32 and can be driven by the output shaft 32 to move.

Figure 2:
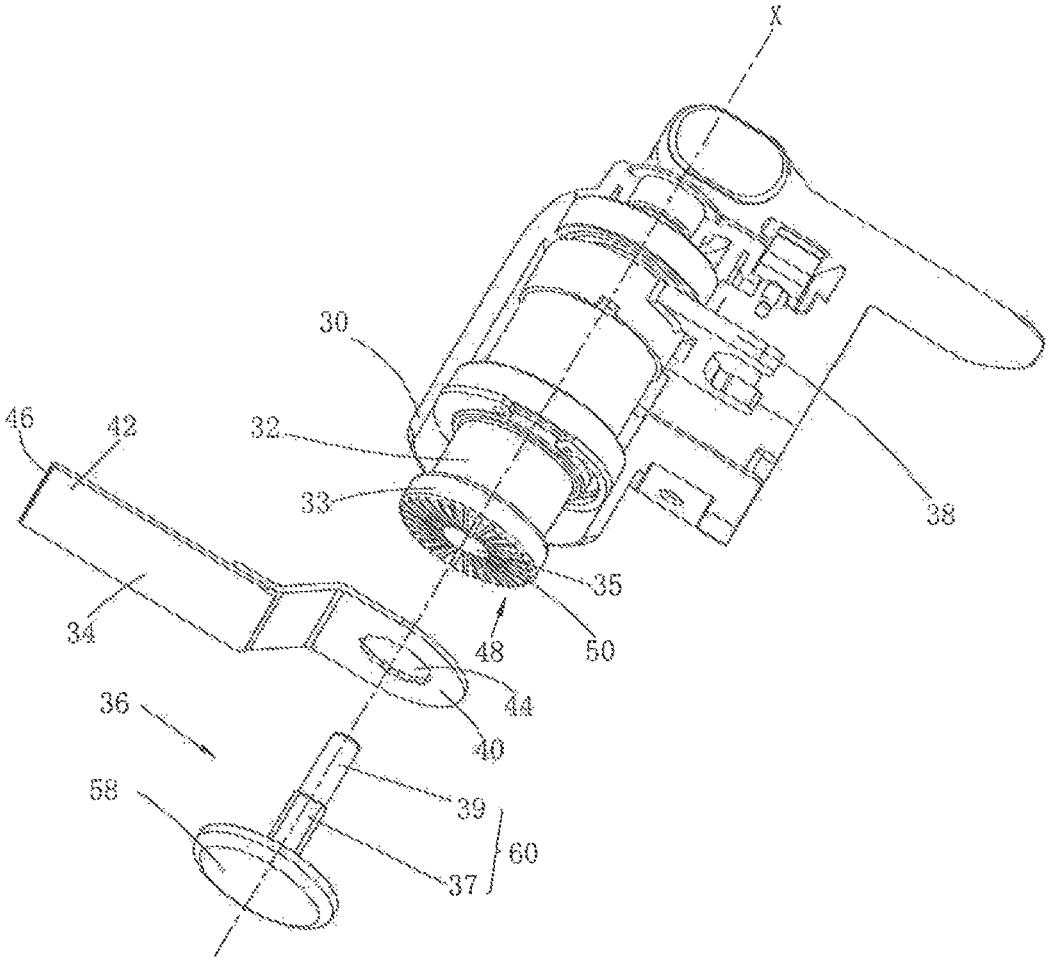
FIG. 2 is a three-dimension exploded view of the head area without some of the housing in the first embodiment of the oscillatory power tool of the invention.

As shown in FIG. 1 and FIG. 2, the output shaft 32 is lengthwise installed in the housing 30, and the tail end thereof extends out of the housing 32 by a certain length. The output shaft 32 is equipped with a pivot element 38. The motor drives an eccentric device (not shown in the figure) to rotate together. Then, the eccentric device drives the pivot element 38 to realize rotary oscillation, and thus the output shaft 32 conducts rotary oscillation. The tail end of the output shaft 32 is provided with a connecting flange 33 with a relative big diameter. The connecting flange 33 is provided with a circular hole 35 through which the fastener 36 penetrates. The connecting flange 33 is integrated with the output shaft 32 and also can be fixedly installed on the output shaft 32. In the invention, the connecting flange 33 is fixedly installed on the output shaft 32 (refer to FIG. 4).

Here, it should be pointed out that the output shaft 32 can be directly provided with a tapped blind hole, and that the fastener 36 is a fastening bolt including a pressing plate 58 and a rod part 60 which axially extends from the middle part of the pressing plate 58. The rod part 60 comprises a connecting portion 37 in connection with the pressure plate 58 and a screw portion 39 connected with the connecting portion 37. To install the cutting tool, it only needs to penetrate the fastener 36 through the cutting tool 34 and connect the fastener with the tapped blind hole, and thus the cutting tool can be fixed on the output shaft. But in this embodiment, in order to quickly assemble or disassemble the cutting tool and provide a bigger axial pressing force, the oscillatory power tool is provided with a quick clamping mechanism, which is described in detail later.

As shown in FIG. 2, the cutting tool 34 is a straight saw blade. Those skilled in this field can easily figure out that the cutting tool 34 may be other attachments such as the circular saw blade, sand tray and scrapper. The cutting tool 34 is made of metal, including a securing section 40 connected to the connecting flange 33 and a cutting portion 42. The securing section 40 is provided with a connecting hole 44 for allowing the fastener 36 to pass through. In this embodiment, the connecting hole 44 is dodecagonal. Of course, here, the connecting hole 44 may be any other shape, such as regular polygons and roundness etc. The tail end of the cutting portion 42 is provided with teeth 46 with a cutting function.

A driving section 48 is disposed on the connecting flange 33 at the tail end of the output shaft 32. The driving section 48 comprises a matching surface which contacts with the upper surface of the securing section 40 of the cutting tool 34. When the cutting tool 34 is fixed on the output shaft 32, the upper and lower surfaces of the cutting tool 34 are respectively adhered between the fastener 36 and the matching surface. Here, the matching surface and the upper surface of the cutting tool 34 generate a friction force which is big enough, so the oscillatory power tool can transmit the oscillation torque of the output shaft 32 to the cutting tool 34 during working and is guarded against slip.

Figure 3:
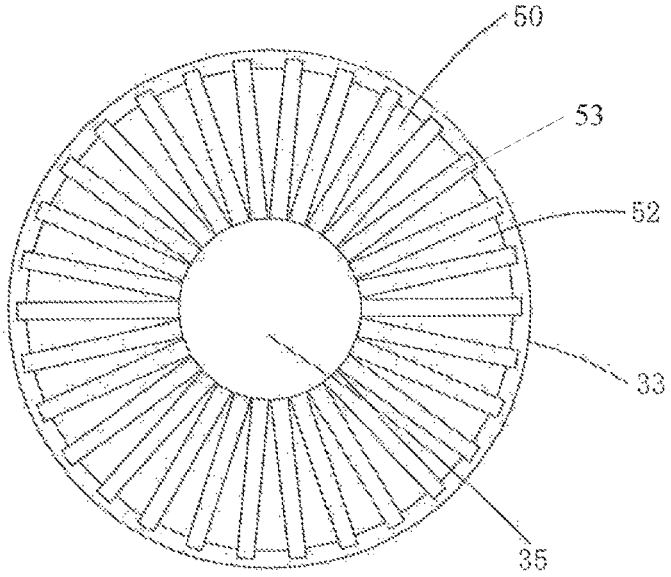
FIG. 3 is a schematic view of a friction surface in the first embodiment of the oscillatory power tool of the invention.

As shown in FIG. 3, the matching surface may be a smooth surface or a friction surface. In this embodiment, the matching surface is a friction surface 50. The friction surface 50 is formed by a plurality of prominent ribs 52 arrayed regularly and recesses 53 defined between adjacent ribs 52. Those prominent ribs 52 are approximately sectors, radiating inwards in the radial direction and intersected at the outer edge of the circular hole 35. The cross-sections may be trapezoid, rectangular, semi-round, oval, etc., while the tops may be relatively sharp. In this embodiment, the cross-sections are rectangular. Of course, those prominent ribs 52 may also radiate outwards along the radial direction of any circles concentric to the circular hole 35, or arrayed in a mesh mode. Furthermore, the prominent ribs 52 may also be set as curves, such as "S-curves", and distributed on the output shaft irregularly.

Figure 4:
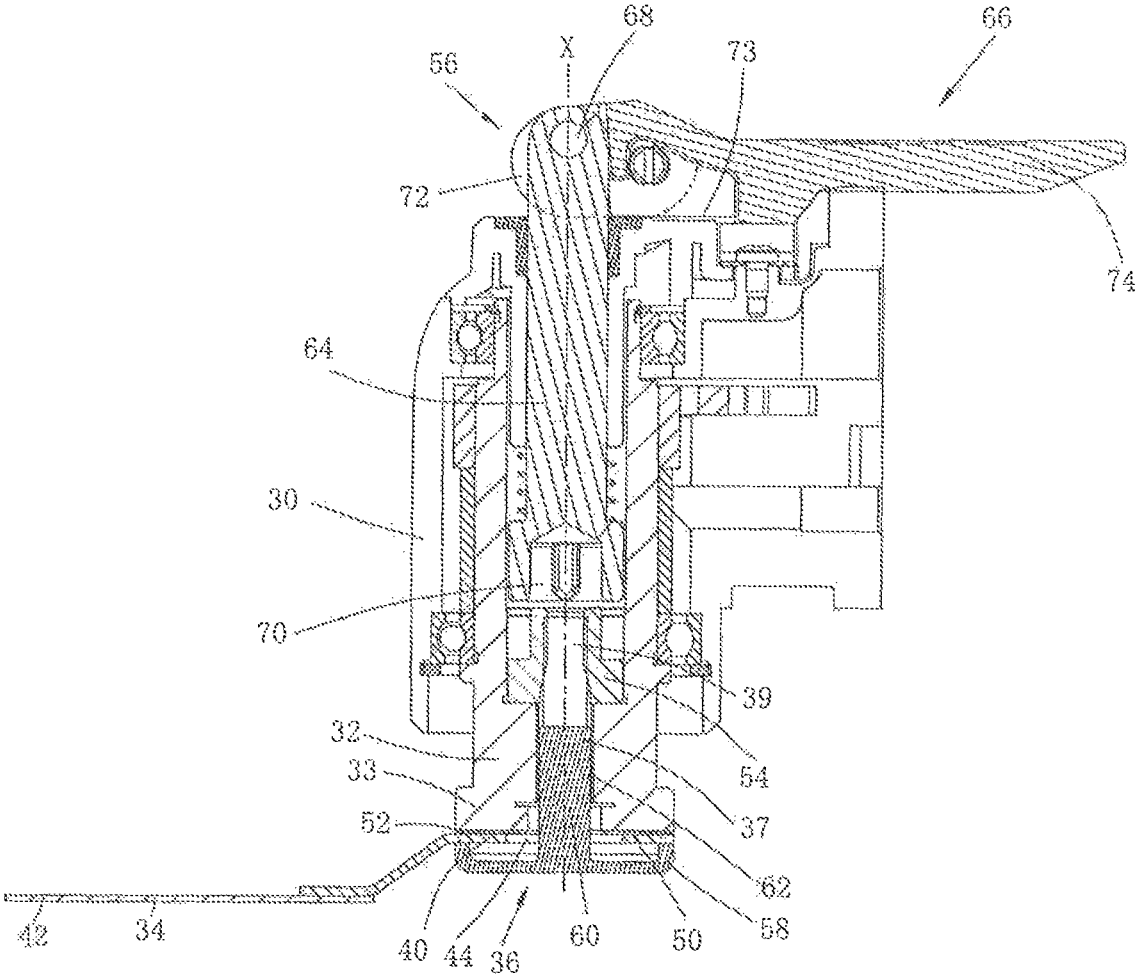
FIG. 4 is a sectional view of cutting holes installed on the friction surface as shown in FIG. 3 in the first embodiment of the oscillatory power tool of the invention.

As shown in FIG. 4, the quick clamping mechanism comprises a fastening element 54 and a driving mechanism 56 which can rotate around the axis X of the output shaft 32. When rotating along on direction, the driving mechanism 56 can drive the fastening element 54 and the fastener 36 to be fastened in a threaded way; and then, when rotating along the opposite direction, the driving mechanism 56 can drive the fastening element 54 and the fastener 36 to be unfastened.

The fastening element 54 is received in the cavity of the output shaft 32. The fastening element 54 is approximately circular-shaped and can rotate freely in the cavity, but does not generate axial displacement; the middle part is axially provided with a thread hole which is connected with the screw part 39 of the fastener 36. The cross-section of the connecting portion 37 of the fastener 36 is approximately square, and the output shaft 32 is provided with a through hole 62 for receiving the connecting portion 37. The cross-section of the through hole 62 is also approximately square, so when the connecting portion 37 is inserted in the through hole 62, the fastener 36 cannot rotate with respective to the output shaft 32. Therefore, the cutting tool is further prevented from slip.

The driving mechanism 56 comprises a pushing rod 64 for engagement with the fastening element 54 and driving the fastening element 54 to rotate and an operating element 66 for operating the pushing rod 64 to move. The top of the pushing rod 64 is equipped with a pivot shaft 68, while the bottom is provided with a groove 70. Wherein, the axis of the pivot shaft 68 is transverse to the axis X of the output shaft 32. The groove 70 is sleeved on the outer periphery of the fastening element 54 and drives the fastening element 54 to rotate through an engagement device. The operating element 66 is pivoted to the top of the pushing rod 64 through the pivot shaft 68, provided with a cam portion 72 on one side thereof relative to the pivot shaft 68 and having a handle 74 on the other side that extends in a way of being approximately horizontal to the cam portion 72. Wherein, when the handle 74 is operated to rotate around the axis of the pivot shaft 68, the cam portion 72 contacts an upper surface 73 of the housing so as to drive the pushing rod 64 to move up and down.

To install a cutting tool, it only needs to operate the handle 74 to rotate around the axis of the pivot shaft 68 so as to the pushing rod 64 to move downward. In this way, the groove 70 of the pushing rod 64 is engaged with the fastening element 54. In such circumstances, the handle 74 can be operated to rotate around the axis X of the output shaft 32 along the screwing direction and therefore drive the fastening element 54 to rotate together; then, the fastening element 54 is fastened with the screw portion 39 of the fastener 36; and thus, the cutting tool 34 is fixed on the output shaft 32.

When the cutting tool 34 is required to be demounted, it only needs to operate the handle 74 to drive the pushing rod 64 to move downward such that the groove 70 of the pushing rod 64 is engaged with the fastening element 54. In such circumstances, the handle 74 is operated to rotate around the axis X of the output shaft 32 so as to drive the fastening element 54 to rotate together until the fastening element 54 is completely disengaged with the fastener 36 in threaded connection. Then, the fastener 36 is disassembled from the output shaft 32, and the cutting tool 34 can be taken out. The connecting hole 44 on the securing section 40 of the cutting tool 34 is closed, so it is required to completely separate the fastening element 54 from the fastener 36 to take it down from the output shaft 32, and then the fastener 36 is penetrated through the connecting hole 44 of the cutting tool 34 and then installed of the output shaft 32. Of course, the opening of the cutting tool may be processed to be non-closed, and a gap is reserved for penetration by the fastener. In such cases, it is not required to completely take down the fastening element from the fastener, and it is only required to unscrew the fastener such that a gap for penetration by the securing section of the cutting tool is reserved between the fastening element and the output shaft.

As shown in FIG. 2, FIG. 3 and FIG. 4, when the oscillatory power tool uses the cutting tool, the cutting tool 34 is placed below the output shaft 32 below, and the upper surface of the securing section 40 of the cutting tool 32 is adhered to the prominent ribs 52 of the output shaft 32. The prominent ribs 52 can realize connection of a large force between the output shaft 32 and the cutting tool 34 in the axial direction and the circumferential direction, the transmitted torque is big enough, thus avoiding relative slip between the cutting tool 34 and the output shaft 32.

During working, the output shaft 32 is driven by the motor (not shown in the figure) to rotationally oscillate. The output shaft 32 is provided with the friction surface 50 formed by the prominent ribs 52 to generate a friction force big enough between the output shaft 32 and the upper surface of the securing section 40 of the cutting tool 34, so the oscillation torque output by the output shaft 32 is further transmitted to the cutting tool 34 to drive the cutting tool 34 to oscillate.

A relatively big space between adjacent prominent ribs 52 can also receive dirt and dust on the securing section 40 of the cutting tool 34, thus ensuring ensure good contact between the prominent ribs 52 and the cutting tool 34 of securing section 40 even if the cutting tool is stained.

Figure 5:
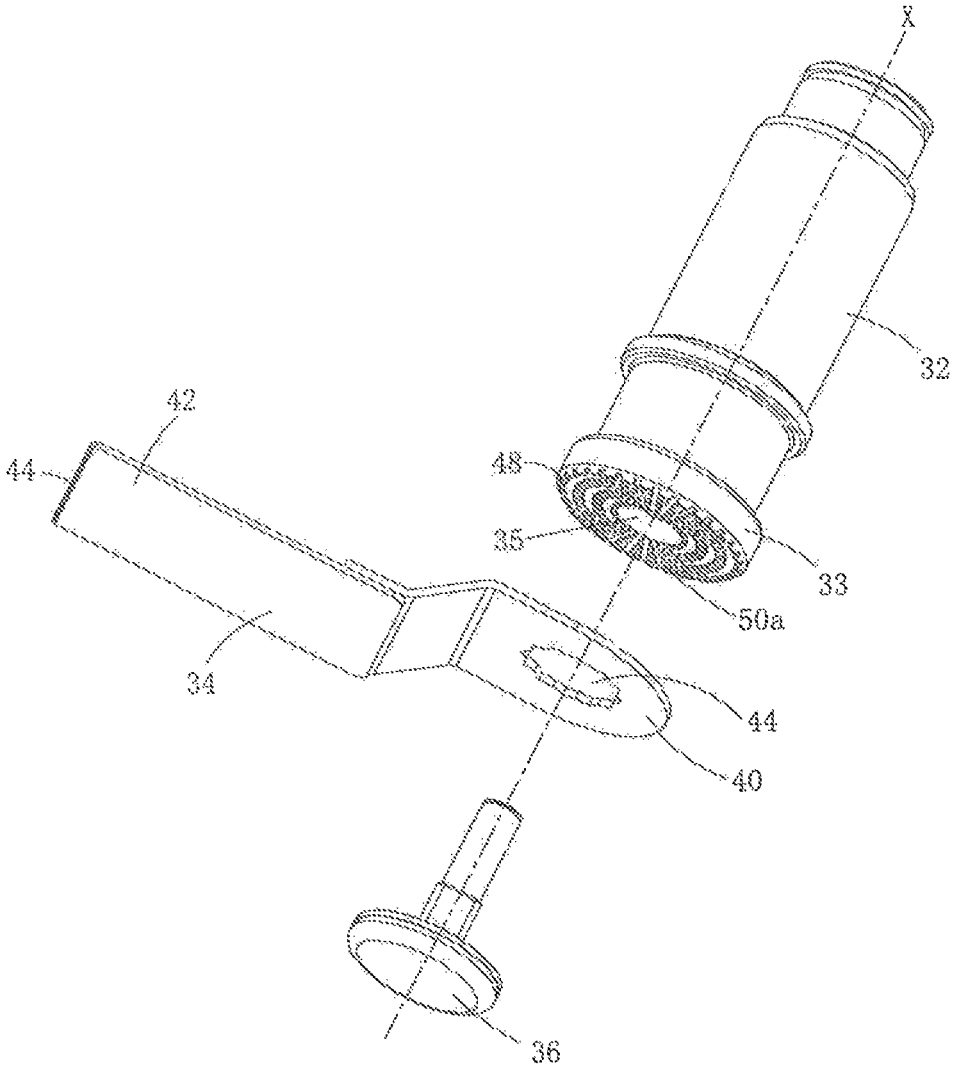
FIG. 5 is a three-dimension exploded view of the cutting tool matched with another friction surface in the first embodiment of the oscillatory power tool of the invention.
Figure 6:
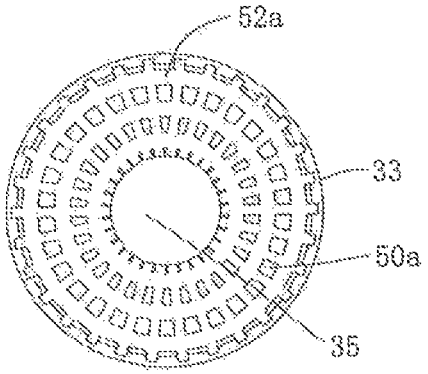
FIG. 6 is a schematic view of the friction surface as shown in FIG. 5.
Figure 7:
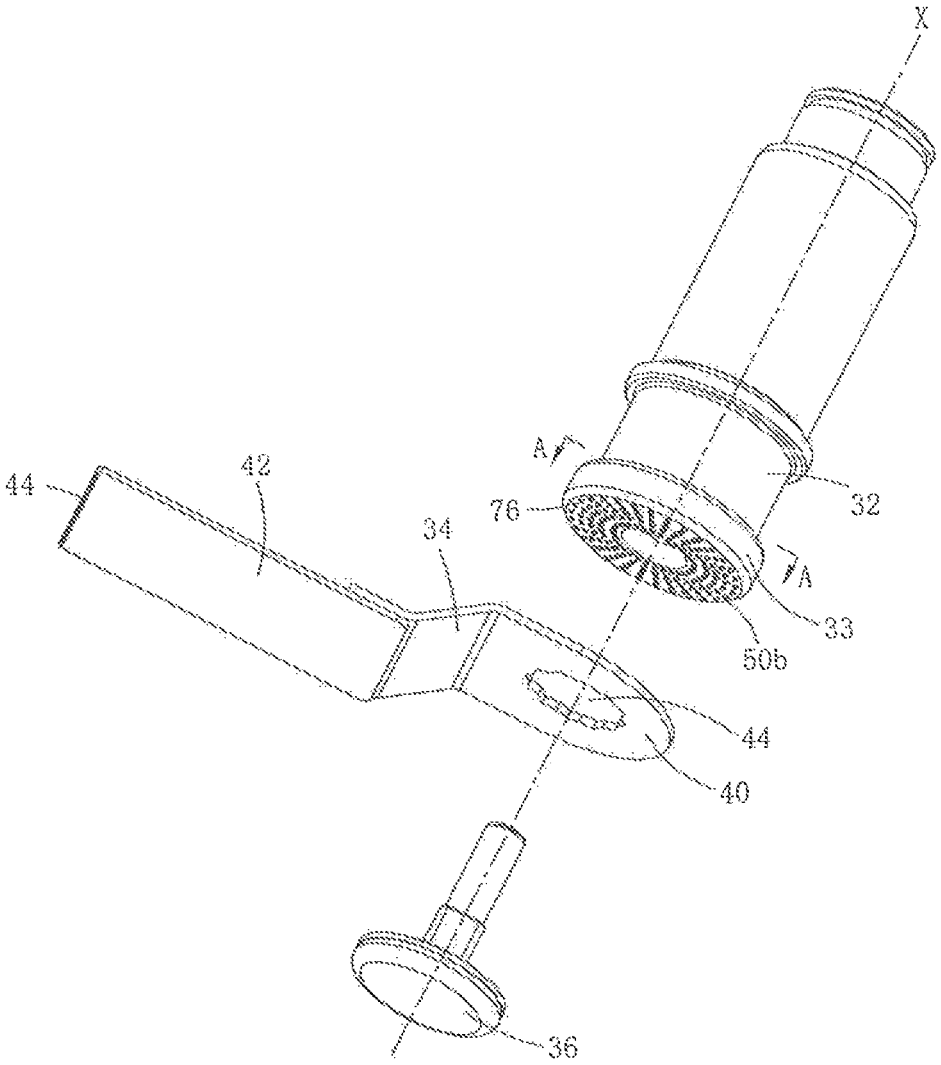
FIG. 7 is a three-dimension exploded view of the cutting tool matched with another friction surface in the first embodiment of the oscillatory power tool of the invention.
Figure 8:
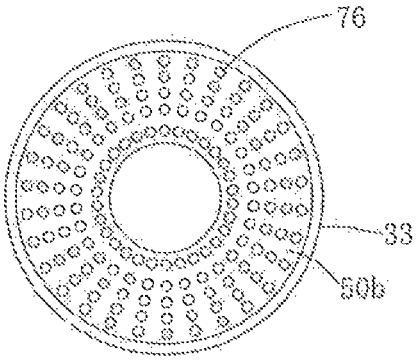
FIG. 8 is a schematic view of the friction surface as shown in FIG. 7.
Figure 9:
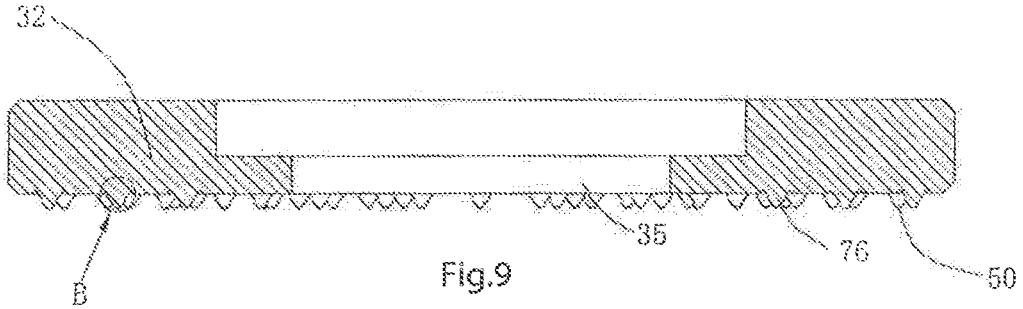
FIG. 9 is a sectional view in A-A direction as shown in FIG. 7.
Figure 10:
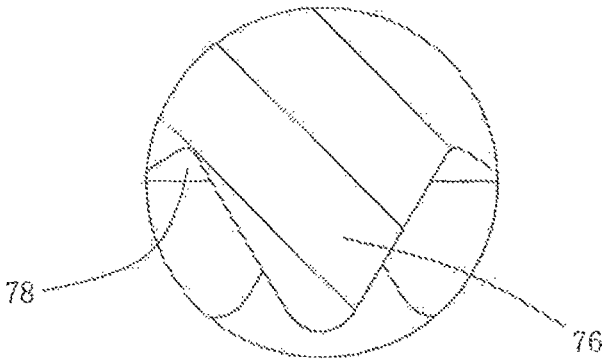
FIG. 10 is an amplified view of position B in FIG. 9.

Of course, the friction surface may be in other shapes. As shown in FIG. 5 and FIG. 6, the friction surface 50*a* is different from the friction surface 50 in that: the prominent ribs 52*a* of the friction surface 50*a* are not complete ribs, but separated by several circular rings concentric to the axis X of the output shaft 32. In this way, the friction surface 50*a* is formed by several convex portions which are arranged regularly. Thus, more dirt and dust on the securing section 40 of the cutting tool 34 can be received without affecting the friction force between the friction surface 50*a* and the upper surface of the securing section 40. During working, the output shaft 32 is driven by the motor (not shown in the figure) to rotationally oscillate. The output shaft 32 is provided with the friction surface 50*a* to generate a friction force big enough between the output shaft 32 and the upper surface of the securing section 40 of the cutting tool 34, so the oscillation torque output by the output shaft 32 is transmitted to the cutting tool 34 to drive the cutting tool 34 to oscillate.

As shown in FIGS. 7-10, the friction surface 50*b* is different from the friction surface 50 in that: the friction surface 50*b* is formed by several spindles 76 which are arranged regularly. The several spindles 76 are approximately circular cone-shaped, and an annular recessing portion 78 is located on periphery of each spindle 76. When the cutting tool 34 is installed on the output shaft 32, the top of the spindle 76 is pressed against the upper surface of the securing section 40 of the cutting tool 34. The spindle 76 can realize transmission of a large force between the output shaft 32 and the cutting tool 34, and the transmitted torque is big enough, thus ensuring no relative slip between the cutting tool 34 and the output shaft 32. During working, the output shaft 32 is driven by the motor (not shown in the figure) to rotationally oscillate. The output shaft 32 is provided with the friction surface 50*b* formed by the spindles 76 to generate a friction force big enough between the output shaft 32 and the securing section 40 of the cutting tool 34, so the oscillation torque output by the output shaft 32 is further transmitted to the cutting tool 34 to drive the cutting tool 34 to oscillate.

The above recessing portion 78 can receive dirt and dust on the securing section 40 of the cutting tool 34, thus ensuring good contact between the spindle 76 and the upper surface of the securing section 40 even if the cutting tool is stained. The spindles 76 may be square, rectangular or be in other geometric shapes as long as a rough friction surface is formed; moreover, the spindles 76 may be arranged on the output shaft 32 regularly or irregularly.

Figure 11:
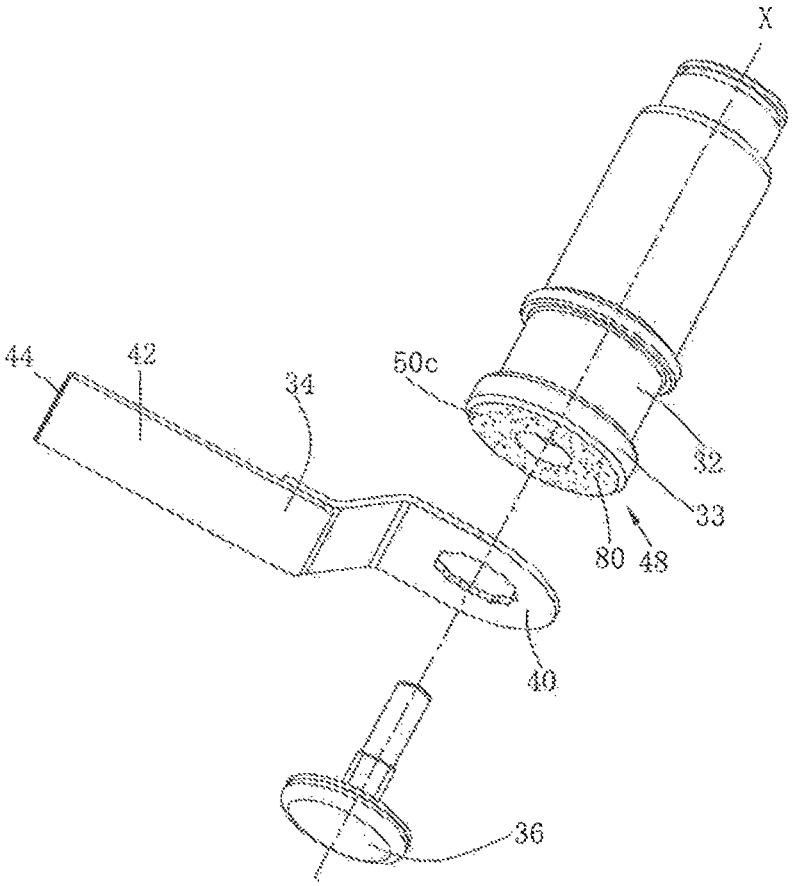
FIG. 11 is a three-dimension exploded view of the cutting tool matched with another friction surface in the first embodiment of the oscillatory power tool of the invention.

As shown in FIG. 11, the fiction surface 50*c* is different from the friction surface 50 in that the friction surface 50*c* includes a coating layer 80 with a friction material. When the cutting tool 34 is installed on the output shaft 32, the upper surface of the securing section 40 of the cutting tool 34 is adhered to the coating layer 80. The coating layer 80 can realize transmission of a large force between the output shaft 32 and the cutting tool 34 in the axial direction and the circumferential direction, and the transmitted torque is big enough, thus ensuring no relative slip between the cutting tool 34 and the output shaft 32. During working, the output shaft 32 is driven by the motor (not shown in the figure) to rotationally oscillate. The output shaft 32 is provided with the coating layer 80 to generate a friction force big enough between the output shaft 32 and the upper surface of the securing section 40 of the cutting tool 34, so the oscillation torque output by the output shaft 32 is further transmitted to the cutting tool 34 to drive the cutting tool 34 to oscillate.

Of course, the output shaft 32 may also be not provided with the coating layer 80, while the tail end of the connecting flange 33 of the output shaft 32 is directly grinded to form a friction surface.

In conclusion, the friction force generated between the friction surface and the upper surface of the cutting tool is big enough and can transmit the oscillation torque on the output shaft to the cutting tool and prevent the cutting tool from slipping. Due to the close fit of the friction surface with the upper surface of the cutting tool, the connecting hole of the cutting tool can be in any shape. Therefore, through setting the output shaft with the friction surface, the cutting tools of the oscillatory power tool for different application can be firmly installed on the output shaft, which greatly improves the universality and convenience of the oscillatory power tool.

As shown in FIGS. 12-17, the cutting tool can be quickly and conveniently installed in place during installation, meaning that the centre line of the connecting hole of the cutting tool is superposed with the axis X of the output shaft 32. The oscillatory power tool can also be matched with a centering element 82.

The second embodiment of the invention is basically structurally the same with the first embodiment, but different in that the connecting flange 33 of the output shaft 32 is provided with a depression 84 matched with the centering element 82. The depression 84 extends axially inwards from the friction surface 50, and the axial depth is H. The depression 84 has a circular inner wall 98, and the center line thereof is superposed with the axis X of the output shaft 32. In this embodiment, the cross section of the depression 84 is round, also it may be rectangular, square, regularly polygonal, etc. Therefore, the shape of the centering element 82 matched with the depression may be rectangular, square, regularly polygonal, etc.

The centering element 82 is installed between the output shaft 32 and the cutting tool 34. The centering element 82 is approximately cylindrical, including a first surface 86 facing the depression 84, a second surface 88 facing the cutting tool 34, a periphery wall 90 connecting the first surface 86 and the second surface 88, and a central positioning hole 92 for allowing the fastener 36 to pass through.

Wherein, the first surface 86 is opposite to the depression 84 of the output shaft 32 and can be provided with some friction surfaces or convex portions matched with the depression 84. However, in this embodiment, the first surface 86 may be a plane which does not need the friction surfaces or convex portions. Particularly, the second face 88 is facing to the cutting tool 34 and provided with a form-fit portion 94 matched with the securing section 40 of the cutting tool 34. When the form-fit portion 94 is just matched with the securing section 40 of the cutting tool 34, the cutting tool can be centered conveniently.

In this embodiment, the first surface 86 and the second surface 88 are arranged in parallel, at an interval of L. The interval L between the first surface 86 and the second face 88 is not greater than the axial depth H of the depression 84. Thus, when assembled in the depression 84 the centering element 82 does not affect contact between the upper surface of the securing section 40 of the cutting tool 34 and the friction surface 50. Of course, the first surface 86 and the second surface 88 can also be not in parallel, but the maximum interval between the two cannot be greater than the axial depth H of the depression 84.

To match with various cutting tools, the centering element 82 is limited in a diameter scope of 22-30 mm, and may be 25 mm, 27 mm, etc.

The form-fit portion 94 is a hollow convex stand 96 which extends axially from the second surface 88, wherein the convex stand 96 extends around the center position hole 92 in a radial direction. In this embodiment, the outer peripheral surface of the convex stand 96 is regularly hexagonal, just matched with the regularly dodecagonal connecting hole 44 of the cutting tool 34.

It can be understood that, when the connecting hole of the cutting tool changes, the form-fit portion may also be in other shapes matched with the connecting hole of the cutting tool. Here, the outer peripheral wall of the convex stand 96 may be in other regular polygons, roundness or other irregular shapes.

The centering element 82 may be made of plastic or metal materials. In this embodiment, the centering element 82 may be made of plastics.

To better adhere to the inner wall 98 of the depression 84, the periphery wall 90 of the centering element 82 is uniformly provided with at least two bumps 100 which contact the inner wall 98 of the depression 84.

In this embodiment, the periphery wall 90 is provided with a total of four bumps 100. The quantity of the bumps 100 is not limited. In addition, the bumps 100 can be distributed regularly or irregularly on the periphery wall 90.

The centering element 82 is provided with expansion holes 102 which are uniformly distributed in the circumference. The expansion holes 102 can the centering element 82 deform at a certain degree when the centering element 82 is assembled in the depression 84 to facilitate installation of the centering element 82, and can also provide convenience to the operator to remove the centering element 82 from the depression 84 using tools.

The quantity of the expansion holes 102 is not limited. In addition, the expansion holes 102 may be through holes penetrating through the first surface 86 and the second surface 88, or the blind holes. Moreover, the expansion holes 102 may be irregularly or regularly distributed on the first surface 86 and the second surface 88.

In this embodiment, to make the expansion holes 102 perform better deformation, the specification and position of the expansion holes 102 can be set in this way: the expansion holes 102 correspond to the bumps 100 one by one in circumference. The expansion holes 102 in the extension direction are longer than the bumps 100 in the extension direction. The circle formed by the center lines of the expansion holes 102 is concentric to the center positioning hole 92, and the radius of the circle where the expansion holes 102 exist is twice that of the center positioning hole 92.

Figure 13:
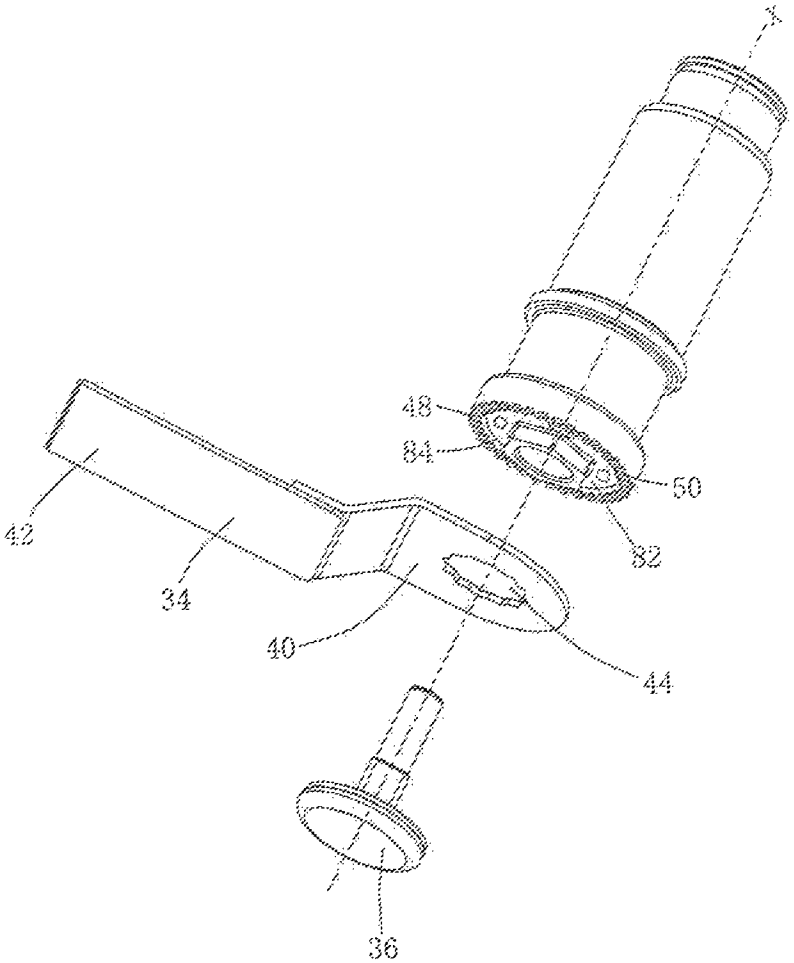
FIG. 13 is a three-dimension exploded view of the cutting tool, output shaft and centering element in the second embodiment of the oscillatory power tool of the invention, wherein the centering element is received in the depression of the output shaft.
Figure 12:
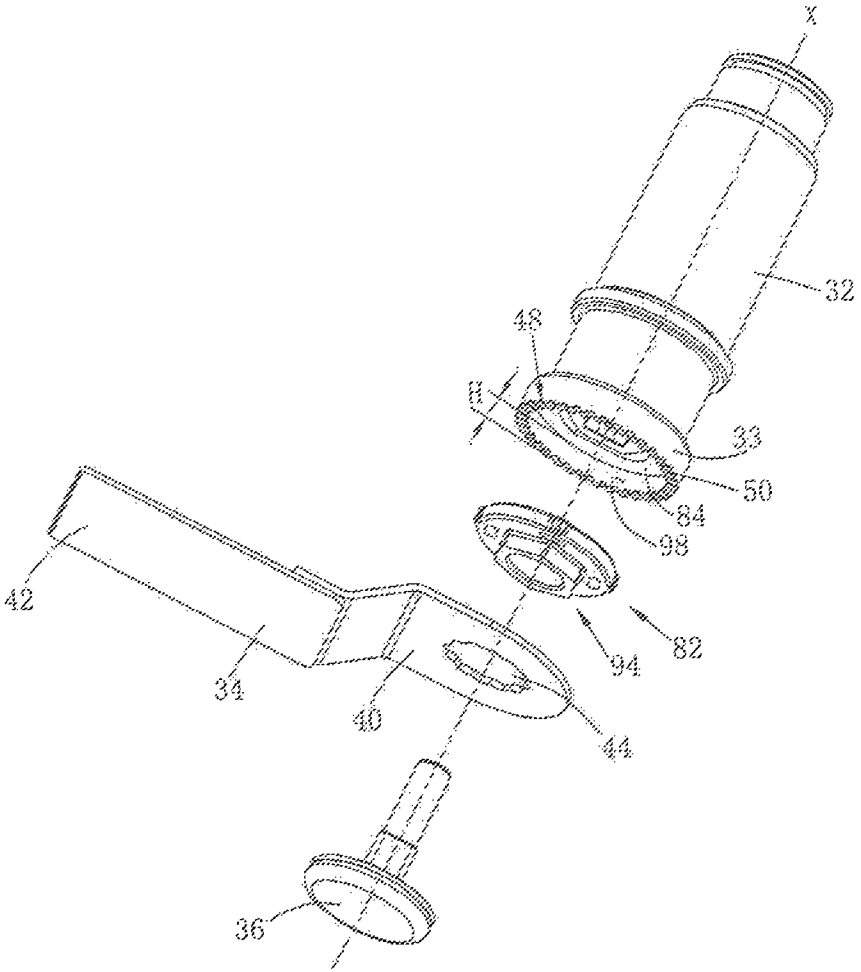
FIG. 12 is a three-dimension exploded view of the cutting tool, output shaft and centering element in the second embodiment of the oscillatory power tool of the invention.
Figure 14:
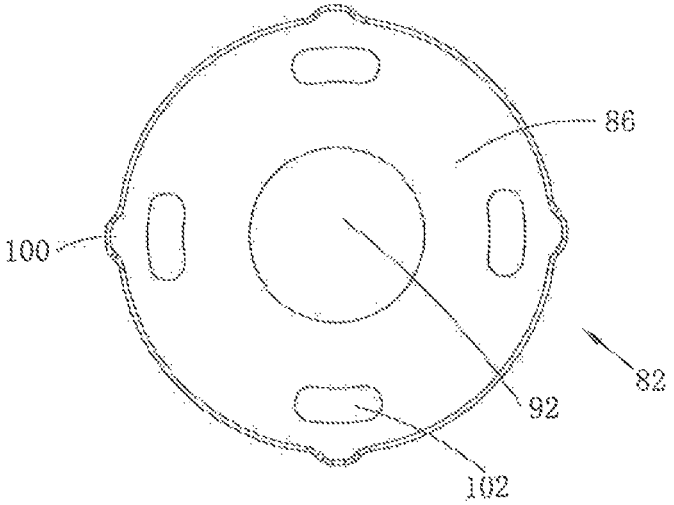
FIG. 14 is a schematic view of the first surface of the centering element as shown in FIG. 12.
Figure 15:
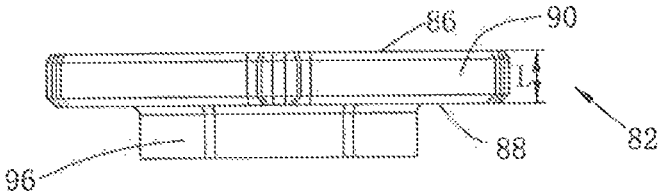
FIG. 15 is a lateral view of the centering element as shown in FIG. 12.
Figure 16:
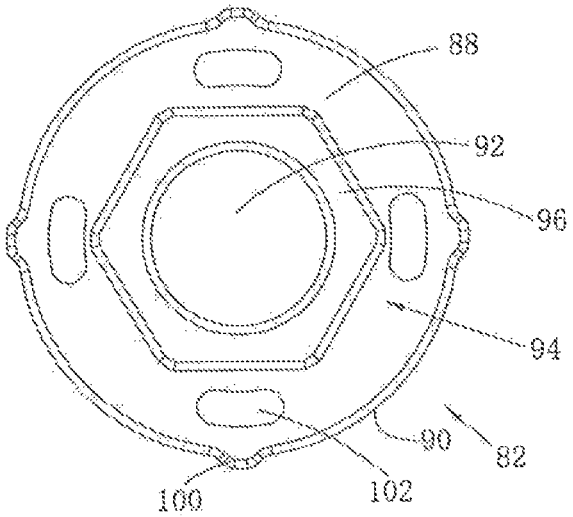
FIG. 16 is a schematic view of the second surface of the centering element as shown in FIG. 12.
Figure 17:
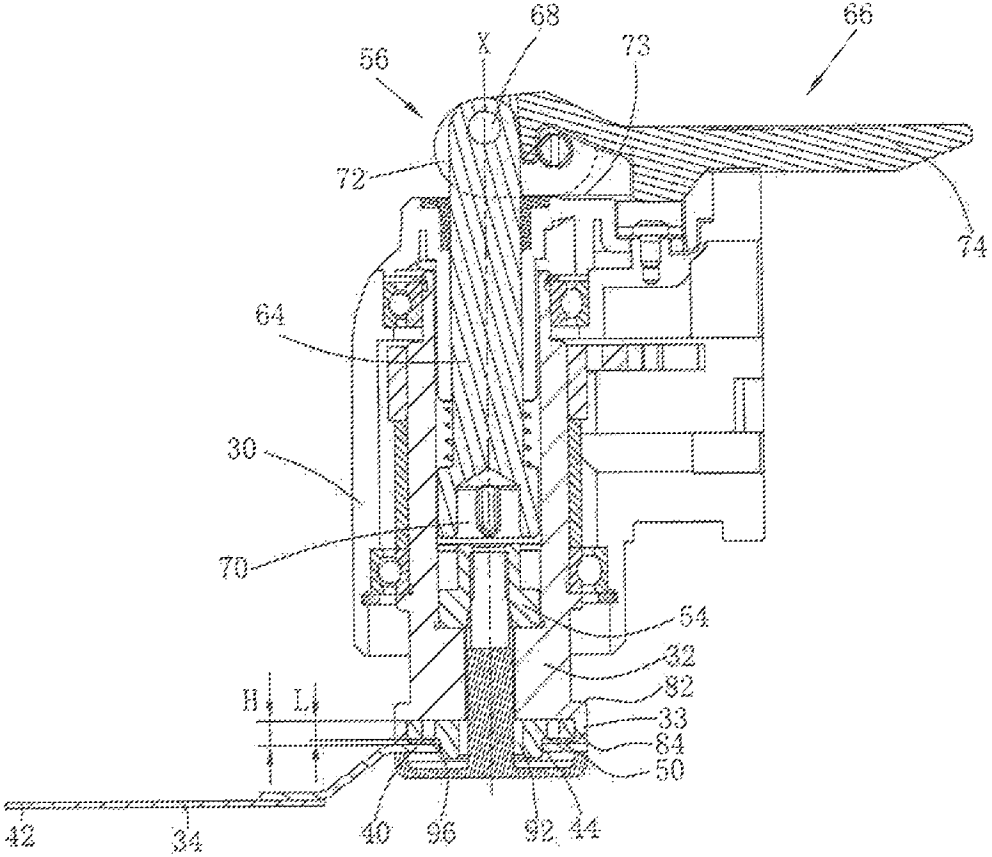
FIG. 17 is a sectional view of the cutting tool that is installed on the output shaft through the centering element in the second embodiment of the oscillatory power tool of the invention.
Figure 19:
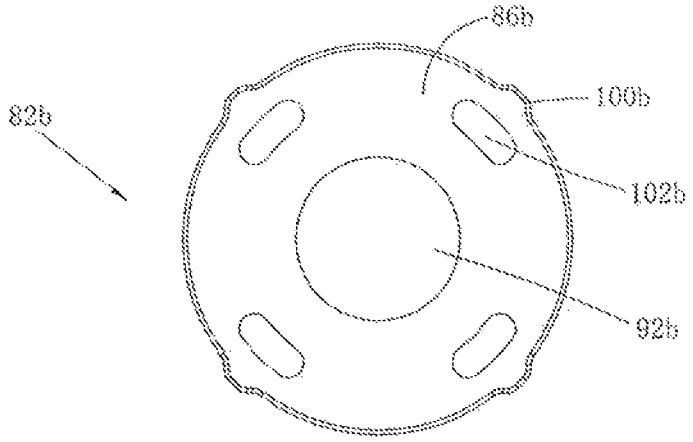
FIG. 19 is a schematic view of the first surface of the centering element as shown in FIG. 18.
Figure 20:
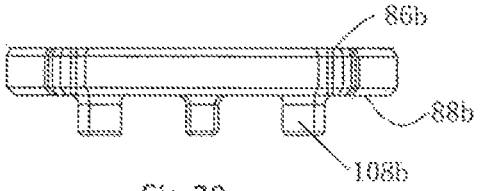
FIG. 20 is a lateral view of the centering element as shown in FIG. 18.
Figure 21:
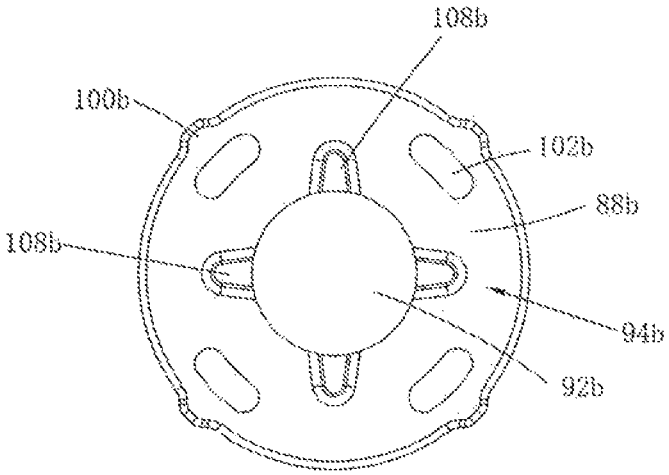
FIG. 21 is a schematic view of the second surface of the centering element as shown in FIG. 18.

As shown in FIG. 12, FIG. 13 and FIG. 17, to install the cutting tool 34 on the output shaft 32, install the centering element 82 in the depression 84 first; then, sleeve the cutting tool 34 on the centering element 82, match the securing section 40 of the cutting tool 34 with the form-fit portion 94 of the centering element 82 such that the center line of the cutting tool 34 is superposed with the axis X of the output shaft 32; next, penetrate the fastener 36 through the connecting hole 44 such that the center positioning hole 92 is matched with the thread hole; and finally, operate the handle 74 to rotate around the axis of the pivot shaft 68 to drive the pushing rod 64 to move downward such that the groove 70 of the pushing rod 64 is engaged with the fastening element 54. In such circumstances, the handle 74 can be operated to rotate around the axis X of the output shaft 32 along the fastening direction to drive the locking element 54 to rotate together. The locking element 54 is locked with the fastener 36 in a threaded way so as to fix the cutting tool 34 on the output shaft 32.

To assemble the centering element 82 in the depression 84, the centering element 82 can be closely matched with the depression 84 to be limited in rotation relative to the depression 84. Of course, the centering element 82 may also spaced from the depression 84 at a relatively large distance so as to conveniently rotate relative to the depression 84. A friction force which is big enough is generated between the friction surface 50 and the upper surface of the securing section 40 of the cutting tool 34, while the friction surface 50 ensure that the securing section 40 of the cutting tool 34 will not slip relative to the output shaft 32 in the axial and circumferential directions; moreover, the fastening element 54 and the fastener 36 are locked in a threaded way to fixedly install the cutting tool 34 on the output shaft 32. Thus, the centering element 82 can rotate relative to the depression 84 even during installation, but if locked by the fastening element 54 and the fastener 36 in a threaded way, will oscillate together with the cutting tool 34 as the output shaft 32 oscillates.

In the prior art, the convex portions on the output shaft are matched with the star-shaped openings of the cutting tool, thus fixedly installing the cutting tool on the output shaft. In this way, the convex portions and the openings together conduct the centering function, fixing function and torque transmission function, causing quick wear to the convex portions and the openings. In this invention, the centering element 82 is used for centering to isolate the centering function from the fixing function and/or torque transmission function, thus reducing wear of the centering element 82, the friction surface 50, the connecting hole 44 of the cutting tool 34, etc.

Relatively, the centering element 82 can be made of materials with relatively low cost and correspondingly design according to the cutting tools for various securing sections, so the cost is not increased while the oscillatory power tool can be matched with various types of cutting tools.

The centering element 82 can rotate relative to the depression 84, so the angle and position of the cutting tool 34 relative to the output shaft 32 can be conveniently adjusted according to demands.

In this embodiment, the friction surface 50 is formed by several prominent ribs 52. Of course, other friction surfaces described in the first embodiment also apply.

The centering element of the invention is not limited to the description in the second embodiment. The following are specific description of centering elements in other shapes.

As shown in FIG. 18, FIG. 19, FIG. 20 and FIG. 21, in the third embodiment of the invention, the cutting tool 34*b* is basically structurally the same as the cutting tool 34 in the second embodiment. The cutting tool 34*b* also has a securing section 40*b* and a cutting portion 42*b*. The securing section 40*b* is provided with a connecting hole 44*b*. However, the shape of the connecting hole 44*b* is different from that of the connecting hole 44 of the cutting tool 34. The connecting hole 44*b* includes eight round bumps 104*b* extending in the radial direction. Adjacent round bumps 104*b* are continuously connected through curve segments 106*b*.

Relative to change of the connecting hole 44*b*, the centering element 82*b* is also different from the centering element 82 in the second embodiment. Wherein the first surface 86*b*, bumps 100*b* and expansion holes 102*b* of the centering element 82*b* are structurally identical with the first surface 86*b*, the bumps 100 and the expansion holes 102 in the second embodiment. However, the form-fit portion 94*b* of the second surface 88*b* that is matched with the securing section 40*b* of the cutting tool 34*b* is different from the form-fit portion 94.

In this embodiment, the form-fit portion 94*b* includes four convex portions 108*b* which axially extend from the second surface 88*b* and are uniformly distributed in the circumference. Each projection portion 108*b* is a round tip extending outwards in the radial direction from the outer edge of the center positioning hole 92*b*. The convex portions 108*b* are just matched with the round bumps 104*b* and the curve segments 106*b* on the connecting hole 44*b* of the cutting tool 34*b* such that the center line of the connecting hole 44*b* of the cutting tool 34*b* is superposed with the axis X of the output shaft 32 for centering.

It can be understood that the quantity of the round bumps 104*b* of the cutting tool 34*b* is not limited to eight but is required to be over two, and the adjacent round bumps are mutually connected through curve segments. Correspondingly, the quantity of the projection portions 108*b* of the form-fit portion 94*b* is also not limited to four, and is only required to be over two. Of course, the best round bumps 104*b* are integral multiples of the convex portions 108*b*.

Of course, the convex portions 108*b* may also be rectangular, trapezoid or in other shapes instead of round tips, as long as the shapes of the convex portions 108*b* can be matched with the round bumps 104*b* or curve segments 106*b*. In addition, the convex portions 108*b* may also be set according to demands, and are not required to be distributed uniformly.

Figure 18:
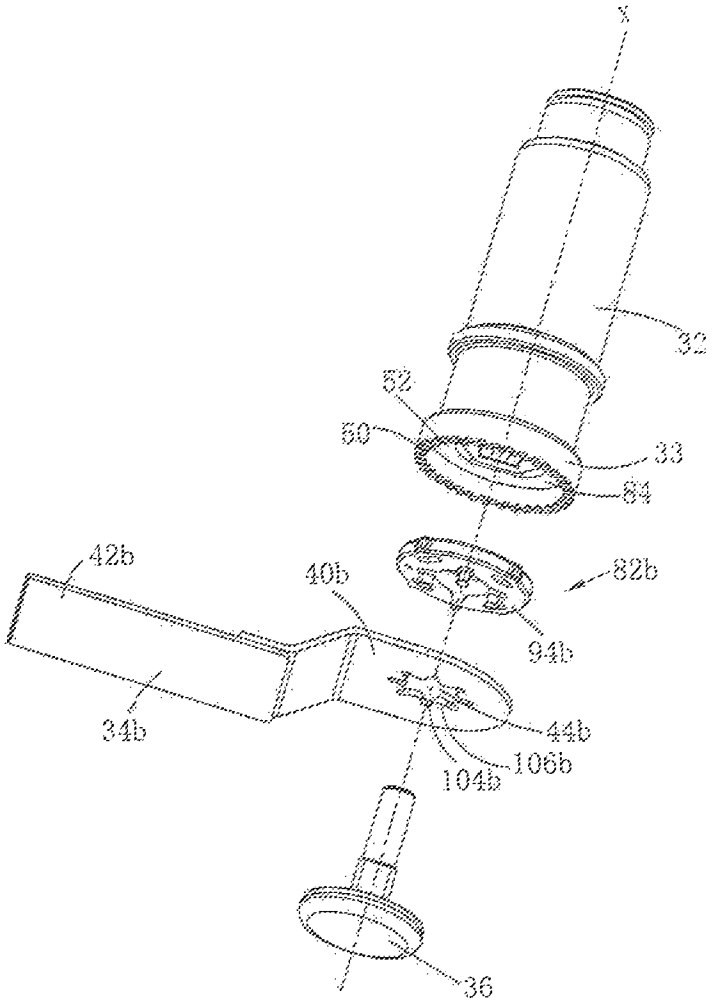
FIG. 18 is a three-dimension exploded view of the cutting tool, output shaft and centering element in the third embodiment of the oscillatory power tool of the invention.

As shown in FIG. 18, to install the cutting tool 34*b* on the output shaft 32, install the centering element 82*b* in the depression 84 first; then, sleeve the cutting tool 34*b* on the centering element 82*b*, make the securing section 40*b* of the cutting tool 34*b* match with the form-fit portion 94*b* of the centering element 82*b* such that the center line of the connecting hole 44*b* of the cutting tool is superposed with the axis X of the output shaft 32; next, refer to the above mentioned method to fix the cutting tool 34 on the output shaft 32 through the quick clamping mechanism.

During working, the output shaft 32 is driven by the motor (as shown in figure below) to rotationally oscillate. The output shaft 32 is provided with the friction surface 50 formed by the prominent ribs 52 such that a friction force which is big enough is formed between the output shaft 32 and the securing section 40*b* of the cutting tool 34*b*, and then the oscillation torque output by the output shaft 32 is further transmitted to the cutting tool 34*b* to drive the cutting tool 34*b* to oscillate.

In this embodiment, the friction surface 50 is formed by several prominent ribs 52. Of course, other friction surfaces described in the first embodiment also apply.

As shown in FIG. 22, FIG. 23, FIG. 24 and FIG. 25, in the fourth embodiment of the invention, the cutting tool 34*c* is basically structurally the same as the cutting tool 34 in the second embodiment, also having a securing section 40*c* and a cutting portion 42*c*. The securing section 40*c* is provided with a connecting hole 44*c*. The difference lies in that the shape of the connecting hole 44*c* is different from that of the connecting hole 44 of the cutting tool 34. The connecting hole 44*c* includes 12 holes 110*c* arranged at an interval in the circumference and a through hole 111*c* for allowing the fastener 36 to pass through.

Relative to change of the connecting hole 44*c*, the centering element 82*c* is also different from the centering element 82 in the second embodiment. Wherein the first surface 82*c*, bumps 100*c* and expansion holes 102*c* of the centering element 82*c* are structurally identical with the first surface 86*c*, the bumps 100 and the expansion holes 102*b* in the second embodiment. However, the form-fit portion 94*c* of the second surface 88*c* that is matched with the securing section 40*c* is different from the form-fit portion 94.

In this embodiment, the form-fit portion 94*c* includes 12 locking elements 112*c* which axially extend from the second surface 88*c* and are uniformly distributed in the circumference. All locking elements 112*c* are located out of the center positioning hole 92*c*. In addition, the 12 locking elements 112*c* are just matched with the 12 holes 110*c* of the cutting tool 34*b* such that the center line of the connecting hole 44*c* of the cutting tool 34*c* is superposed with the axis X of the output shaft 32 for centering.

It can be understood that the connecting hole 44*c* of the cutting tool 34*c* is not limited to have the 12 holes 110*c*, are is only required to have over two holes 110*c*. Correspondingly, the quantity of the locking element 112*c* of the form-fit portion 94*c* is not limited to 12, is only required to be over two, but best multiples of the holes 110*c*. In addition, the quantity of the holes 110*c* is best integral multiples that of the locking element 112*c*. In addition, the locking elements 112*c* may also be set according to demands, and are not required to be distributed uniformly.

In this embodiment, the cross-sections of the holes 110*c* are trapezoid; correspondingly, the cross-sections of the locking elements 112*c* of the form-fit portion 94*c* are also trapezoid. To facilitate loading and unloading, each locking element 112*c* has at least one chamfer for supporting the insertion process, and the cutting tool 34*c* cooperate with the holes 110*c* through the locking elements 112*c* to perform centering.

For those skilled in the art, it is easily understood that the cross-sections of the locking elements 112*c* and the holes 110*c* are not limited to be in the shape of trapezoid, and may be in one of rectangle, triangle, arc, square, roundness and oval.

Figure 22:
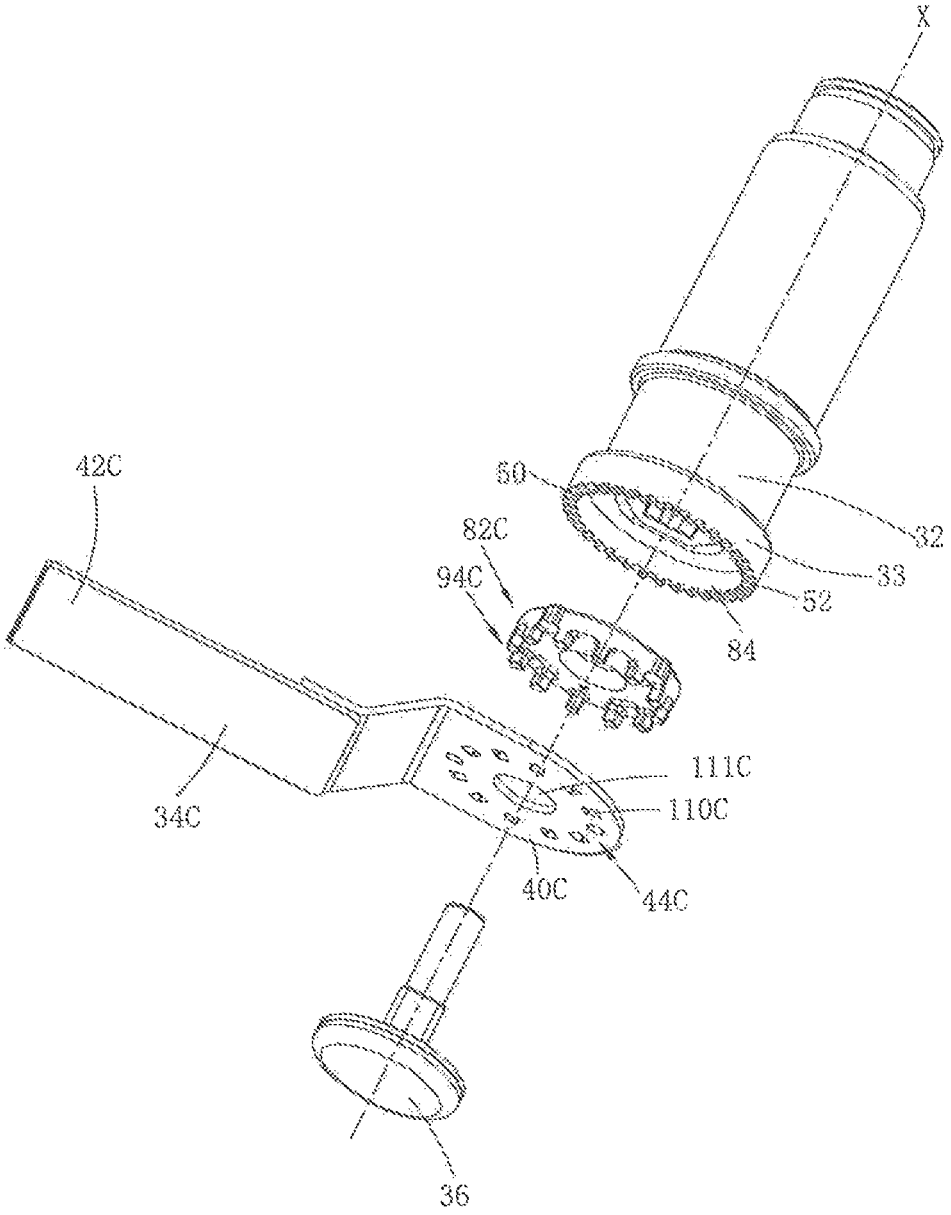
FIG. 22 is a three-dimension exploded view of the cutting tool, output shaft and centering element in the fourth embodiment of the oscillatory power tool of the invention.
Figure 23:
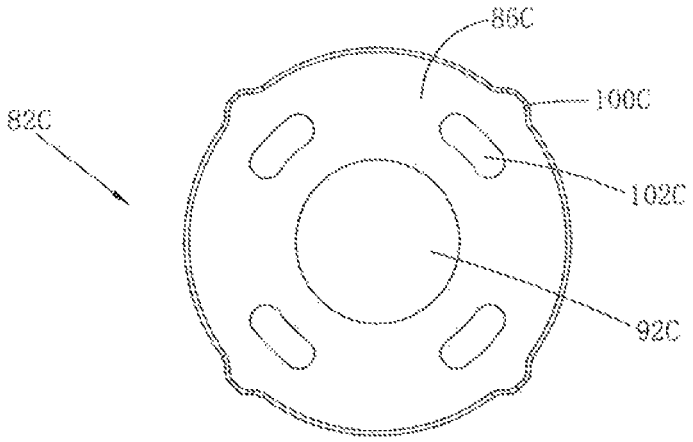
FIG. 23 is a schematic view of the first surface of the centering element as shown in FIG. 22.
Figure 24:
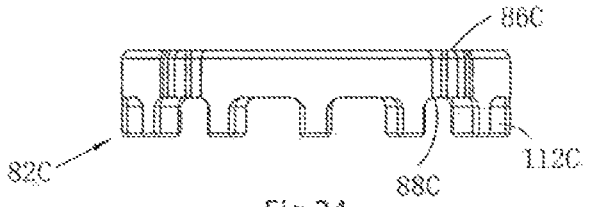
FIG. 24 is a lateral view of the centering element as shown in FIG. 22.
Figure 25:
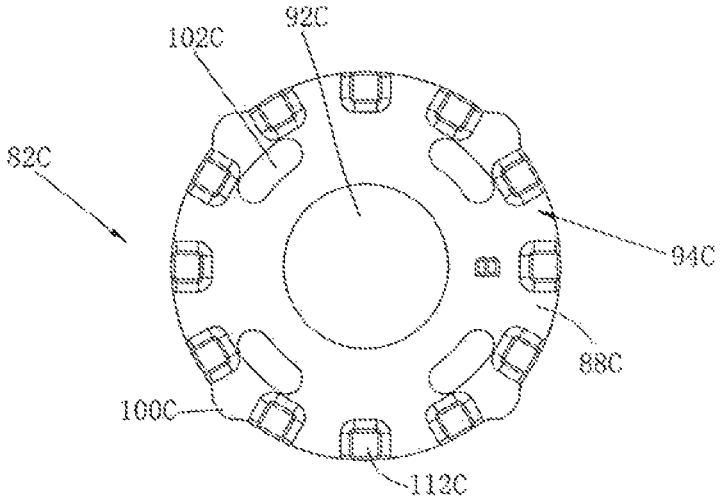
FIG. 25 is a schematic view of the second surface of the centering element as shown in FIG. 22.

As shown in FIG. 22, to install the cutting tool 34*c* on the output shaft 32, install the centering element 82*c* in the depression 84 first; then, sleeve the cutting tool 34*c* on the centering element 82*c*, make the securing section 40*c* of the cutting tool 34*c* match with the form-fit portion 94*c* of the centering element 82*c* such that the center line of the connecting hole 44*c* of the cutting tool 34*c* is superposed with the axis X of the output shaft 32; next, refer to the above mentioned method to fix the cutting tool 34*c* on the output shaft 32 through the quick clamping mechanism.

During working, the output shaft 32 is driven by the motor (as shown in figure below) to rotationally oscillate. The output shaft 32 is provided with the friction surface 50 formed by the prominent ribs 52 such that a friction force which is big enough is formed between the output shaft 32 and the securing section 40*c* of the cutting tool 34*c*, and then the oscillation torque output by the output shaft 32 is further transmitted to the cutting tool 34*c* to drive the cutting tool 34*c* to oscillate.

In this embodiment, the friction surface 50 is formed by several prominent ribs 52. Of course, other friction surfaces described in the first embodiment also apply.

It can be understood that the connecting hole 44*c* includes 12 holes 110*c* arranged at an interval in the circumference and a through hole 111*c* for allowing the fastener 36 to pass through. In the second embodiment of the invention, the centering element 82 is also adapted. The outer wall of the hollow convex stand 96 of the centering element 82 may be round. Then, the through hole 111*c* is just matched with the convex stand 96 such that the center line of the connecting hole 44*c* of the cutting tool 34*c* is superposed with the axis X of the output shaft 32. In this way, the cutting tool can be conveniently installed.

To conveniently and quickly install various different cutting tools in place, the oscillatory power tool may also be provided with a locating element and an elastic element. The elastic element is used to drive the locating element to always move axially or radially towards a direction for contacting with the cutting tool.

FIGS. 26-45 illustrate the fifth embodiment of the invention. The fifth embodiment of the invention is basically structurally the same as the second embodiment. Similarities are not described repeatedly. The following are specific description of the difference.

Figure 26:
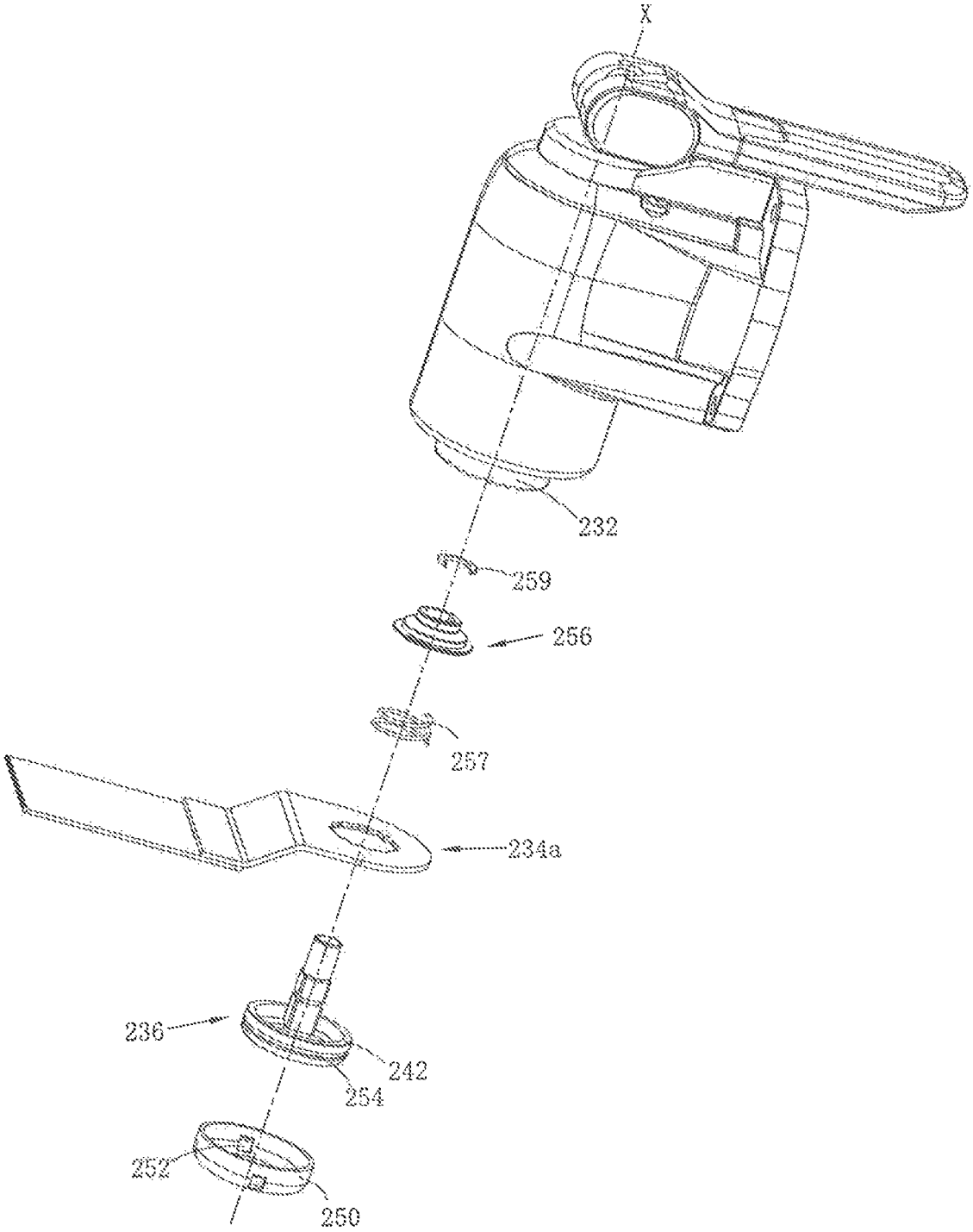
FIG. 26 is a three-dimensional exploded view of the head area of the oscillatory in the fifth embodiment of the invention.

Refer to FIG. 26. The pressing plate 242 of the fastener 236 is connected with a heat-insulating lagging 250. The heat-insulating lapping 250 is clad on the pressing plate 242 to prevent the operator from injury which is caused by the heat on the output shaft 232 that is transmitted to the pressing plate 242 when the cutting tool needs replacing after being used for a while. The heat-insulating lagging 250 is uniformly provided with stuck hooks 252 in the circumference. The pressing plate 242 is provided with strove slots 254. The stuck hooks 252 get stuck in the stuck slots 254 to clad the heat-insulating lagging 250 on the pressing plate 242.

The oscillatory power tool includes a locating element 256 matched with the cutting tool. The locating element 256 can be matched with the cutting tool having a connecting hole with the minimum inner diameter, so the various types of cutting tools can be conveniently and quickly installed. Even the center lines of the connecting holes of different types of cutting tools can be approximately superposed with the axis X of the output shaft 232. Of course, those skilled in the art can understand that, here, the center lines of the connecting holes of the cutting tools can also be not superposed with the axis X of the output shaft. The distance between the two also can ensure that the cutting tools are conveniently and quickly installed in place.

The oscillatory power tool also includes an elastic element. The elastic force of the elastic element drives the locating element 256 to always axially move towards a direction for contacting with the first cutting tool 234*a*.

In this embodiment, the locating element 256 is sleeved on the fastener 236, while the elastic element is located between the pressing plate 242 and the locating element 256. Here, the elastic element is a conical spring 257. The conical spring 257 only occupies a very small space when pressed. It can be understood that the elastic element may also be a pressure spring, etc. To prevent the locating element 256 from axial separation, the fastener 236 is provided with a stopping ring 259 to prevent the locating element 256 from separation.

Of course, the locating element 256 is sleeved on the fastener 236, and an elastic element is arranged between the two to form an independent fastening device which can used to install various cutting tools on one oscillatory power tool. Similarly, to prevent the locating element 256 from axial separation, the fastener 236 is provided with a stopping ring 259 to prevent the locating element 256 from separation. As an independent assembly, the fastening device can be conveniently installed on the cutting tool. Of course, the fastening device may also be sold as an independent accessory.

As known by those skilled in the art, the locating element 256 may also be arranged in the output shaft 232, and then the elastic element is located between the output shaft 232 and the locating element 256.

FIGS. 27-30 illustrate several different types of cutting tools to clearly describe the fifth embodiment of the invention.

Figure 27:
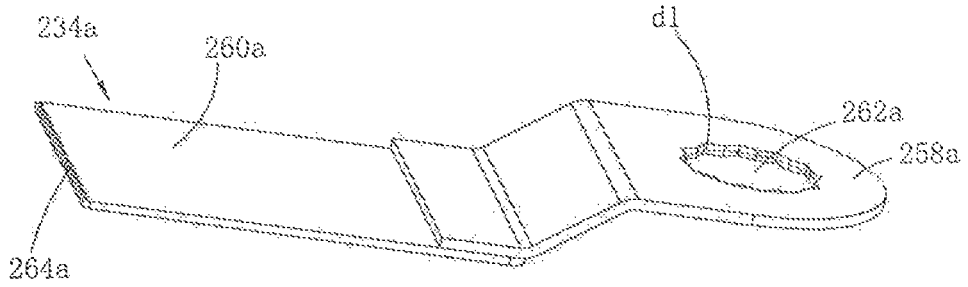
FIG. 27 is a three-dimensional view of the first cutting tool applicable to the oscillatory power tool as shown in FIG. 26.

Refer to FIG. 27. The first cutting tool 234*a* is a straight saw blade comprising a first securing section 258*a* and a first cutting portion 260*a*, wherein the first securing section 258*a* is connected to the output shaft 232. The first securing section 258*a* is provided with a first connecting hole 262*a* for penetration by the fastener 236. The first connecting hole 262*a* is the shape of regular dodecagon, and the diameter of the minimum incircle is d1. The tail end of the first cutting portion 260*a* is provided with a teeth 264*a* with cutting function.

Figure 28:
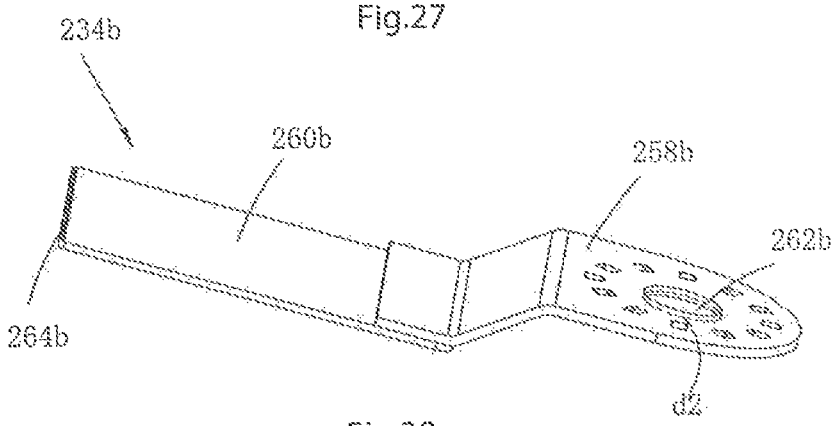
FIG. 28 is a three-dimensional view of the second cutting tool applicable to the oscillatory power tool as shown in FIG. 26.

Refer to FIG. 28. The second cutting tool 234*b* is a straight saw blade comprising a second securing section 258*b* and a second cutting portion 260*b*, wherein the second securing section 258*b* is connected to the output shaft 232. The second securing section 258*b* is provided with a second connecting hole 262*b* for penetration by the fastener 236. The second connecting hole 262*b* is round, and the diameter thereof is d2. The tail end of the second cutting portion 260*b* is provided with teeth 264*b* with a cutting function.

Figure 29:
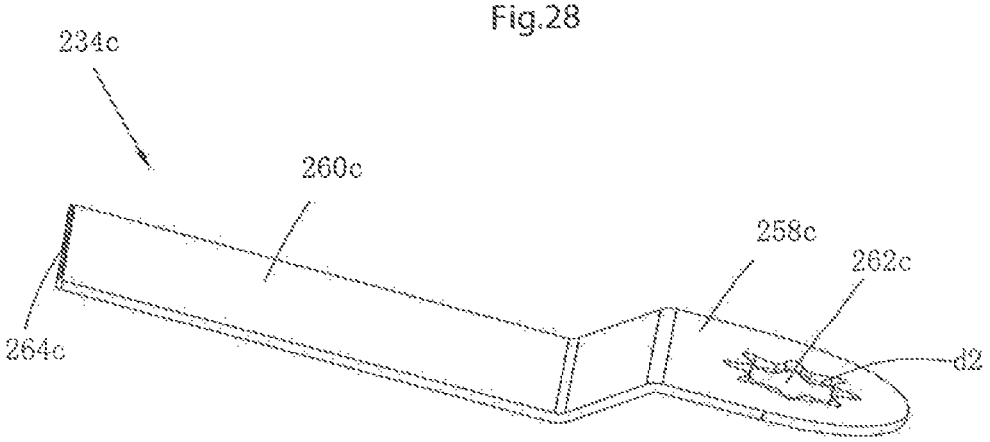
FIG. 29 is a three-dimensional view of the third cutting tool applicable to the oscillatory power tool as shown in FIG. 26.

Refer to FIG. 29. The third cutting tool 234*c* is a straight saw blade comprising a third securing section 258*c* and a third cutting portion 260*c*, wherein the third securing section 258*c* is connected to the output shaft 232. The third securing section 258*c* is provided with a third connecting hole 262*c* for penetration by the fastener 236. The third connecting hole 262*c* is a star-shaped opening with eight circular beads which are connected continuously. The diameter of the minimum incircle is d2, equal to that of the second connecting hole. The tail end of the third cutting portion 260*c* is provided with teeth 264*c* with a cutting function.

Figure 30:
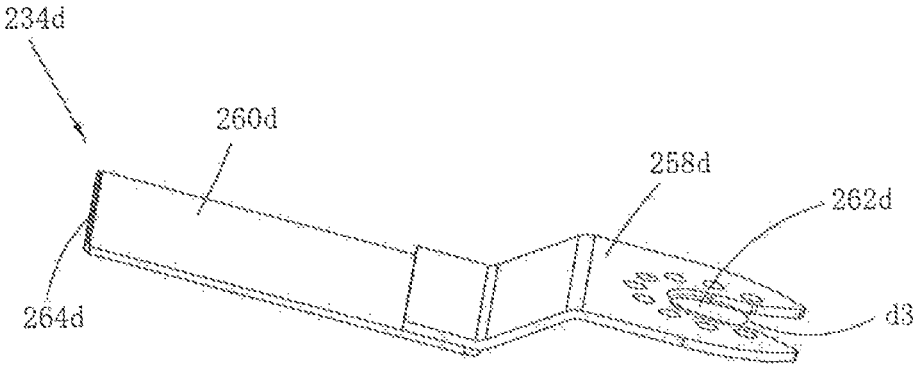
FIG. 30 is a three-dimensional view of the fourth cutting tool applicable to the oscillatory power tool as shown in FIG. 26.

Refer to FIG. 30. The fourth cutting tool 234*d* is a straight saw blade comprising a fourth securing section 258*d* and a fourth cutting portion 260*d* which are capable of being connected to the output shaft 232. The fourth securing section 258*d* is provided with a fourth connecting hole 262*d* for penetration by the fastener 236. The fourth connecting hole 262*d* is round, and the diameter thereof is d3. The tail end of the fourth cutting portion 260*d* is provided with teeth 264*d* with a cutting function. To facilitate installation, the fourth connecting hole 262*d* is a non-closed circular hole with a gap.

Figure 31:
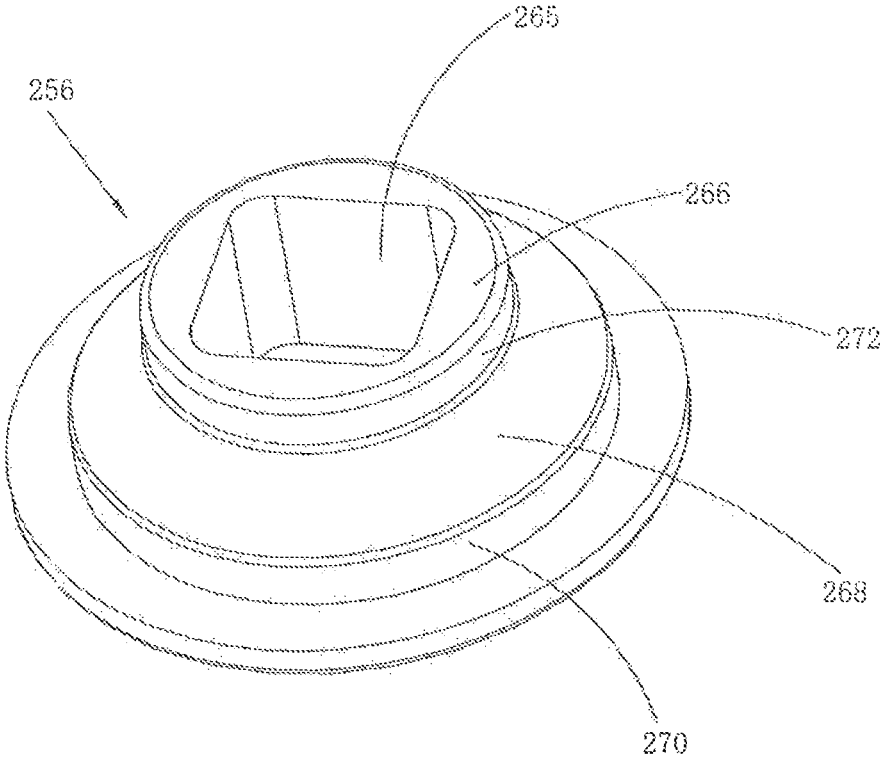
FIG. 31 is a schematic view of a locating eminent in the fifth embodiment of the oscillatory power tool of the invention.
Figure 32:
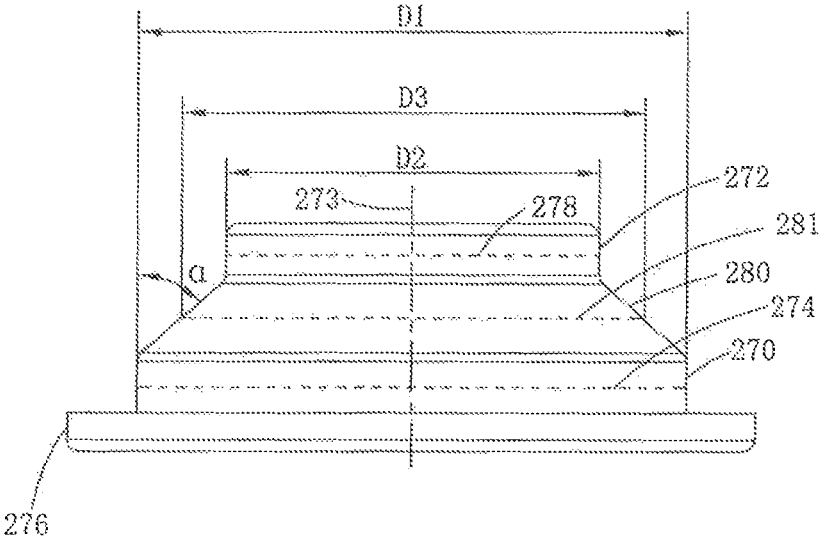
FIG. 32 is a front view of the locating element as shown in FIG. 31.

As shown in FIG. 31 and FIG. 32, the locating element 256 has a central hole 265 for penetration by the fastener 236 and a periphery wall 266 around the central hole 265. Wherein the periphery wall 266 comprises an outer peripheral surface 268 which is matched with the connecting hole of the cutting tool and used to locate the cutting tool.

The outer peripheral surface 268 at least includes a first outline with a first maximum radial size and a second outline with a second maximum radial size along the axial direction, wherein the first maximum radial size is not equal to the second maximum radial size. So, the first outline and the second outline are applicable to matching with at least part of the cutting tools having connecting holes different in inner minimum inner diameter to locate different types of cutting tools.

The contact between the first outline or the second outline and the minimum inner diameter of the corresponding connecting hole may be surface contact. In case of surface contact, the contact area is relatively large, and the location is relatively reliable. Of course, the contact between the first outline or the second outline and the minimum inner diameter of the corresponding connecting hole may be spot contact. Wherein at least three contact spots can realize location of the corresponding cutting tool. Preferably, the at least three contact spots form a right angle or an acute angle.

Changes to the maximum radial size of the outer peripheral surface 268 from the first outline to the second outline may be linear or nonlinear.

Preferably, the outer peripheral surface 268 comprises at least two cylindrical surfaces different in maximum radial size. The at least two cylindrical surfaces are used to contact at least part of the cutting tools with connecting holes which are different in inner diameter.

In this embodiment, the outer peripheral surface 268 comprises a first cylindrical surface 270 and a second cylindrical surface 272. Wherein several identical first outlines 274 with the first maximum radial size D1 form the first cylindrical surface 270; and several identical second outlines 278 with the second maximum radial size D2 form the second cylindrical surface 272.

Here, the first outlines 274 and the second outlines 278 are identical in shape, namely roundness. It can be understood that the first outline and the second outline which are different in shape can also realize location of the corresponding cutting tools.

In this embodiment, both the first outlines 274 and the second outlines 278 are round. For those skilled in the art, it can be easily understood that the first outlines 274 and the second outlines 278 are not limited to roundness, and may be shaped in polygon, oval or others.

In this embodiment, the first cylindrical surface 270 and the second cylindrical surface 272 are axially arranged at an interval. The outer peripheral surface 268 also comprises a connecting surface for connecting the first cylindrical surface 270 and the second cylindrical surface 272. The connecting surface may be a conical surface, inner curved surface, outer curved surface, etc. with linear changes, or formed by a plurality of bending surfaces with nonlinear change. Here, the connecting surface is a conical surface 280. The conical surface 280 is formed by outlines which are different in maximum radial sizes in the axial direction. Therefore, different outlines can be matched with cutting tools which have connecting holes different in minimum inner diameters. Those skilled in the art may think that the outer peripheral surface 268 provided with at least one conical surface can also locate different types of cutting tools.

Of course, the first cylindrical surface 270 and the second cylindrical surface 272 may also be consecutively arranged in the axial direction. The first cylindrical surface 270 and the second cylindrical surface 272 are connected through a step surface vertical to the first cylindrical surface 270 and the second cylindrical surface 272. However, one cylindrical surface is best matched with one cutting tool with the minimum inner diameter, so if the outer peripheral surface 268 of the locating element 256 is formed by the cylindrical surfaces, the corresponding cylindrical surfaces can be set according to the different minimum inner diameter of the cutting tools.

In addition, in this embodiment, the first cylindrical surface 270 and the conical surface 280 are chamfered, while the second cylindrical surface 272 and the conical surface 280 are also chamfered, thus facilitating processing and installation of the cutting tools.

Refer to FIG. 32. An intersecting line is formed by the outer peripheral surface 268 and the longitudinal sectional surface for allowing the center line 273 of the central hole 265 to pass through. In this embodiment, the intersecting line formed by the outer peripheral surface 268 and the longitudinal sectional surface for allowing the center line to pass through is comprised of three straight line segments. Wherein, the intersecting line by the first/second cylindrical surfaces 270/272 and the longitudinal section forms a 0 included angle with the center line 273, while the intersecting line of the conical surface 280 and the longitudinal section forms an angle $\alpha$ with the center line 273. The angle $\alpha$ is 50°. Of course, the angle $\alpha$ may be set as any angle according to demands. It can be understood that the intersecting line may be not a straight line, but one of a curved line or an arced line, or combinations of the straight line, curved line or arced line.

Figure 33:
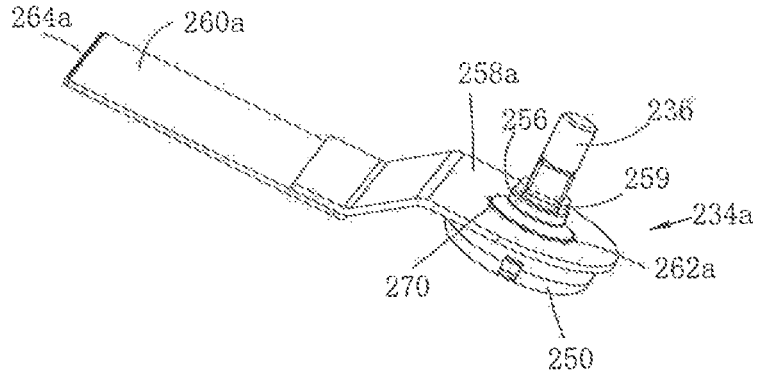
FIG. 33 is a three-dimensional view of the first cutting tool as shown in FIG. 27 that is matched with the locating element.

Refer to FIG. 27, FIG. 32 and FIG. 33. The minimum inner diameter d1 of the first connecting hole 262*a* is equivalent to the first maximum diameter D1 of the first outline 274. The first cutting tool 234*a* is sleeved on the first cylindrical 270 such that the first connecting hole 262*a* is just clamped on the first cylindrical surface 270, realizing location of the first cutting tool 234*a*. The situation that the minimum inner diameter d1 of the first connecting hole 262*a* is equivalent to the first maximum diameter D1 may mean that the minimum inner diameter d1 of the first connecting hole 262*a* is equal to or a little greater than the first maximum diameter D1 of the first outline 274. So, as long as the first cylindrical 270 contacts at least a part of the first connecting hole 262*a*, the first cutting tool 234*a* can be located.

To ensure that the contact surface between the first cylindrical surface 270 and the first connecting hole 262*a* is big enough but does not affect the volume of the entire oscillatory power tool, the height of the first cylindrical surface 270 is equivalent to the thickness of the first connecting hole 262*a*. Here, the situation that the height of the first cylindrical surface 270 is equivalent to the thickness of the first connecting hole 262*a* may mean that the thickness of the first connecting hole 262 is a little smaller than or equal to the height of the first cylindrical surface 270. It can be understood that the locating element 256 is also provided with a bottom surface 276 which is connected with the first cylindrical surface 270. The diameter of the bottom surface 276 is greater than the first maximum diameter D1. When the first cutting tool 234*a* is sleeved on the locating element 256, the bottom surface 276 stops the first cutting tool 234*a* from separating from the locating element 256.

Figure 34:
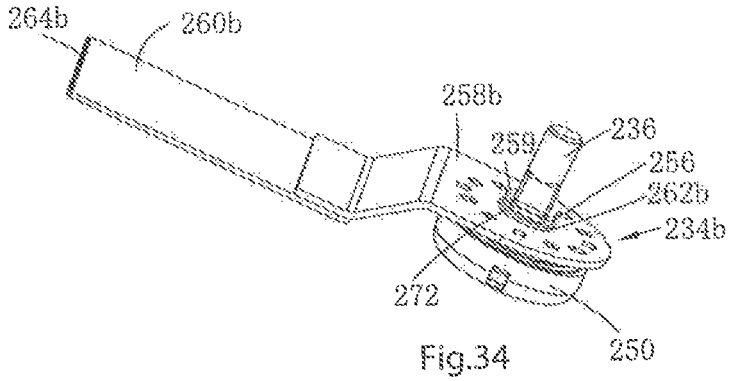
FIG. 34 is a three-dimensional view of the second cutting tool as shown in FIG. 28 that is matched with the locating element.

Refer to FIG. 28, FIG. 32 and FIG. 34. The diameter d2 of the second connecting hole 262*b* is equivalent to the second maximum diameter D2 of the second outline 278. The second cutting tool 234*b* is sleeved on the second cylindrical 272 such that the second connecting hole 262*b* is just clamped on the second cylindrical surface 272, realizing location of the second cutting tool 234*b*. The diameter d2 of the second connecting hole 262*b* is equivalent to the second maximum diameter D2 may mean that the minimum inner diameter d1 of the second connecting hole 262*b* is equal to a little greater than the first maximum diameter D1 of the first outline 274.

Preferably, when the diameter d2 of the second connecting hole 262*b* is equal to the second maximum diameter D2 of the second cylindrical surface 272, the second connecting hole 262*b* of the second cutting tool 234*b* and the second cylindrical surface 272 perform surface contact, so the contact area is bigger, and the location is more reliable.

To ensure that the contact surface between the second cylindrical surface 272 and the second connecting hole 262*b* is big enough but does not affect the volume of the entire oscillatory power tool, the height of the second cylindrical surface 272 is equal to the thickness of the second connecting hole 262*b*. Here, the situation that the height of the second cylindrical surface 272 is equivalent to the thickness of the second connecting hole 262*b* may mean that the thickness of the second connecting hole 262 is a little smaller than or equal to the height of the second cylindrical surface 272.

Figure 35:
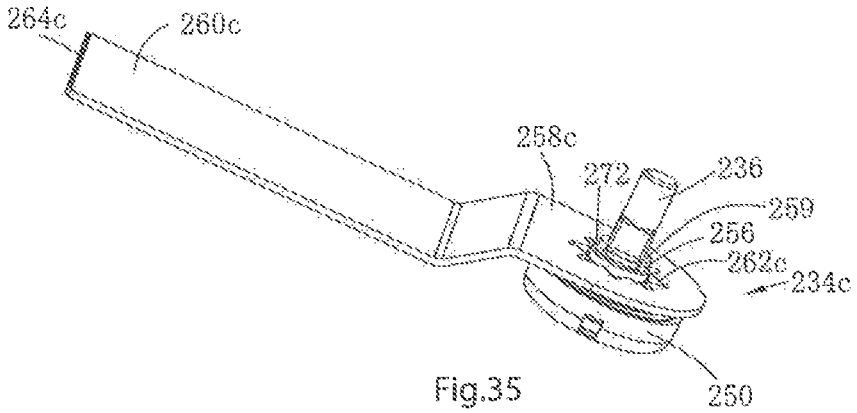
FIG. 35 is a three-dimensional view of the third cutting tool as shown in FIG. 29 that is matched with the locating element.

Refer to FIG. 29, FIG. 32 and FIG. 35. The minimum inner diameter d2 of the third connecting hole 262*c* is equivalent to the second maximum diameter D2 of the second outline 278. The third cutting tool 234*c* is sleeved on the second cylindrical 272 such that the third connecting hole 262*c* is just clamped on the second cylindrical surface 272, realizing location of the third cutting tool 234*c*. The minimum inner diameter d2 of the third connecting hole 262*c* is equivalent to the second maximum diameter D2 may mean that the minimum inner diameter d2 of the third connecting hole 262*c* is equal to or a little greater than the second maximum diameter D2 of the second outline 278. Thus it can be seen that even if the connecting holes of the second cutting tool 234*b* and the second cutting tool 234*c* are different in shape, as long as the minimum inner diameter is the same, the diameters of the outlines contacting the locating element 256 are the same.

Similarly, the situation that the height of the second cylindrical surface 272 is equivalent to the thickness of the third connecting hole 262*c* may mean that the thickness of the second connecting hole 262 is a little smaller than or equal to the height of the second cylindrical surface 272.

Figure 36:
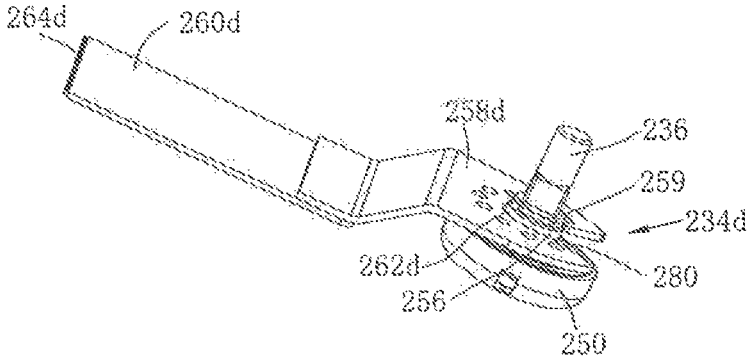
FIG. 36 is a three-dimensional view of the fourth cutting tool as shown in FIG. 30 that is matched with the locating element.

Refer to FIG. 32. The conical surface 280 comprises a third outline 281 with a third maximum diameter D3. The diameter d3 of the fourth connecting hole 262*d* is equal to the third maximum diameter D3 of the third outline 281. As shown in FIG. 30, FIG. 32 and FIG. 36, the fourth cutting tool 234*d* is sleeved on the conical surface 280 such that the fourth connecting hole 262*d* just contacts the third outline 281, realizing location of the fourth cutting tool 234*d*. The cutting tool 234*d* is matched with the circular surface 280, so the diameter d3 of the fourth connecting hole 262*d* is just equal to the third maximum diameter D3, and fit between the fourth connecting hole 262*d* and the third outline 281 is linear contact in the entire circumference. In this way, the location is reliable.

Figure 37:
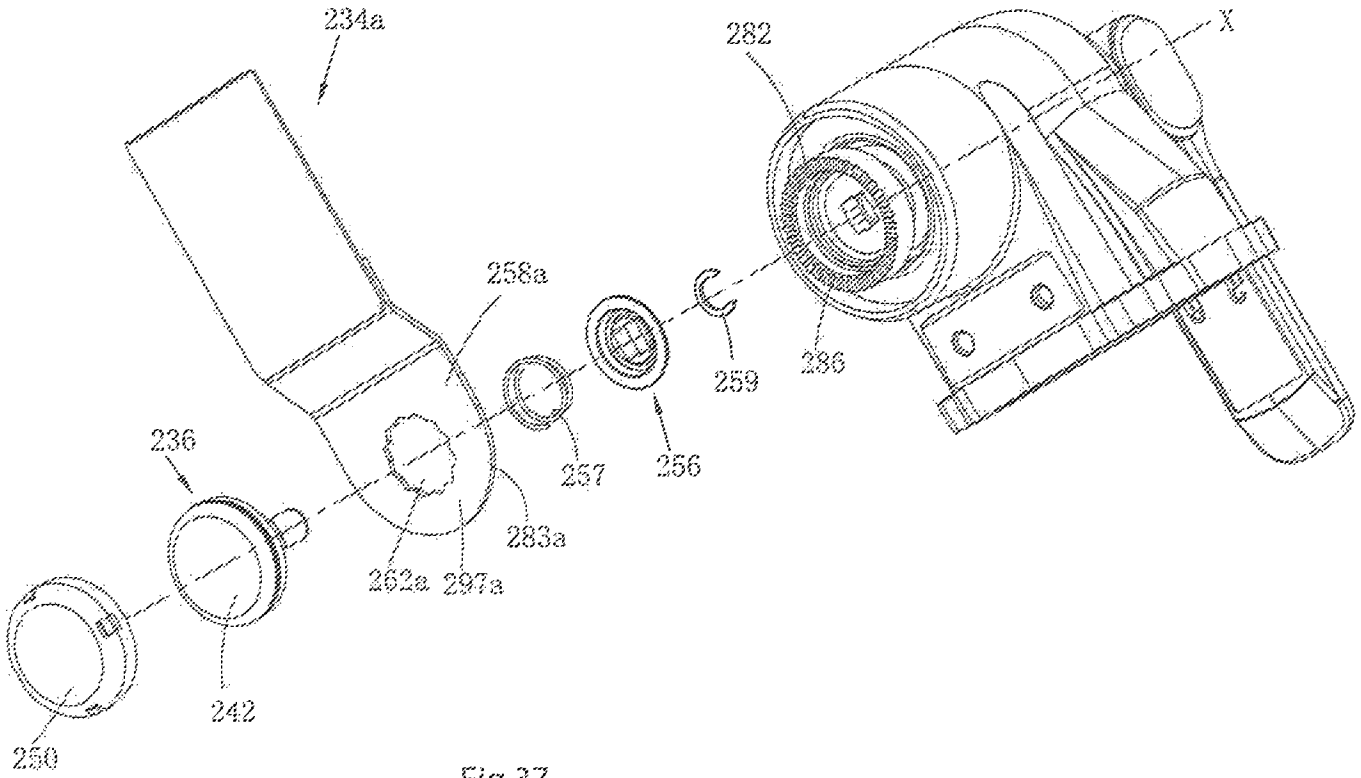
FIG. 37 is a three-dimensional exploded view of the head area of the oscillatory power tool as shown in FIG. 26 at another angle.
Figure 39:
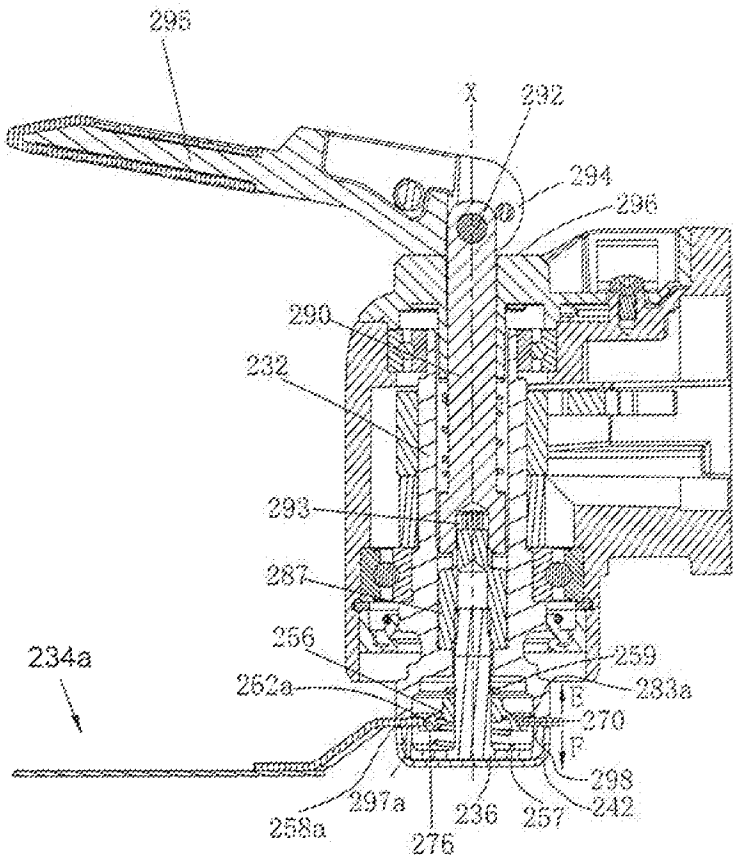
FIG. 39 is a sectional view of the head area of the oscillatory power tool as shown in FIG. 26, in such circumstances the first cutting tool is locked.
Figure 38:
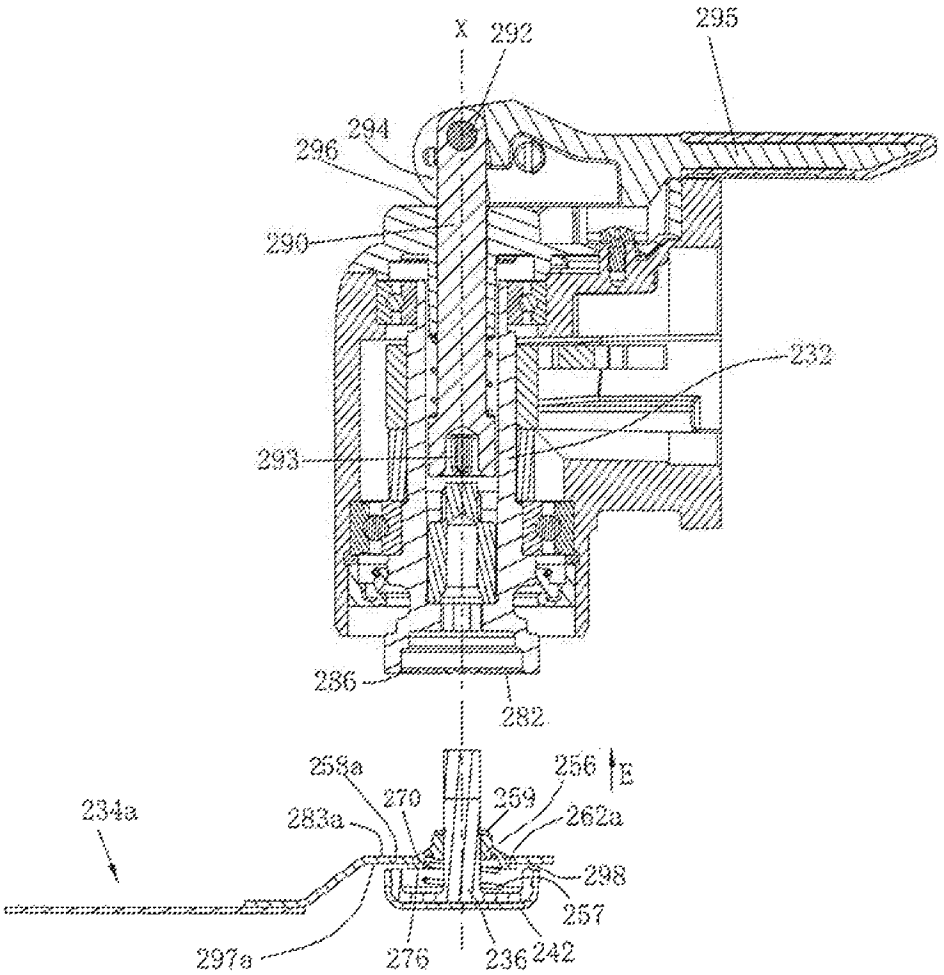
FIG. 38 is a sectional view of the head area of the oscillatory power tool as shown in FIG. 26, in such circumstances the fastener and the first cutting tool are not installed on the output shaft yet.

As shown in FIG. 37, in this embodiment, the matching surface 282 is the friction surface formed by several prominent ribs 286. Of course, other friction surfaces of the first embodiment also apply.

As shown in FIG. 33 and FIGS. 38-40, the oscillatory power tool comprises a quick clamping mechanism which is approximately structurally the same as that in the first embodiment. Here, the specific structure is not described repeatedly. If the oscillatory power tool needs using the first cutting tool 234*a*, sleeve the first cutting tool 234*a* on the locating element 256 first such that the first connecting hole 262*a* is matched with the first cylindrical surface 270 for location. In such circumstances, the locating element 256 is pressed against the stopping ring 259 by the action of the conical spring 257. Then, install the fastener 236 equipped with the first cutting tool 234*a* on the output shaft 232. Operate the handle 295 to rotate around the axis of the pivot shaft 292 thereof. The cam portion 294 contacts the contacting surface 296 of the housing to drive the pushing rod 290 move forward, and then the groove 293 of the pushing rod 290 is engaged with the fastening element 287. Next, operate the handle 295 to rotate around the axis X of the output shaft 232 along the screwing direction, and the fastening element 287 is driven to rotate together to be threadedly locked with the fastener 236. Thus, the first cutting tool 234*a* is fixed on the output shaft 232.

In the locking process, the fastener 236 matched with the fastening element 287 axially moves along the direction E. During movement, the upper surface 283*a* of the first securing section 258*a* of the first cutting tool 234*a* is adhered to the prominent ribs 286. In such circumstances, if the handle 295 is continuously operated to rotate around the axis X of the output shaft 232, the locating element 256 is driven to axially move along the direction F and compress the conical spring 257 until the lower surface 297*a* of the first securing section 258*a* of the first cutting tool 234*a* is adhered to the upper surface 298 of the pressing plate 242. Thus, the first cutting tool 234*a* is fixed on the output shaft 232. Finally, operate the handle 295 to rotate around the axis of the pivot shaft 292 back to the initial position where it is approximately vertical to the output shaft 232.

The prominent ribs 286 can realize transmission of a large force between the output shaft 232 and the cutting tool 234*a* in the axial direction and in the circumferential direction, and the transmitted torque is big enough, thus ensuring no relative slip between the cutting tool 234*a* and the output shaft 232. During working, the output shaft 232 is driven by the motor (not shown in the figure) to rotationally oscillate, and the oscillation torque output by the output shaft 232 is further transmitted to the first cutting tool 234*a*, so the first cutting tool 234*a* is driven to oscillate.

To dismantle the first cutting tool 234*a*, just operate the handle 295 to drive the pushing rod 290 to move downward such that the groove 293 of the pushing rod 290 is engaged with the fastening element 287. In such circumstances, operate the handle 295 to rotate around the axis X of the output shaft 232 along the unscrewing direction, and then the fastening element 287 is driven to rotate together until the fastening element 287 is completely separated from the fastener 236 in threaded connection. Then, dismantle the fastener 236 from the output shaft 232 and take out the first cutting tool 234*a*. The connecting hole 44 on the first securing section 258*a* of the first cutting tool 234*a* is closed, so the fastening element 287 is required to be completely separated from the fastener 236 to be taken down from the output shaft 232.

Figure 40:
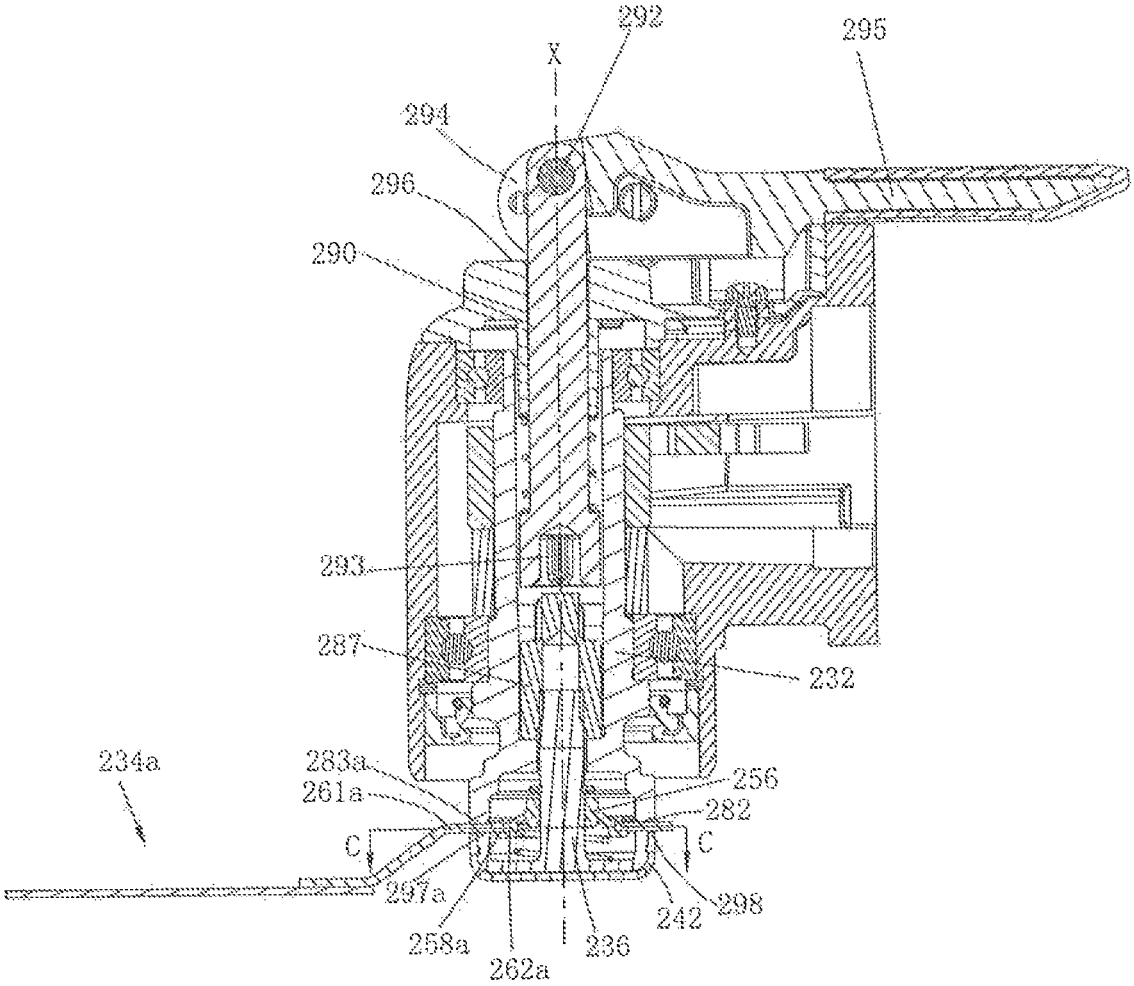
FIG. 40 is a sectional view of the head area of the oscillatory power tool as shown in FIG. 26, in such circumstances the first cutting tool is locked on the output shaft.

Refer to FIG. 40. The first securing section 258*a* of the first cutting tool 234*a* has a first center surface 261*a* parallel to the matching surface 282. The distances from the first center surface 261*a* to the upper surface 283*a* and the lower surface 297*a* of the first securing section 258*a* are equal.

Figure 41:
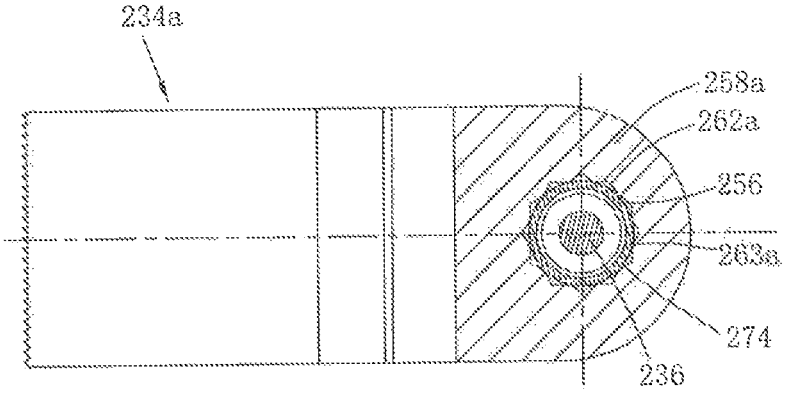
FIG. 41 is a sectional view in C-C direction as shown in FIG. 40.

FIG. 41 is a sectional view of FIG. 40 in C-C direction. Refer to FIG. 41, the locating element 256 has a first cross-section 263*a* in the first center surface 261*a*. Here, the first cross-section 263*a* is circular ring shaped, and the first outline 274 thereof forms a first circumcircle contacting the first connecting hole 262*a* of the first cutting tool 234*a*. Wherein the diameter of the first circumcircle is the radial size D1 of the first outline 274.

The diameter of the minimum incircle of the first connecting hole 262*a* is d1, which is equivalent to the diameter D1 of the first circumcircle, thus realizing location of the first cutting tool 234*a*.

Figure 42:
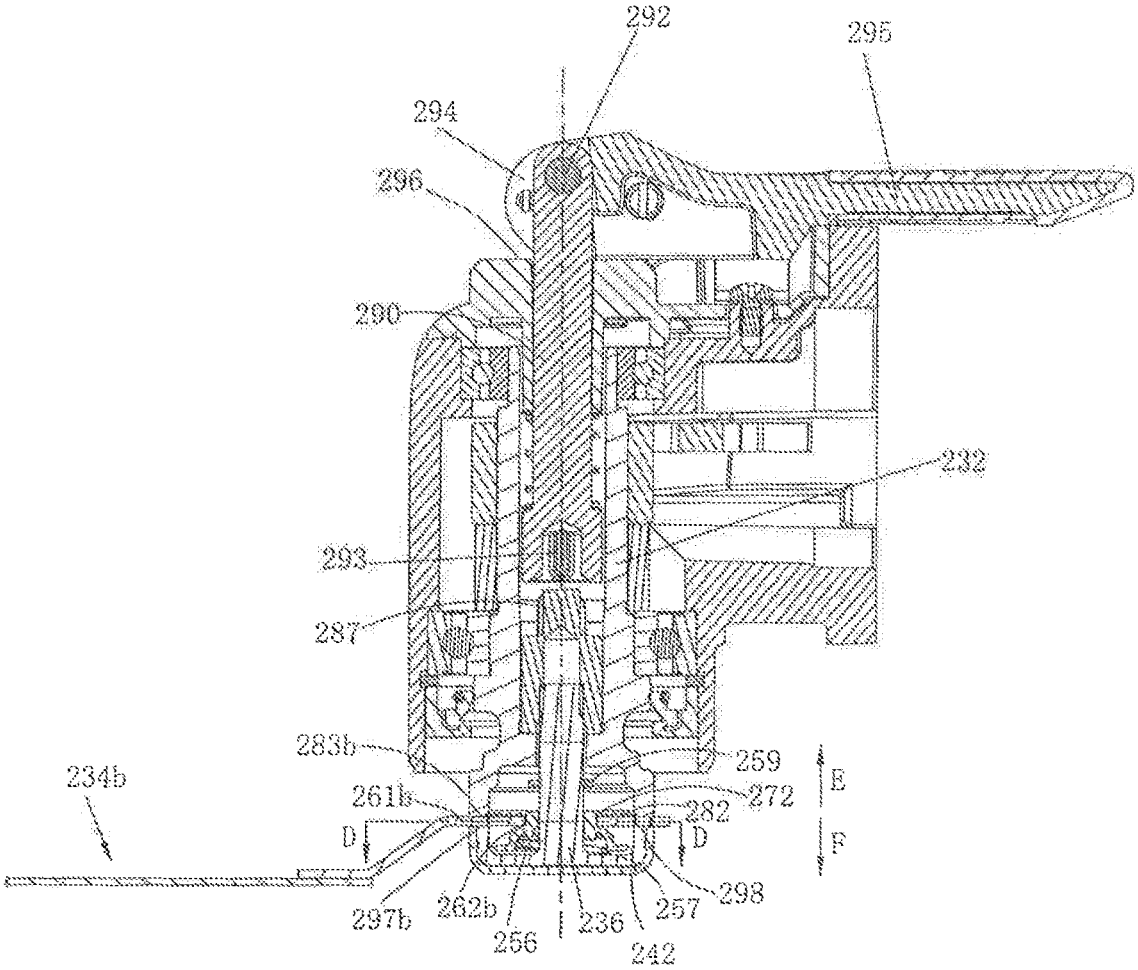
FIG. 42 is a sectional view of the head area of the oscillatory power tool, in such circumstances the second cutting tool is locked on the output shaft.

As shown in FIG. 34 and FIG. 42, if the oscillatory power tool needs using the second cutting tool 234*b*, sleeve the second cutting tool 234*b* on the locating element 256 first, such that the second connecting hole 262*b* is matched with the second cylindrical surface 272 for location. In such circumstances, the locating element 256 is pressed against the stopping ring 259 by the action of the conical spring 257. Then, install the fastener 236 equipped with the second cutting tool 234*b* on the output shaft 232. Operate the handle 259 to rotate around the axis of the pivot shaft 292 thereof, and then the pushing rod 290 is driven to move downward such that the groove 293 of the pushing rod 290 is engaged with the fastening element 287. Next, operate the handle 295 to rotate around the axis X of the output shaft 232 along the screwing direction, and the fastening element 287 is driven to rotate together to be threadedly locked with the fastener 236. Thus, the second cutting tool 234*b* is fixed on the output shaft 232.

In the locking process, the fastener 236 matched with the fastening element 287 axially moves along the direction E. During movement, the upper surface 283*b* of the second cutting tool 234*b* is adhered to the friction surface 283*b*. In such circumstances, if the handle 295 is continuously operated to rotate around the axis X of the output shaft 232, the locating element 256 is driven to axially move along the direction F and compress the conical spring 257 until the lower surface 297*b* of the second cutting tool 234*b* is adhered to the upper surface 298 of the pressing plate 242. Thus, the second cutting tool 234*b* is fixed on the output shaft 232. Finally, operate the handle 295 to rotate around the axis of the pivot shaft 292 back to the initial position where it is approximately vertical to the output shaft 232.

Refer to FIG. 42. The second securing section 258*b* of the second cutting tool 234*b* is provided with a second center surface 261*b* parallel to the matching surface 282. The distances from the second center surface 261*b* to the upper surface 283*b* and the lower surface 297*b* are equal.

Figure 43:
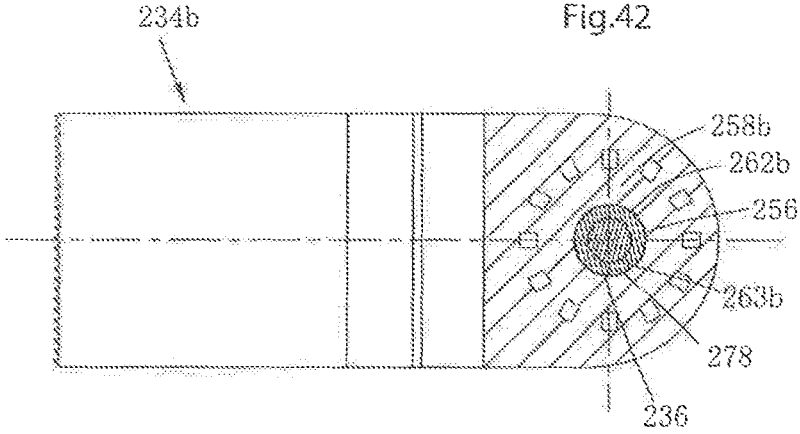
FIG. 43 is a sectional view in D-D direction as shown in FIG. 42.

FIG. 43 is a sectional view of FIG. 42 in D-D direction. Refer to FIG. 43. The locating element 256 has a second cross-section 263*a* in the second center surface 261*b*. Here, the second cross-section 263*b* is circular ring shaped, and the second outline 278 thereof forms a second circumcircle contacting the second connecting hole 262*b* of the second cutting tool 234*b*. Wherein the diameter of the second circumcircle is the radial size D2 of the second outline 278.

The diameter of the minimum incircle of the second connecting hole 262*b* is d2, which is equivalent to the diameter D2 of the second circumcircle, thus realizing location of the second cutting tool 234*b*.

It can be seen that the first cross-section and the second cross-section are identical in shape, namely roundness, but different in diameter of the circumcircles thereof. Of course, for those skilled in the art, it is easily understood that the first cross-section and the second cross-section may be different shape. For example, the first cross-section is round, while the second cross-section is polygonal; or the first cross-section is polygonal, while the second cross-section is oval; etc. That is to say as long as the circumcircle size of the maximum outline of the locating element 256 is equivalent to the minimum incircle size of the connecting hole of the cutting tool, the corresponding cutting tool can be located no matter what shape the cross-cross section of the locating element 256 is in and no matter what shapes of the connecting holes are in.

Figure 44:
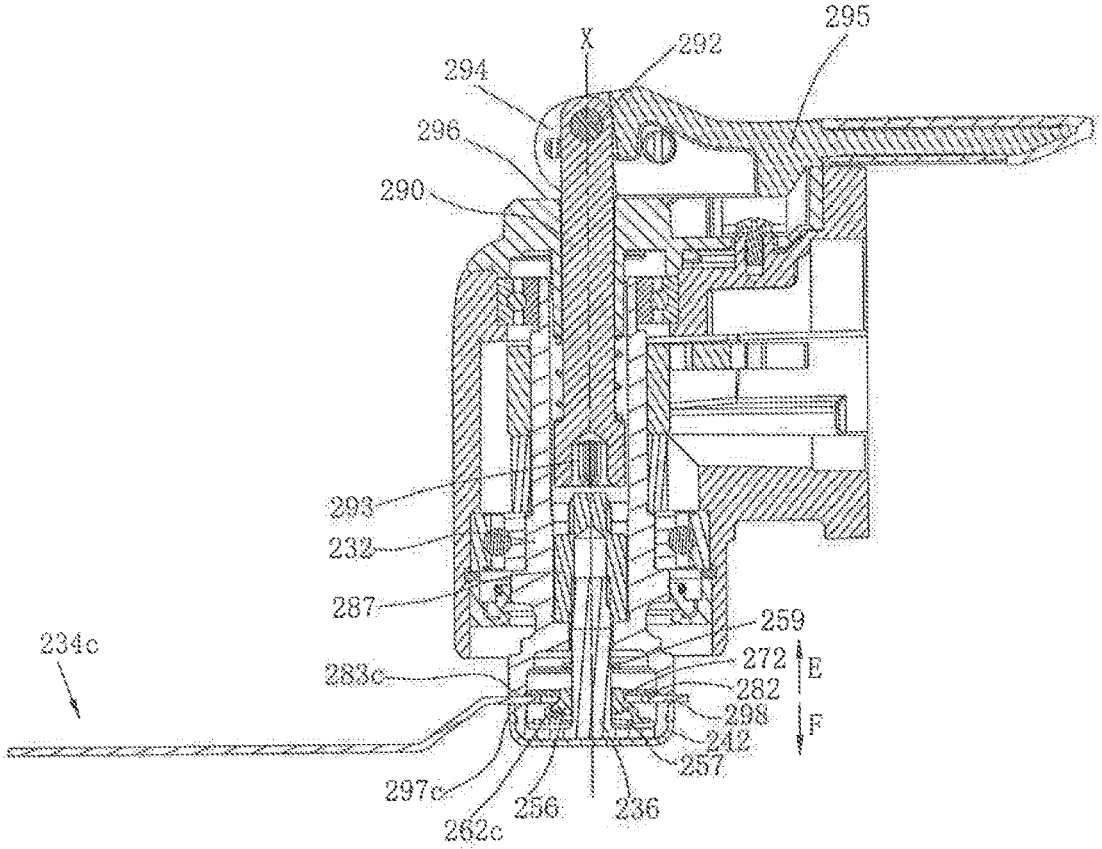
FIG. 44 is a sectional view of the head area of the oscillatory power tool, in such circumstances the third cutting tool is locked on the output shaft.

As shown in FIG. 35 and FIG. 44, if the oscillatory power tool needs using the third cutting tool 234*c*, sleeve the third cutting tool 234*c* on the locating element 256 first such that the third connecting hole 262*c* is matched with the second cylindrical surface 272 for location. In such circumstances, the locating element 256 is pressed against the stopping ring 259 by the action of the conical spring 257. Then, install the fastener 236 equipped with the third cutting tool 234*c* on the output shaft 232. Operate the handle 295 to rotate around the axis of the pivot shaft 292 thereof, and then the pushing rod 290 is driven to move downward such that the groove 293 of the pushing rod 290 is engaged with the fastening element 287. Next, operate the handle 295 to rotate around the axis X of the output shaft 232 along the screwing direction, and the fastening element 287 is driven to rotate together to be threadedly locked with the fastener 236. Thus, the third cutting tool 234*c* is fixed on the output shaft 232.

In the locking process, the fastener 236 matched with the fastening element 287 axially moves along the direction E. During movement, the upper surface 283*c* of the third cutting tool 234*c* is adhered to the matching surface 282. In such circumstances, if the handle 295 is continuously operated to rotate around the axis X of the output shaft 232, the locating element 256 is driven to axially move along the direction F and compress the conical spring 257 until the lower surface 297*c* of the third cutting tool 234*c* is adhered to the upper surface 298 of the pressing plate 242. Thus, the third cutting tool 234*c* is fixed on the output shaft 232.

Figure 45:
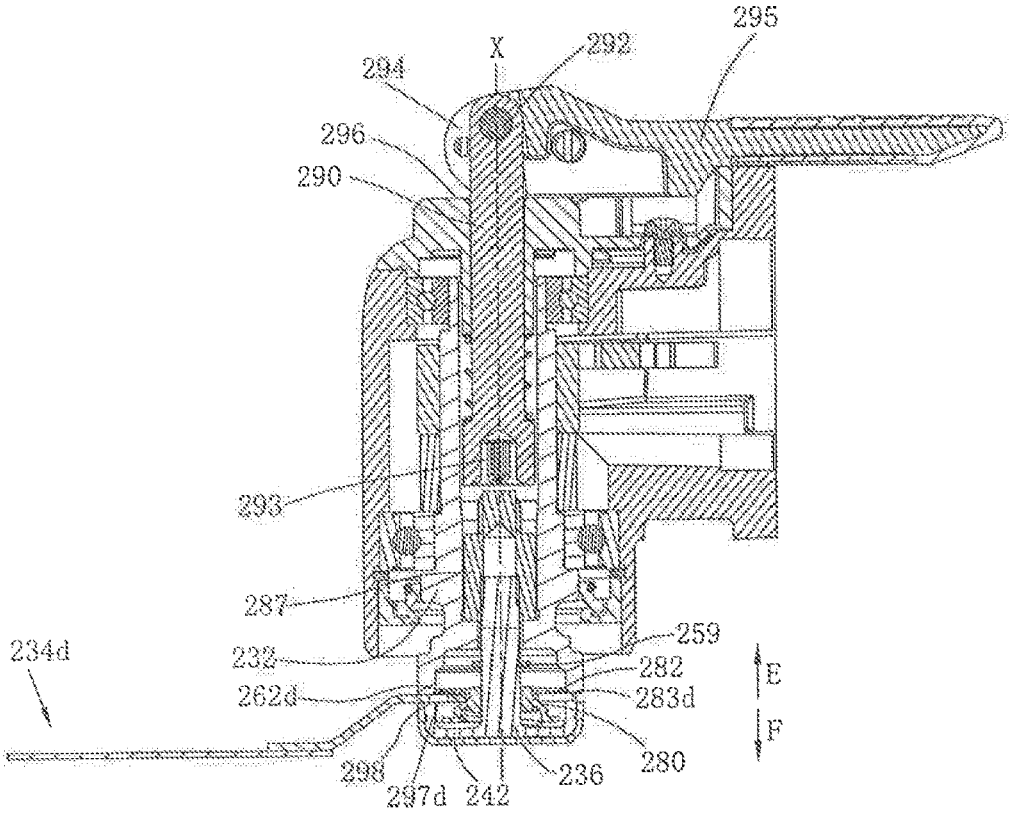
FIG. 45 is a sectional view of the head area of the oscillatory power tool, in such circumstances the fourth cutting tool is locked on the output shaft.

As shown in FIG. 36 and FIG. 45, if the oscillatory power tool needs using the fourth cutting tool 234*d*, sleeve the fourth cutting tool 234*d* on the locating element 256 first such that the fourth connecting hole 62*d* is matched with the conical surface 280 for location. In such circumstances, the locating element 256 is pressed against the stopping ring 259 by the action of the conical spring 257. Then, install the fastener 236 equipped with the fourth cutting tool 234*d* on the output shaft 232. Operate the handle 295 to rotate around the axis of the pivot shaft 292 thereof, and then the pushing rod 290 is driven to move downward such that the groove 293 of the pushing rod 290 is engaged with the fastening element 287. Next, operate the handle 295 to rotate around the axis X of the output shaft 232 along the screwing direction, and the fastening element 287 is driven to rotate together to be threadedly locked with the fastener 236. Thus, the fourth cutting tool 234*d* is fixed on the output shaft 232.

In the locking process, the fastener 236 matched with the fastening element 287 axially moves along the direction E. During movement, the upper surface 283*d* of the fourth cutting tool 234*d* is adhered to the matching surface 282. In such circumstances, if the handle 295 is continuously operated to rotate around the axis X of the output shaft 232, the locating element 256 is driven to axially move along the direction F and compress the conical spring 257 until the lower surface 297*d* of the fourth cutting tool 234*d* is adhered to the upper surface 298 of the pressing plate 242. Thus, the fourth cutting tool 234*d* is fixed on the output shaft 232. To dismantle the fourth cutting tool 234*d*, fourth connecting hole 62*d* has a gap for penetration by the rod part 44 of the fastener 236, so it is not required to completely take down the fastener 236 from the fastening element 287, and only required to unscrew the fastening element 287 such that a space for penetration by the fourth cutting tool 234*d* is reserved between the fastener 236 and the output shaft 232.

In inclusion, the locating element 256 is provided with at least two outer outlines different in the maximum radial sizes that contact at least part of the inner diameters of different types of the cutting tools, thus realizing location of different types of the cutting tools no matter which shapes the connecting holes themselves are in, Due to the contact with the inner diameters of the cutting tools through the outlines, the connecting holes of the cutting tools may be in any other shape. So, through setting the locating elements 256 having outlines different in the maximum radial size, different types of cutting tools that are connected to the oscillatory power tool can be quickly and correctly installed at corresponding positions.

In the prior art, through fit between the convex portions on the output shaft and the star-shaped connecting holes of the cutting tools, the cutting tools are fixedly installed on the output shaft. In this way, the convex portions and the connecting holes together conduct the location function, fixation function and torque transmission function, thereby causing quick wear to the convex portions and the connecting holes. In the invention, the locating element 256 is used for location, while the friction surface and the surfaces of the cutting tool together conduct the fixation function and/or torque transmission function through the locking mechanism. In this way, the location function is isolated from the fixation function and/or torque transmission function, thus reducing wear to the locating element 256, the friction surface, the connecting holes of the cutting tools, etc.

Moreover, the outline of the locating element 256 contacts the minimum inner diameter of the connecting hole, intended for location only. The relative positions of the cutting tool and the locating element are not limited. So, the operator can conveniently adjust the angle position of the cutting tool relative to the output shaft 232.

Figure 46:
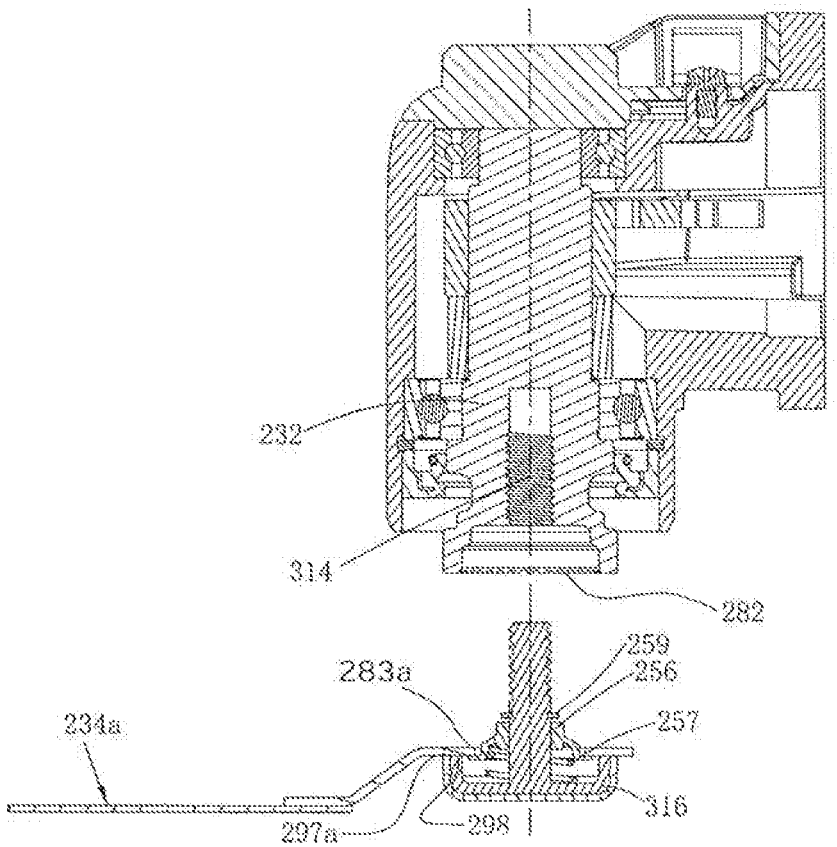
FIG. 46 is a sectional view of the head area of the oscillatory power tool in the sixth embodiment of the invention, in such circumstances the fastener and the first cutting tool are not installed on the output shaft yet.
Figure 47:
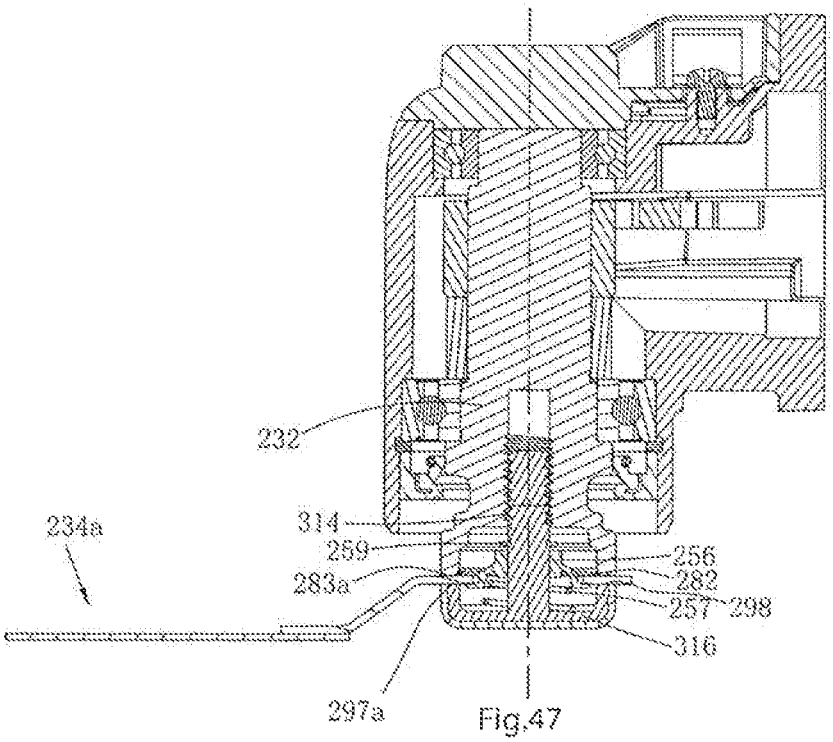
FIG. 47 is a sectional view of the head area of the oscillatory power tool as shown in FIG. 46, in such circumstances the first cutting tool is locked on the output shaft.

As shown in FIG. 46 and FIG. 47, the sixth embodiment of the invention is basically the same as the fifth embodiment, but different in that the output shaft 232 is directly provided with a tapped blind hole 314 and that the fastener 316 is a fastening bolt with screw threads. To install the first cutting tool 234*a*, sleeve the first cutting tool 234*a* on the locating element 256 such that the first connecting hole 262*a* is matched with the first cylindrical surface 270 for location. At this moment, the locating element 256 is pressed against the stopping ring 259 by the action of the conical spring 257. Then, install the fastener 316 with the first cutting tool 234*a* on the output shaft 232. In such circumstances, the first cutting tool 234*a* can be easily fixed on the output shaft 232 through connecting the fastener 316 with the tapped blind hole 314 and screwing the fastener 316.

As shown in FIGS. 48-51, the seventh embodiment of the invention is basically the same as the sixth embodiment, but different in that: the locating element 256 in the sixth embodiment moves axially to match with different cutting tools, while the locating element 420 in the seventh embodiment radially moves to match with different cutting tools.

Figure 48:
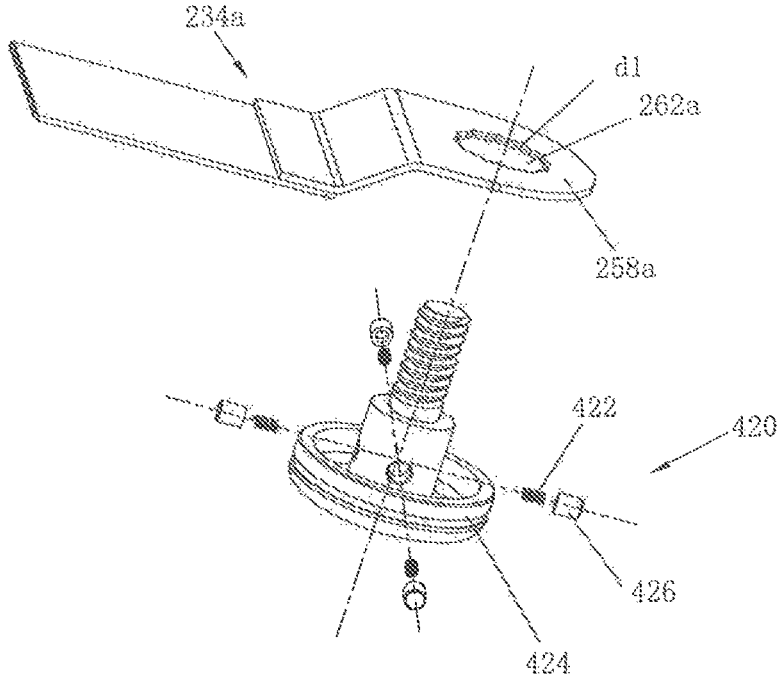
FIG. 48 is a three-dimensional exploded view of the fastener and the locating element in the seventh embodiment of the invention.

As shown in FIG. 48, in the embodiment, the elastic element 422 is arranged in the fastener 424, driving the locating element 420 to always radially move towards a direction for contacting with the connecting hole of the cutting tool.

In this embodiment, the elastic element 422 is a spring. Of course, the spring may be a compression spring or a tension spring.

The locating element 420 comprises at least two locating blocks 426 which are arranged on the fastener 424 in the circumference. The locating blocks 426 always radially move by the effect of the spring 422 towards a direction for contacting with the connecting hole of the cutting tool. Of course, a limiting device (not shown in the figure) is also arranged between the fastener 424 and each locating block 426 to prevent the locating block 426 separating from the fastener 424.

In this embodiment, four locating blocks 426 are uniformly distributed on the circumference of the fastener 424. Of course, those locating blocks 426 may be arranged on the circumference of the fastener 424 any angle.

Figure 49:
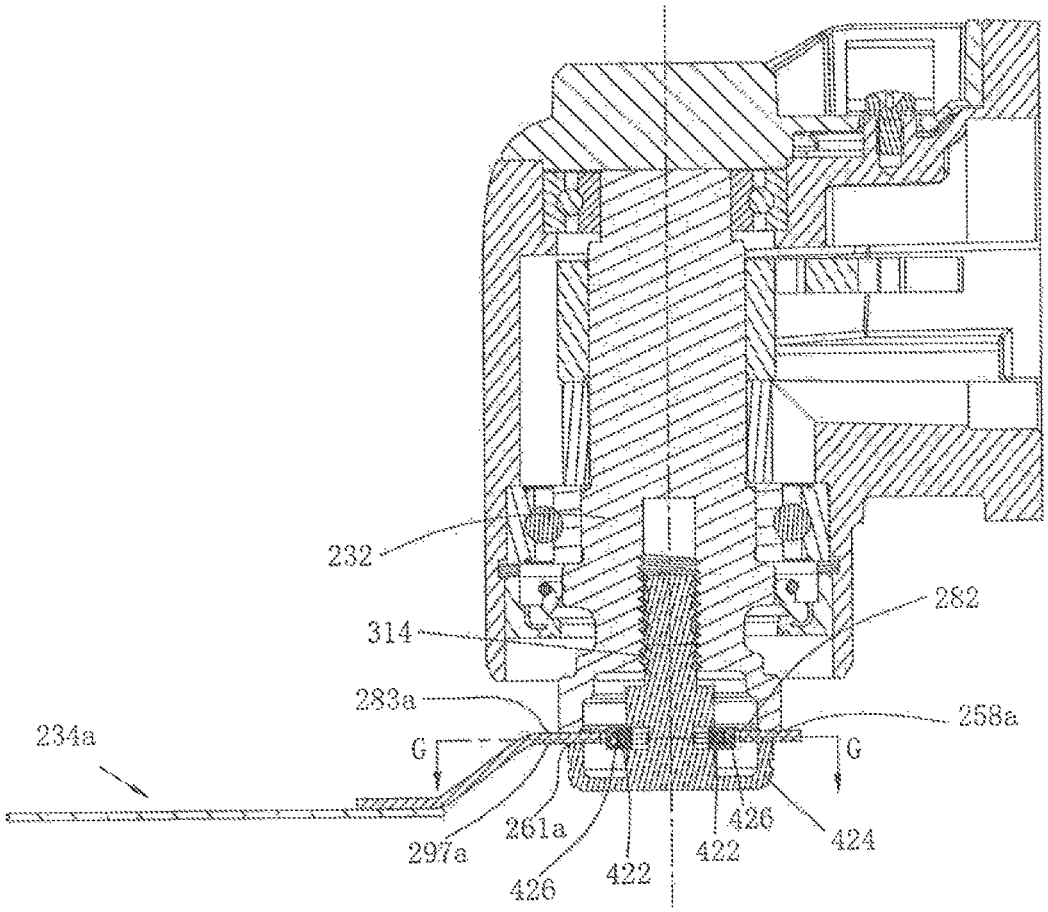
FIG. 49 is a schematic view of the fastener and the locating as shown in FIG. 48 that lock the first cutting tool on the output shaft.

Refer to FIG. 49. To install the first cutting tool 234*a*, sleeve the first cutting tool 234*a* on the locating element 420 such that the first connecting hole 262*a* is matched with the locating blocks 426 for location. Then, install the fastener 424 with the first cutting tool 234*a* on the output shaft 232. In such circumstances, as long as the fastener 424 is connected with the tapped blind hole 314 and then screwed, the first cutting tool 234*a* can be easily fixed on the output shaft 232.

The first securing section 258*a* of the first cutting tool 234*a* has a first center surface 261*a* parallel to the matching surface 282. The distances from the first center surface 261*a* to the upper surface 283*a* and the lower surface 297*a* of the first securing section 258*a* are equal.

Figure 50:
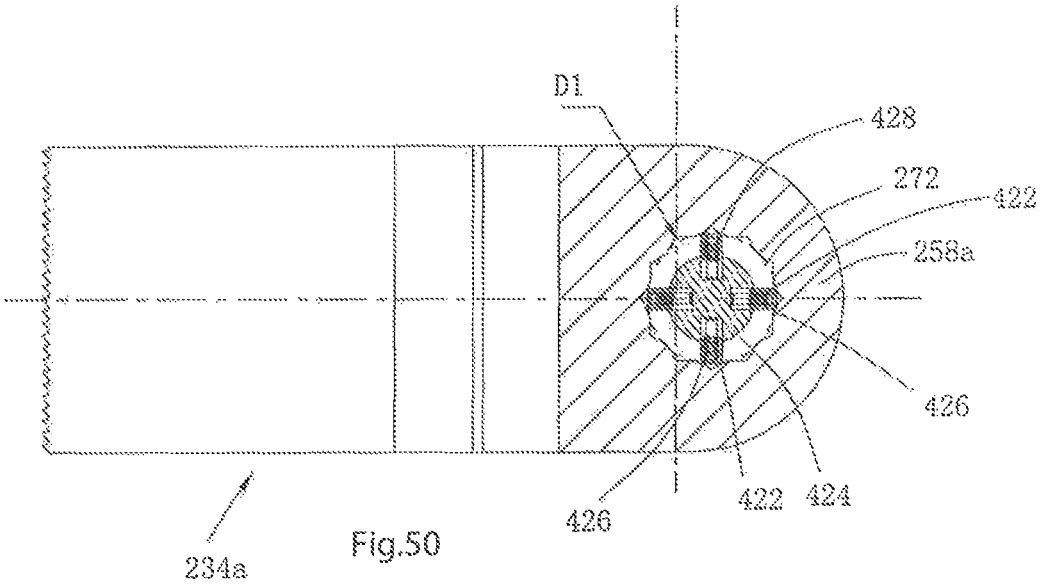
FIG. 50 is a sectional view in G-G direction as shown in FIG. 49.

FIG. 50 is a sectional view of FIG. 49 in G-G direction. Refer to FIG. 50. The locating element 420 has a first cross-section 428 in the first center surface 261*a*. Here, the first cross-section 428 is approximately shaped as four separate rectangles, and the diameter of the formed circumcircle is D1. Here, the D1 is equivalent to the diameter d1 of the minimum incircle of the first connecting hole 262*a*, thus realizing location of the first cutting tool 234*a*. Of course, those skilled in the art can understand that the situation that the diameter D1 of the first circumcircle is equivalent to the diameter d1 of the minimum incircle of the first connecting hole 262*a* may mean that the diameter D1 of the first circumcircle is equal to or a little greater than the diameter d1 of the minimum incircle of the first connecting hole 262*a*.

Figure 51:
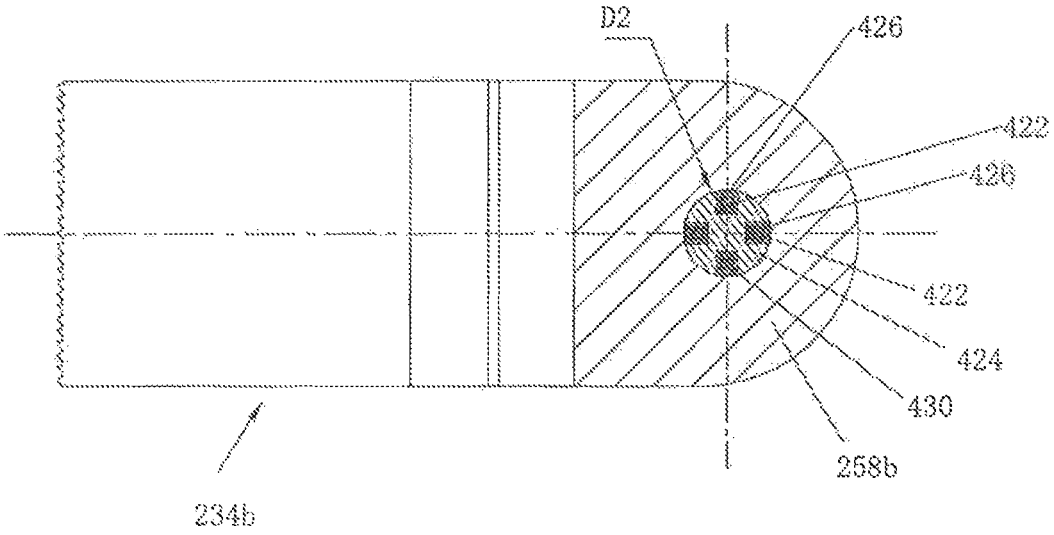
FIG. 51 is a cross-sectional view of the second cutting tool installed on the output shaft.

FIG. 51 is a sectional view of the second center surface 261*b* along the second cutting tool 234*b*. Refer to FIG. 51. The locating element 420 has a second cross-section 430 in the second center surface 261*b*. Here, the second cross-section 430 is shaped like the first cross-section 428, approximately four separate rectangles, and the diameter of the formed circumcircle is D2. Here, the D2 is equivalent to the diameter d1 of the minimum incircle of the second connecting hole 262*b*, thus realizing location of the second cutting tool 234*b*. Here, the situation that the diameter D1 of the first circumcircle is equivalent to the diameter d1 of the minimum incircle of the first connecting hole 262*a* means that the diameter D1 of the first circumcircle is basically equivalent of the diameter d1 of the minimum incircle of the first connecting hole 262*a*.

Comparison of FIG. 50 with FIG. 51 shows that the first cross-section 428 and the second cross section 430 are located at different positions relative to the output shaft 232. Thus it can be seen that the locating element 420 is adapted to different cutting tools through radial movement.

Of course, to better match with connecting holes in different shapes, one end of each locating block 426 that is adapted to the cutting tool is a round tip or arc end.

Of course, in this embodiment, the locating element 420, the fastener 424 and the elastic element 422 may also form an independent fastening device which can be used to assemble many kinds of cutting tool to one oscillatory power tool. As an independent assembly, the fastening device brings convenience to installation of the cutting tool. Of course, the fastening device may also be sold as an independent accessory.

The eight embodiment of the invention is basically the same as the fifth, sixth and seventh embodiments, but different in that: the locating element 256 in the former three embodiments moves axially or radially to match with different cutting tools, while the locating element in the eighth embodiment match with different cutting tools through deformation thereof. In this embodiment, the locating element is a deforming element, capable of being arranged on the fastener or the output shaft. The deforming element contacts the first connecting hole and forms a first circumcircle tangent to the first connecting hole in the first center surface; and the deforming element contacts the second connecting hole and forms a second circumcircle tangent to the second connecting hole in the second center surface. Wherein the first connecting hole and the second connecting hole are different in the minimum inner diameter, while the first circumcircle and the second circumcircle are different in diameter.

Of course, in this embodiment, the locating element together with the fastener may form an independent fastening device which can be used to assemble many kinds of cutting tool to one oscillatory power tool. As an independent assembly, the fastening device brings convenience to assembly of the oscillatory power tool. Of course, the fastening device may also be sold as an independent accessory.

To more conveniently and quickly install different types of cutting tools in place, the locating element is also provided with a form-fit portion capable of transmitting torque. FIGS. 52-62 show the ninth embodiment of the invention. The ninth embodiment of the invention is basically structurally the same as the second embodiment, but different in specific structure and function of the locating element.

Figure 52:
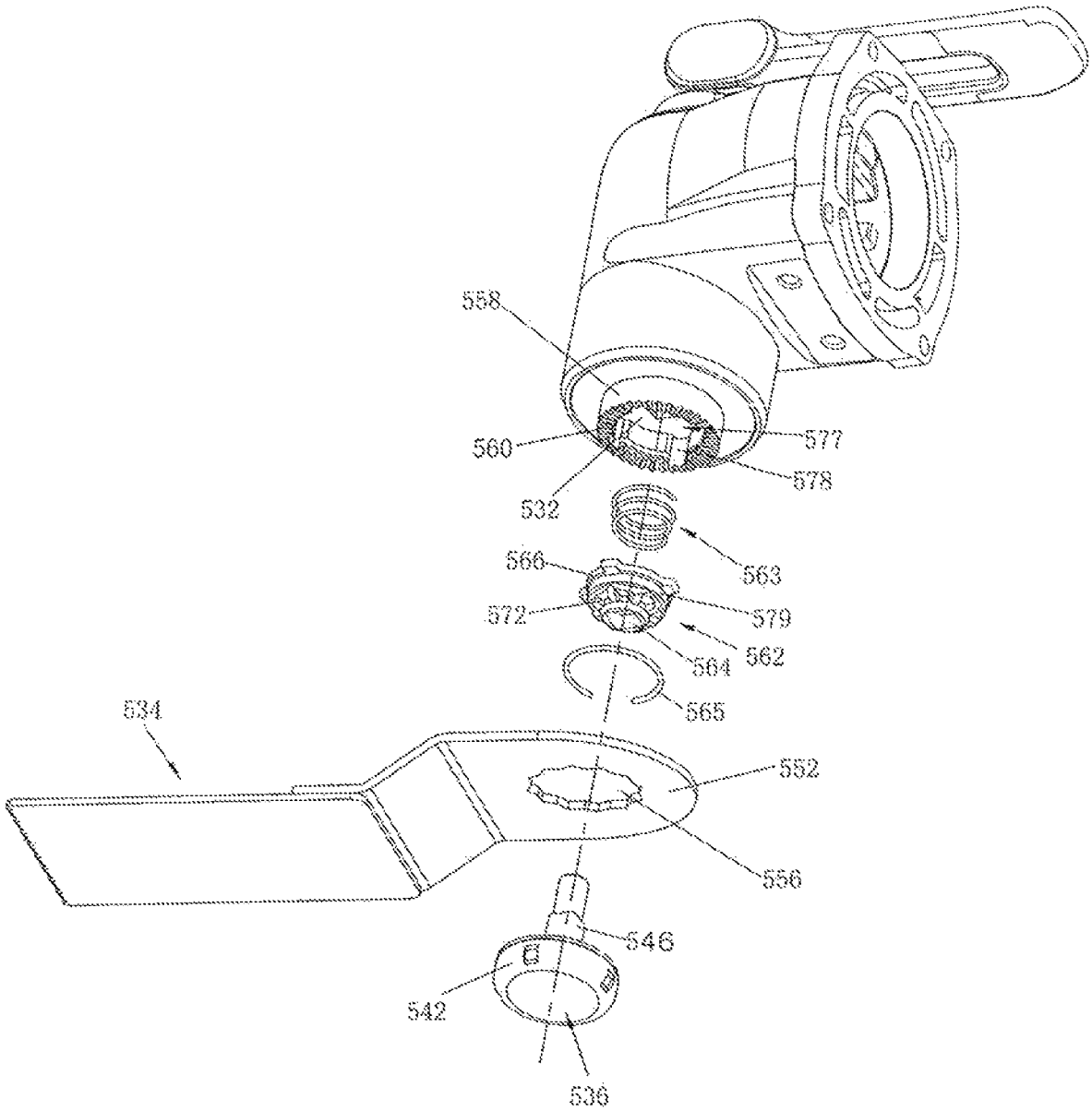
FIG. 52 is a three-dimensional exploded view of the head area of the oscillatory power tool in the ninth embodiment of the invention.

As shown in FIG. 52, the tail end of the output shaft 532 is provided with a connecting flange 558. The connecting flange 558 is provided with a matching surface 560 capable of contacting the upper surface of the cutting tool 534. When the cutting tool 534 is fixed on the output shaft 532, the upper and lower surfaces of the cutting tool 534 are respectively adhered between the pressing plate 542 and the matching surface 560. Here, the matching surface 560 and the upper surface of the cutting tool 534 generate a friction force which is big enough, so the oscillatory power tool can transmit the oscillation torque on the output shaft 532 to the cutting tool 534 during working and prevent the cutting tool 534 from slip.

In this embodiment, the matching surface 560 is a friction surface formed by several prominent ribs which are arrayed regularly. Of course, other friction surfaces of the first embodiment also apply.

Figure 53:
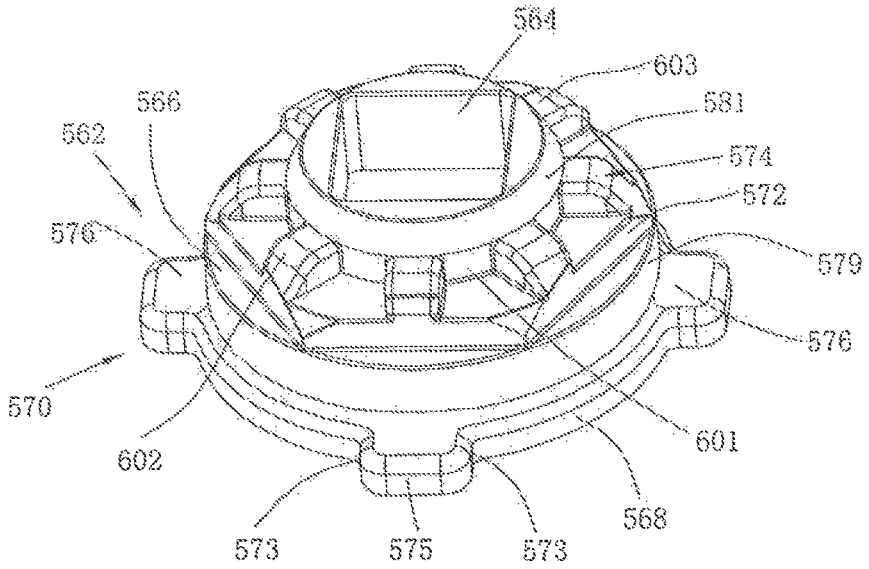
FIG. 53 is a three-dimensional view of the locating element in the ninth embodiment of the invention.
Figure 54:
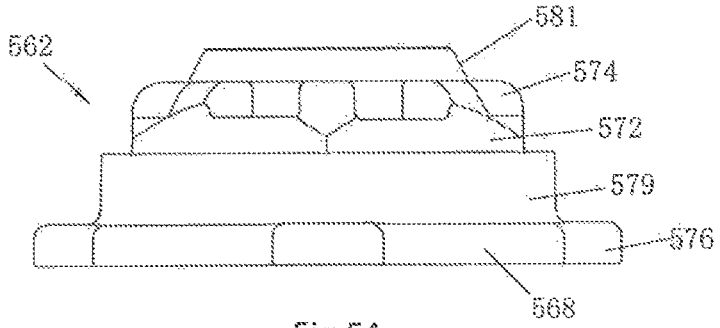
FIG. 54 is a front view of the locating element in the ninth embodiment of the invention.
Figure 55:
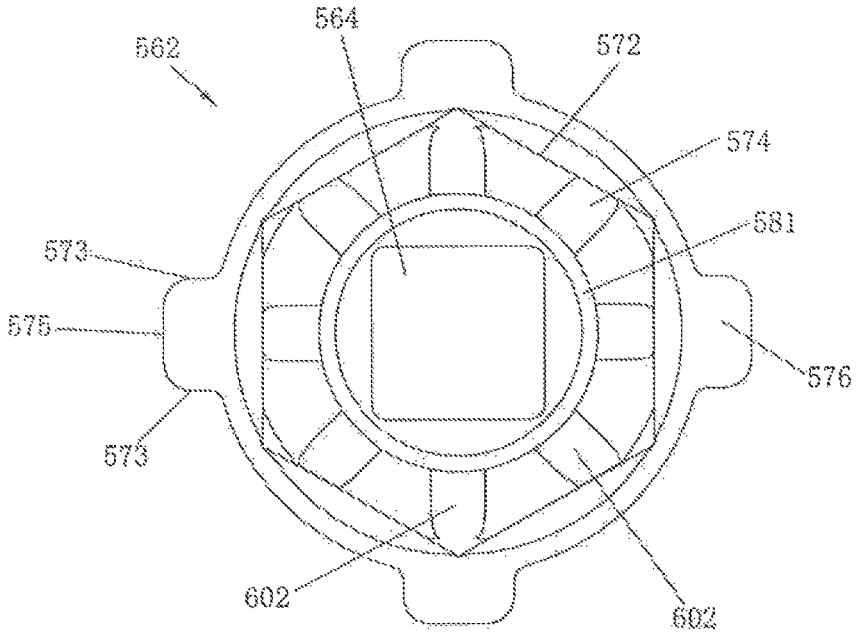
FIG. 55 is a vertical view of the locating element in the ninth embodiment of the invention.

Through the matching surface 560 on the output shaft 532, the oscillatory power tool can be connected with different types of cutting tools, and those cutting tools can be installed on the output shaft 532 at any angle. However, some trouble is also caused, for example failure to quickly and accurately adjust the angle of each cutting tool relative to the output shaft 532. As shown in FIGS. 52-54, the locating element 562 has a central hole 564 for penetration by the fastener 536 and an adaptor plate 566. In this embodiment, the cross-section of the central hole 564 is approximately square, matched with the connecting portion 546. The adaptor plate 566 has a first end and a second end in opposite, wherein the first end faces the output shaft 532 and has a plate-like body 568, while the second end faces the cutting tool 534.

To better transmit the torque and install the cutting tool on the output shaft 532 at a special angle, the locating element 562 comprises a form-fit portion 570 and an adaptor matched with the cutting tool 534. Wherein the adaptor at least comprises a first adaptor 572 and a second adaptor 574. The first adaptor 572 and the second adaptor 574 on a plane vertical to the output shaft 532 are different in the projection shape and therefore are used to connect two types of cutting tools with connecting holes in different shapes. Moreover, the thicknesses of the two adaptors both are over 1.2 mm, preferably 1.2 mm, so the corresponding cutting tool can be installed more fixedly.

The form-fit portion 570 is formed through radial outward extension of the outer circumference of the plate-like body 568. The first adaptor 572 and the second adaptor 574 are formed by axial convex extension of one side of the plate-like body 568.

The form-fit portion 570 comprises at least a form-fit element 576 which is formed through radial outward extension of the circumference of the plate-like body 568. In this embodiment, the form-fit portion 570 comprises four form-fit elements 576 which are uniformly distributed in the circumference, and each form-fit element 576 comprises two parallel side walls 573 relative to the center of the plate-like body 568 and an end wall 575 connecting the two side walls 573. Preferably, the end wall 575 is vertical to the two side walls 573. To facilitate assembly, the two side walls 573 of the form-fit element 576 and the outer circumference of the plate-like body 568 are in circular bead transition; the two side walls 573 of the form-fit element 576 and the end wall 575 are also in circular bead transition. The output shaft 532 is provided a depression 577 which is at least partly received in the locating element 562. The inner wall of the depression 577 is formed with a matching portion which is matched with the form-fit element 576 in shape. In a specific embodiment, the outline of the matching portion and the outline of the form-fit portion 570 are identical in shape. The matching portion comprises a recess 578 matched with the form-fit element 576. Obviously, the outline of the form-fit element 576 may also be in other shapes, at least including arc, polygon, etc.

Of course, if the projection of the outline of the plate-like body 568 on the plane vertical to the output shaft 532 is polygonal, such as regular dodecagon, the form-fit portion is directly formed on the plate-like body 568. In this way, the inner wall of the depression 577 also forms a matching portion which is matched with the outline of the plate-like body 568. Obviously, the outline of the plate-like body 568 may also be in other shapes, such as polygon.

In this embodiment, the locating element 562 is step-like, axially extending to form a step 579 from the plate-like body 568. The step 579 is a cylindrical step, and the radial size is smaller than that of the plate-like body 568. The step 579 is thicker than the stuck ring 565. When the locating element 562 is installed on the output shaft 532, the stuck ring 565 is located on the cylindrical surface of the step 579 and contacts the surface of the plate-like body 568.

The first adaptor 572 and the second adaptor 574 are formed by axially convexly extending in turn in from the end face of the step 579. Moreover, the maximum radial size of the first adaptor 572 may be equal to or more than that of the second adaptor 574.

The adaptor also comprises a third adaptor 581 which is axially arranged relative to the first adaptor 572 and the second adaptor 574. The third adaptor 581 axially extends from the second adaptor 574, and the maximum radial size is smaller than that of the second adaptor 574.

Figure 56:
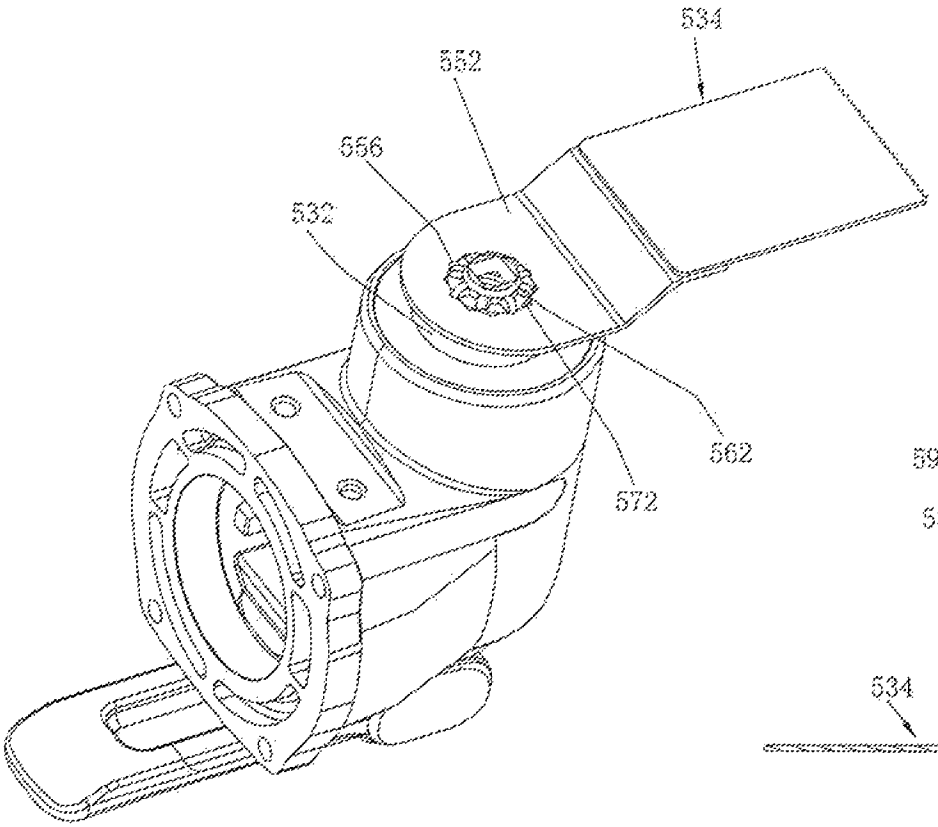
FIG. 56 is a schematic view of the locating element as shown in FIG. 53 that is matched with a cutting tool.

As shown in FIG. 52 and FIG. 56, in this embodiment, the cross-section of the first adapter 572 on the plane vertical to the output shaft 532 is shaped as a regular hexagon, and just matched with the connecting hole 556 of the cutting tool 534. When the cutting tool 534 is installed on the locating element 562, the connecting hole 556 is sleeved on the first adaptor 572 of the locating element 562 and is in tight fit so as to locating the cutting tool 534 radially. In this way, the locating element 562 can transmit the torque on the output shaft 532 to the cutting tool 534 and also can fix the angle of the cutting tool 534 relative to the output shaft 532 at the same time. Obviously, the cross-section of the first adaptor 572 may also be in other shapes, such as dodecagon matched with the dodecagonal cutting tool 534. Of course, the cross-section of the first adaptor 572 is shaped as a regular hexagon such that the cutting tool 534 can be fixed at six positions relative to the output shaft 532.

Furthermore, in this embodiment, to quickly install or dismantle the cutting tool and provide a stronger axial compression force, the oscillatory power tool comprises a quick clamping mechanism which is approximately structurally the same as that in the first embodiment. Here, the specific structure is not described repeatedly.

Figure 57:
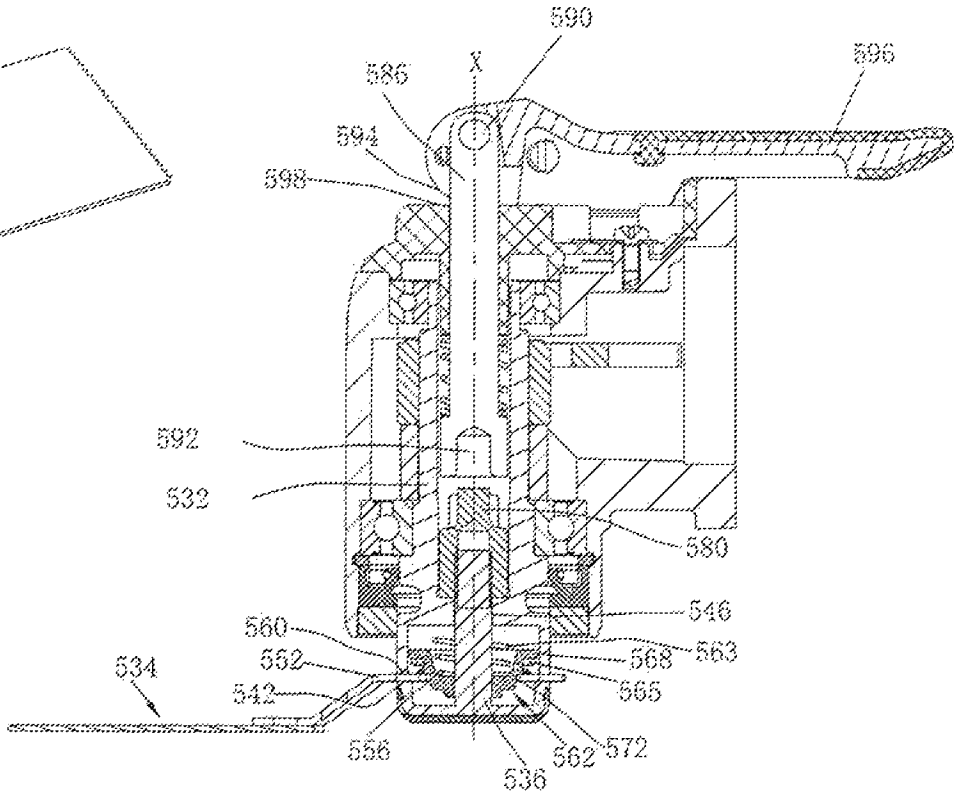
FIG. 57 is a sectional view of the head area of the oscillatory power tool as shown in FIG. 52, in such circumstances the cutting tool is locked on the output shaft.

As shown in FIG. 56 and FIG. 57, to install the cutting tool 534 on the oscillatory power tool, sleeve the cutting tool 534 on the locating element 562 first such that the connecting hole 556 thereof is sleeved on the first adaptor 572 of the locating element 562 and is in tight fit to radially locate the cutting tool 534. Then, operate the handle 596 to rotate around the axis of the pivot shaft 590. The cam portion 594 contacts the contacting surface 598 of the housing to drive the pushing rod 586 to move downward, and then the groove 592 of the pushing rod 586 is engaged with the fastening element 580. Next, operate the operate handle 596 to rotate around the axis X of the output shaft 532 along the screwing direction such that the fastening element 580 is driven to rotate together and then threadedly locked with the fastener 536. In such circumstances, compress the spring 563, then the pressing plate 542 axially extrudes the lower surface of the securing section 552 of the cutting tool 534 until the securing section 552 of the cutting tool 534 is fixed between the matching surface 560 and the pressing plate 542. Thus, the cutting tool 534 is fixed axially. In the installation process, the first adaptor 572 is matched with the connecting hole 556, so the cutting tool 534 does not move randomly.

It can be understood that the driving mechanism in the invention is also not limited to the structure in the above embodiments.

The second adaptor 574 and the first adaptor 572 of the locating element 562 are different in shape and therefore can be connected with two types of cutting tools with different connecting holes. The fit between the locating element 562 and the other cutting tool 600 is described in detail with reference to FIGS. 52-54 and FIGS. 57-59.

As shown in FIGS. 52-54, the second adaptor 574 is arranged on the axial side of the first adaptor 572. The second adaptor 574 comprises eight convex stands 602 axially extending from the first adaptor 572. The convex stands 602 radially extend from the central round table 601 and are independently and uniformly distributed in the circumference. The convex stands 602 have top surfaces 603. The top surfaces 603 and the top surface of the first adaptor 572 are in circular arc transition.

Figure 58:
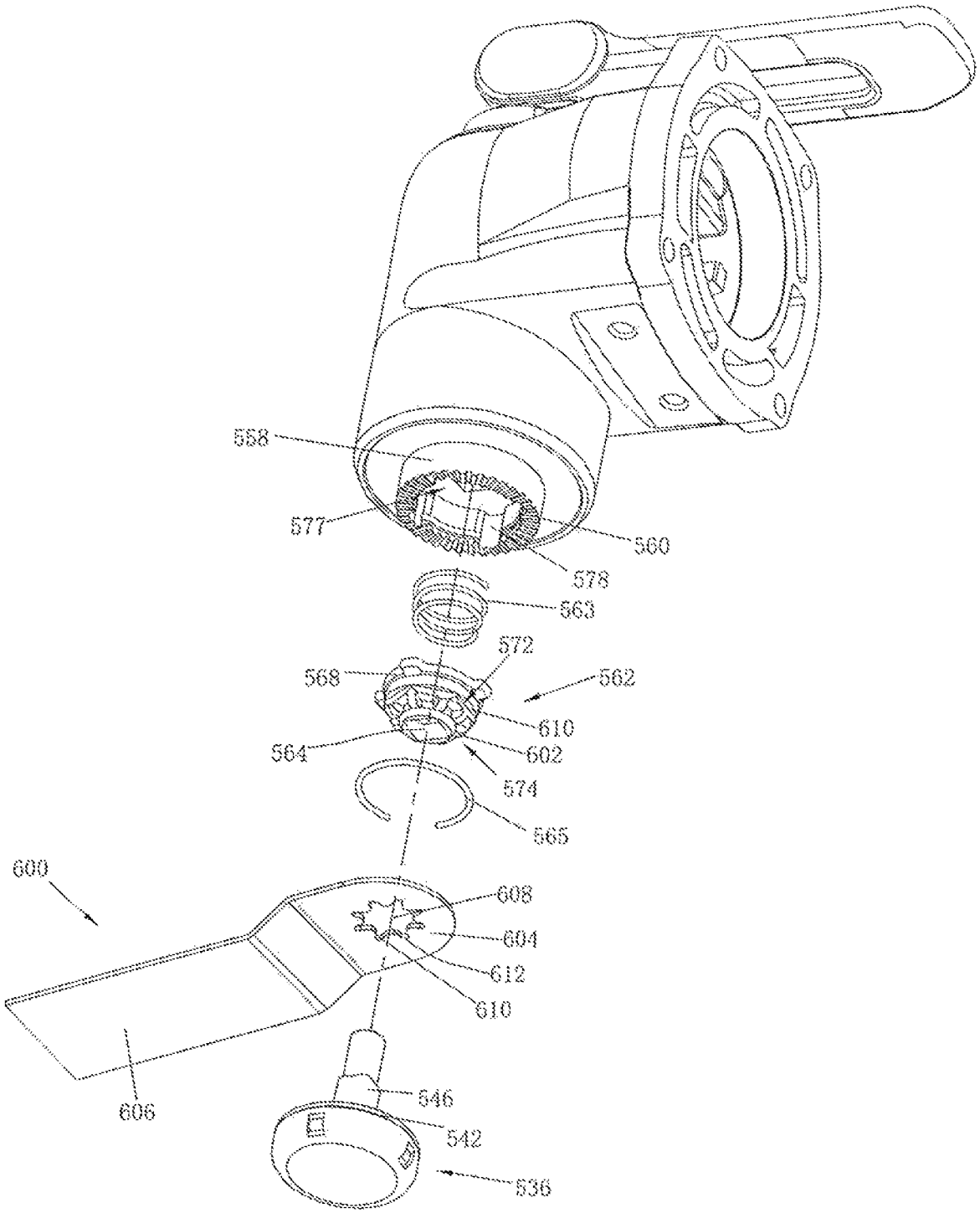
FIG. 58 is a three-dimensional exploded view of a second cutting tool equipped on the oscillatory power tool as shown in FIG. 52.
Figure 60:
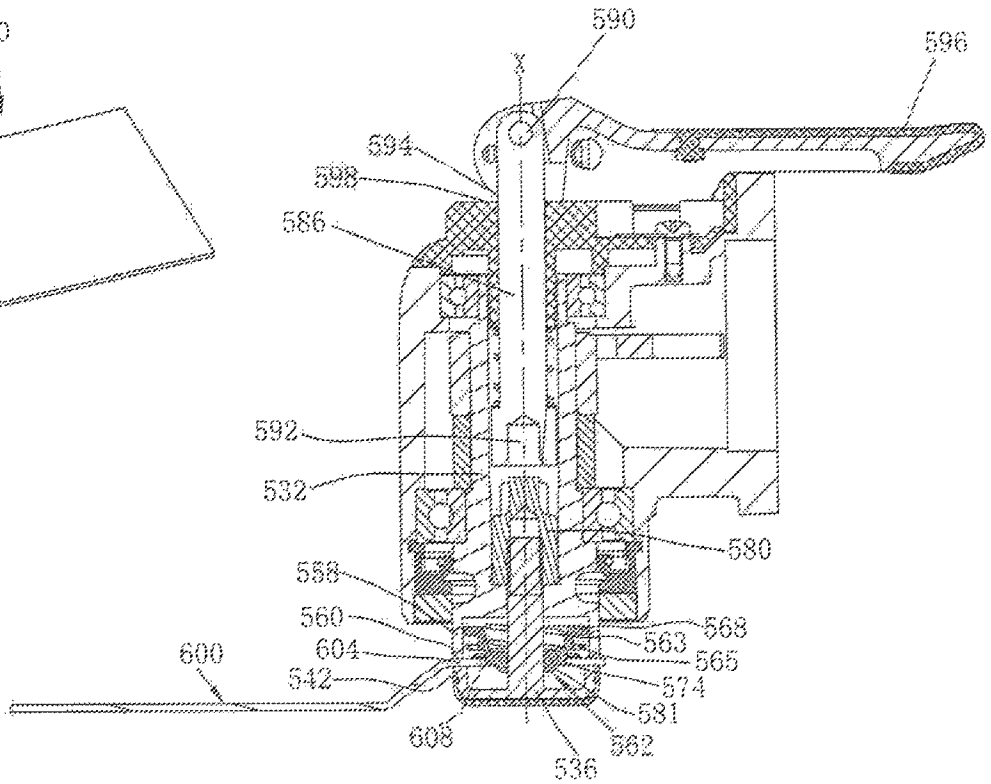
FIG. 60 is a sectional view of the head area of the oscillatory power tool as shown in FIG. 58, in such circumstances the second cutting tool is locked on the output shaft.
Figure 59:
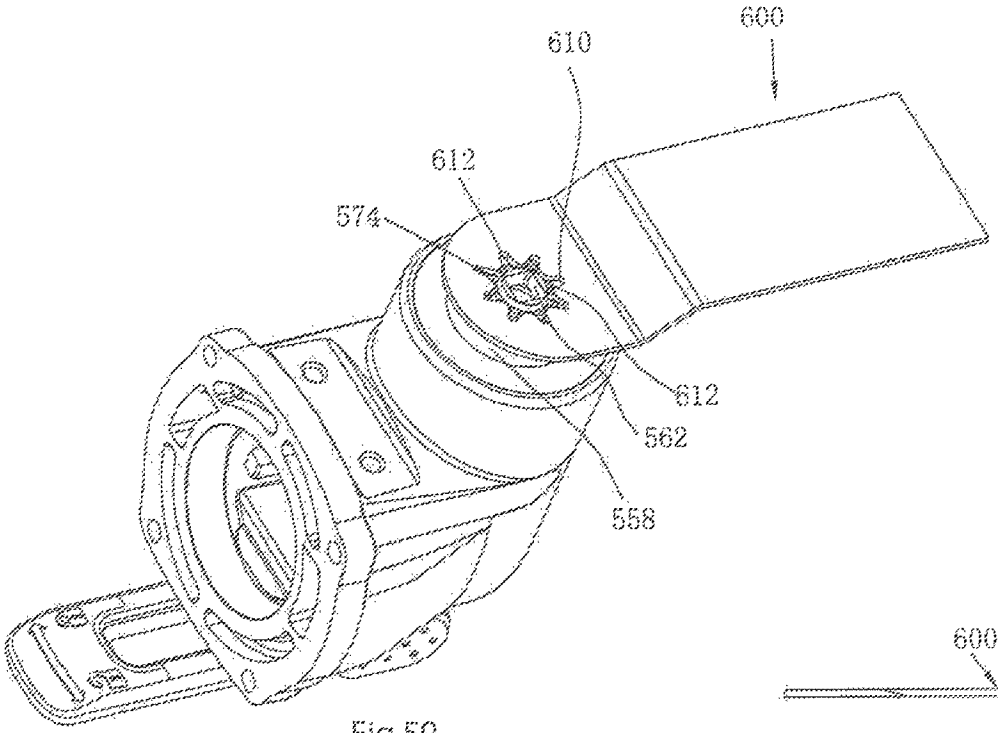
FIG. 59 is a schematic view of the locating element as shown in FIG. 52 that is matched with the second cutting tool.

As shown in FIGS. 58-60, the cutting tool 600 is similar to the cutting tool 534 in shape and also has a securing section 604 and a cutting portion 606 bending and extending from the securing section 604. The securing section 604 is provided with the connecting hole 608. The difference lies in that the shape of the connecting hole 608 is different from that of the connecting hole 556 of the cutting tool 534. The connecting hole 608 is star-shaped and is matched with the second adaptor 574 of the locating element 562. The connecting hole 608 comprises eight round convex portions 610 extending radially. The adjacent convex portions 610 are consecutively connected through curve segments 612 facing the central line of the connecting hole 608.

To install the cutting tool 600 on the oscillatory power tool, sleeve the cutting tool 600 on the locating element 562 first such that the connecting hole 608 thereof is sleeved on the second adaptor 574 of the locating element 562, meaning that the round convex portions 610 are in close fit with the convex stands 602 to radially locate the cutting tool 600. Then, operate the handle 596 to rotate around the axis of the pivot shaft 590. The cam portion 594 contacts the contacting surface 598 of the housing to drive the pushing rod 586 to move downward, and then the groove 592 of the pushing rod 586 is engaged with the fastening element 580. Next, operate the operate handle 596 to rotate around the axis X of the output shaft 532 along the screwing direction such that the fastening element 580 is driven to rotate together and then threadedly locked with the fastener 536. In such circumstances, compress the conical spring 563, then the pressing plate 542 axially extrudes the lower surface of the securing section 604 of the cutting tool 600 until the securing section 604 of the cutting tool 600 is fixed between the matching surface 560 and the pressing plate 542. Thus, the cutting tool 600 is fixed axially. In the installation process, the second adaptor 574 is matched with the connecting hole 608, so the cutting tool 534 does not move randomly.

The third adaptor 581 of the locating element 562 is different from the first adaptor 572 and the second adaptor 574 in shape and therefore can be connected with other types of cutting tools. The fit between the locating element 562 and the other cutting tool 614 is described in detail with reference to FIG. 60 and FIG. 61.

Figure 61:
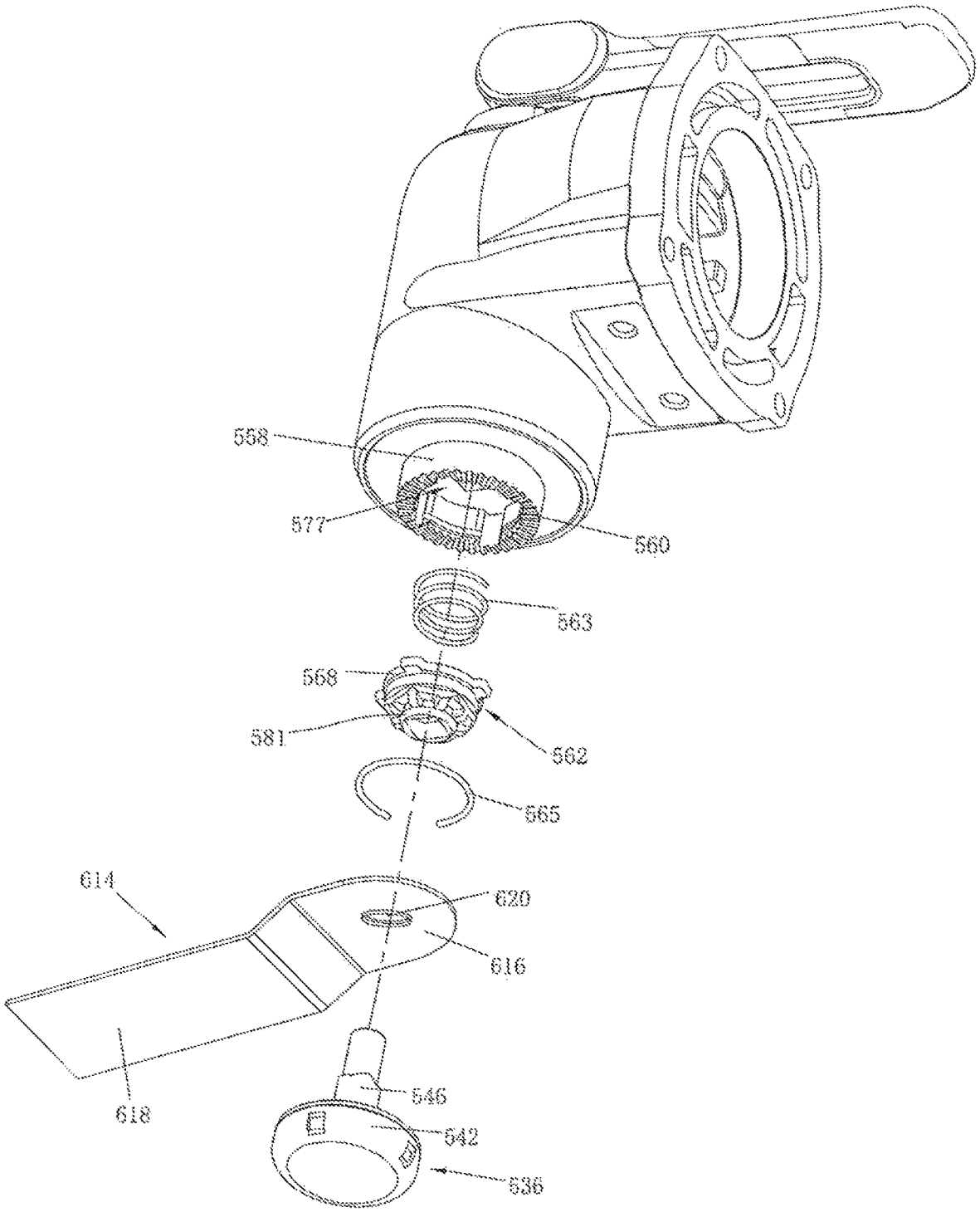
FIG. 61 is a three-dimensional exploded view of a third cutting tool equipped on the oscillatory power tool as shown in FIG. 52.
Figure 62:
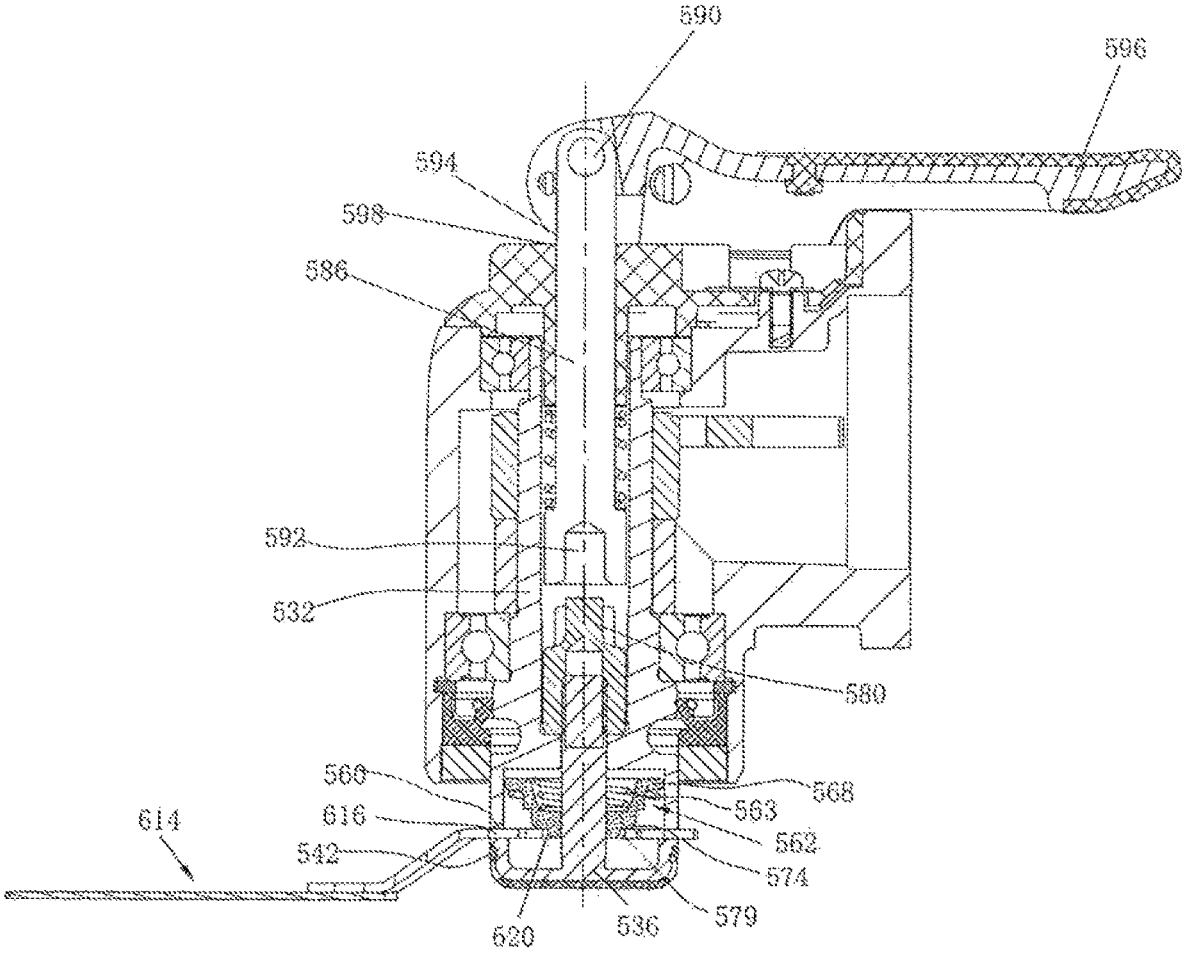
FIG. 62 is a sectional view of the head area of the oscillatory power tool as shown in FIG. 61, in such circumstances the third cutting tool is locked on the output shaft.

As shown in FIG. 61 and FIG. 62, the outline of the third adaptor 581 of the locating element 562 at least comprises a conical surface.

The cutting tool 614 is similar to the cutting tool 534 in shape and also has a securing section 616 and a cutting portion 616 bending and extending from the securing section 618. The securing section 616 is provided with the connecting hole 620. The difference lies in that the shape of the connecting hole 620 is different from that of the connecting hole 556 of the cutting tool 534. The connecting hole 620 is round and matched with the conical surface of the third adaptor 581.

To install the cutting tool 614 on the oscillatory power tool, sleeve the cutting tool 614 on the locating element 562 first such that the connecting hole 620 is sleeved on the third adaptor 581 of the locating element 562 so as to radially locate the cutting tool 614. Then, operate the handle 596 to rotate around the axis of the pivot shaft 590. The cam portion 594 contacts the contacting surface 598 of the housing to drive the pushing rod 586 to move downward, and then the groove 592 of the pushing rod 586 is engaged with the fastening element 580. Next, operate the operate handle 596 to rotate around the axis X of the output shaft 532 along the screwing direction such that the fastening element 580 is driven to rotate together and then threadedly locked with the fastener 536. In such circumstances, compress the spring 563, then the pressing plate 542 axially extrudes the lower surface of the securing section 616 of the cutting tool 614 until the securing section 616 of the cutting tool 614 is fixed between the matching surface 560 and the pressing plate 542. Thus, the cutting tool 614 is fixed axially.

The locating element of the invention is connected with many types of cutting tools through setting the first, second and even third adaptors. So, the torque on the output shaft 532 can be further transmitted to different types of cutting tools, and those cutting tools can be quickly and accurately installed on the output shaft 532 at specific angles. It should be pointed out that the locating element of the invention is not limited to have only the first, second and even third adaptors. Those skilled in the art can easily think that one or more adaptors, such as the fourth adaptor, the fifth adaptor, etc. can be set to connect many types of cutting tools with different connecting holes. The shapes of the first adaptor and the second adaptor are also not limited to those described in the above embodiment. The outlines may also be conical surfaces or cylindrical surfaces, etc. Or, the first adaptor may also be in other polygons. In addition, the number of the convex blocks of the second adaptor is not limited to eight, but is required to be over two. The convex portions may also be in other shapes such as columns. Of course, the outline of the third adaptor is not limited to the conical surface and may also be a cylindrical surface or other shaped convex blocks.

Figure 63:
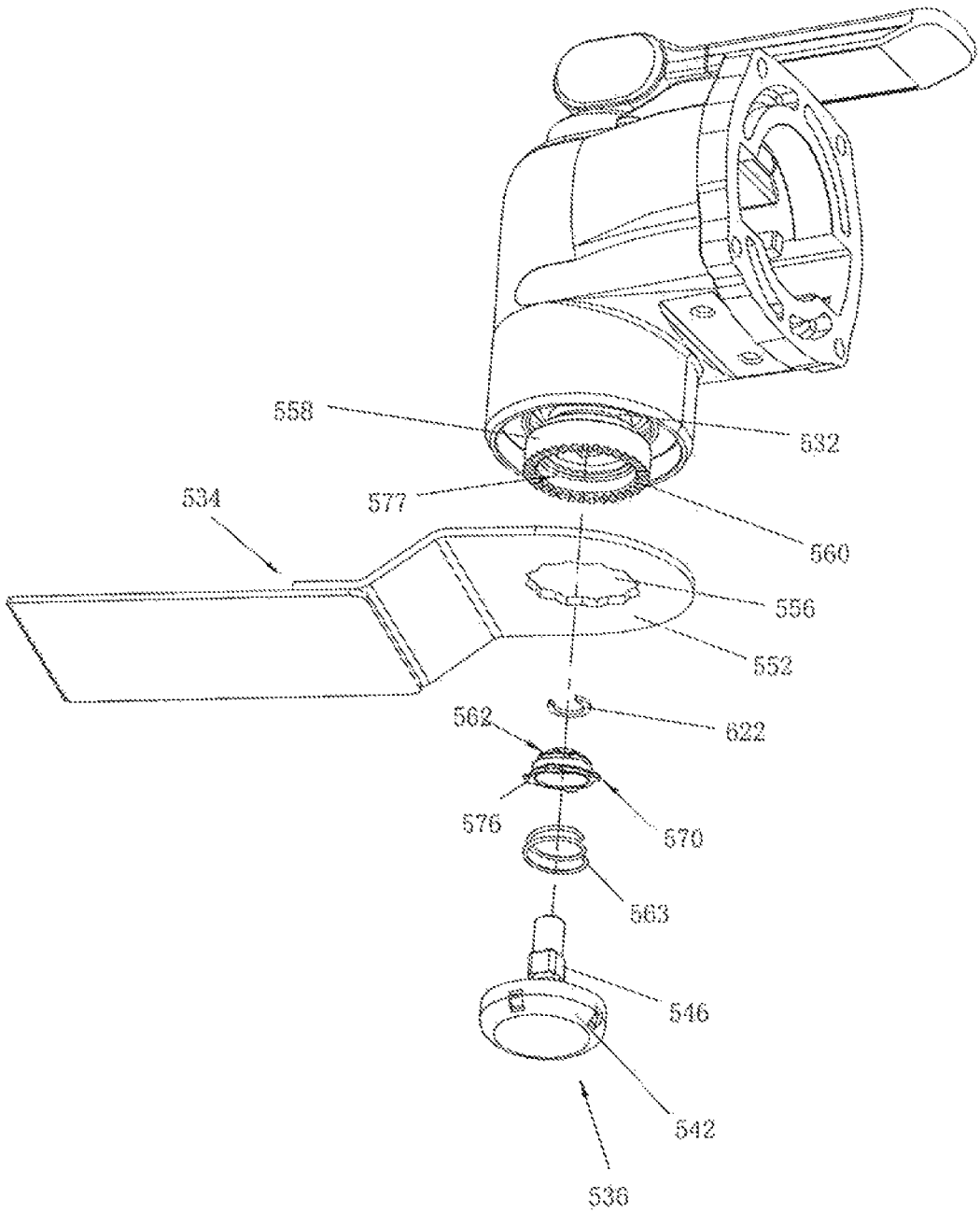
FIG. 63 is a three-dimensional exploded view of the head area of the oscillatory power tool in the 10th embodiment of the invention.
Figure 64:
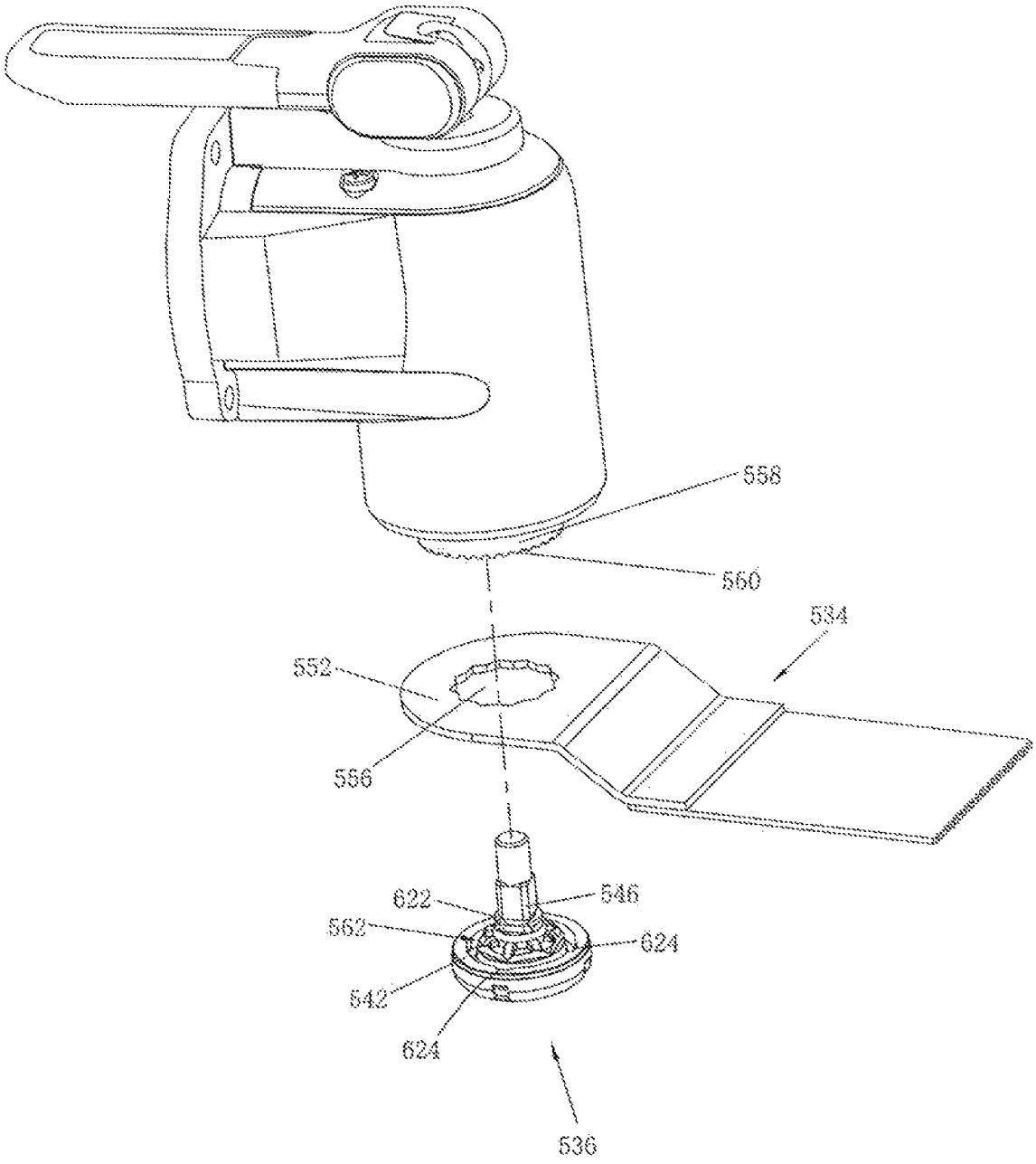
FIG. 64 is a three-dimensional exploded view of the head area of the oscillatory power tool in the 10th embodiment of the invention, in such circumstances the locating element is installed together with the fastener.
Figure 65:
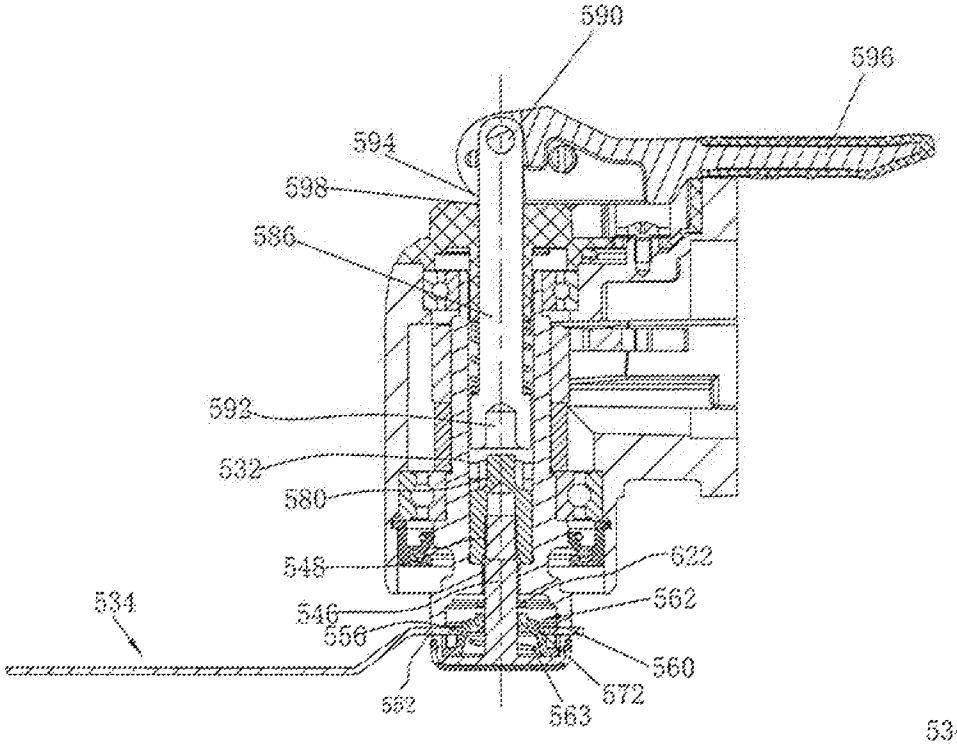
FIG. 65 is a sectional view of the head area of the oscillatory power tool as shown in FIG. 63, in such circumstances the first cutting tool is locked on the output shaft.

As shown in FIGS. 63-65, the locating element 562 in the 10th embodiment is basically the same as that in the ninth embodiment, but different in position. In the 10th embodiment, the locating element 562 is located on the pressing plate 542. Therefore, the conical surface 563 is set between the pressing plate 542 and the locating element 562. The spring force of the conical spring 563 drives the locating element 562 to always axially move towards a direction for contacting with contacts the cutting tool 534. The pressing plate 542 is provided with a stopping ring to prevent the locating element 562 from separation. Here, the stopping ring is a stuck ring 622 with an opening. The connecting portion 546 is provided with a stuck slot. The stuck ring 622 is received in the stuck slot to prevent the locating element 562 separating from the pressing plate 542.

Therefore, in this embodiment, the locating element 562 together with the fastener 536 may form an independent fastening device which can be used to assemble many kinds of cutting tool to one oscillatory power tool. As an independent assembly, the fastening device brings convenience to assembly of the oscillatory power tool. Of course, the fastening device may also be sold as an independent accessory.

The form-fit portion 570 comprises four form-fit elements 576 which are distributed in uniformly. In the 10th embodiment, the pressing plate 542 has a matching portion matched with the form-fit element 576 in shape. In this embodiment, the matching portion is identical with the form-fit portion 570 in shape, namely a recess 624 matched with the form-fit element 576. In this way, the locating element 562 is in form fit with the pressing plate 542 so as to transmit the torque on the output shaft 532 to the cutting tool 534.

The fit between the cutting tool 534 and the locating element 562 is described in detail with reference to FIGS. 63-65. The fit between other adaptors 572 of the locating element 562 and other different types of cutting tools is identical with that described in the ninth embodiment, and therefore is not repeatedly described one by one.

To install the cutting tool 534 on the oscillatory power tool, sleeve the cutting tool 534 on the locating element 562 first such that the connecting hole 556 thereof is sleeved on the first adaptor 572 of the locating element 562 and is in tight fit to radially locate the cutting tool 534. Then, operate the handle 596 to rotate around the axis of the pivot shaft 590. The cam portion 594 contacts the contacting surface 598 of the housing to drive the pushing rod 586 to move downward, and then the groove 592 of the pushing rod 586 is engaged with the fastening element 580. Next, operate the operate handle 596 to rotate around the axis X of the output shaft 532 along the screwing direction such that the fastening element 580 is driven to rotate together and then threadedly locked with the fastener 536. In such circumstances, compress the spring 563, then the pressing plate 542 axially extrudes the lower surface of the securing section 552 of the cutting tool 534 until the securing section 552 of the cutting tool 534 is fixed between the matching surface 560 and the pressing plate 542, thus axially fixing the cutting tool 534. In the installation process, the first adaptor 572 is matched with the connecting hole 556, so the cutting tool 534 does not move randomly.

Figure 66:
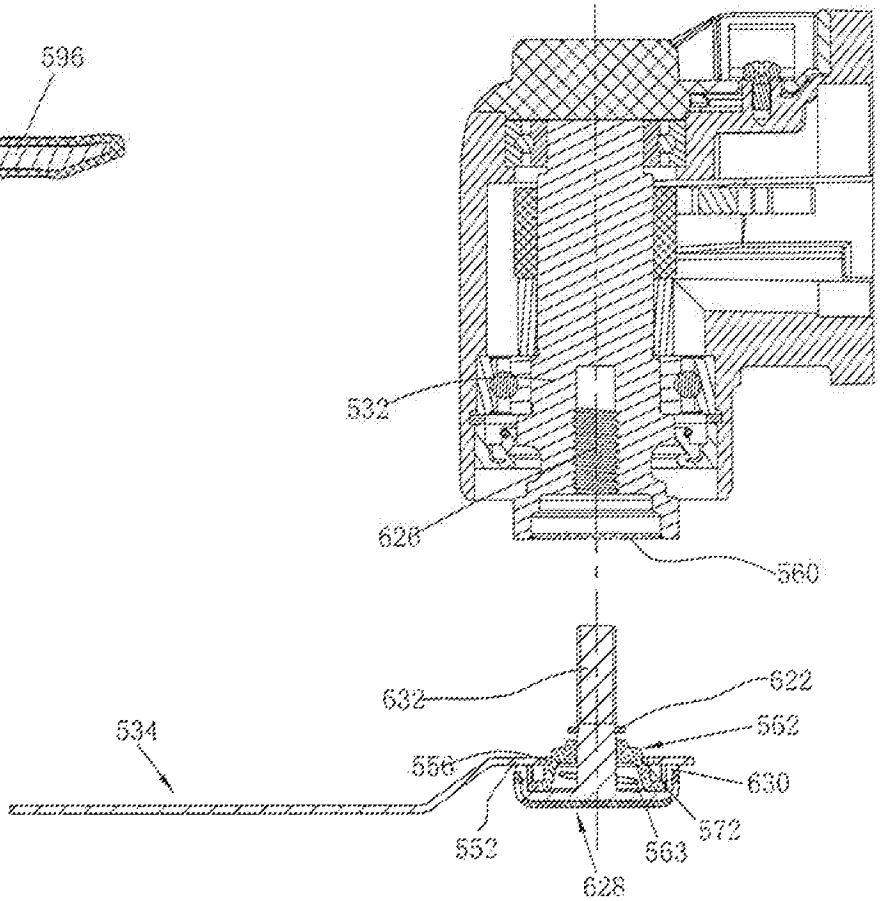
FIG. 66 is a sectional view of the head area of the oscillatory power tool in the eleventh embodiment of the invention, in such circumstances the first cutting tool is not installed on the output shaft yet.

As shown in FIG. 66, in the eleventh embodiment of the invention, the locating element 562 is basically the same as that in the tenth embodiment, but different in that: the output shaft 532 is directly provided with a tapped blind hole 626, and the fastener 628 comprises a pressing plate 630 and a cylindrical screw portion 632 which axially extends from the middle part of the pressing plate 630. To install the cutting tool 534, sleeve the cutting tool 534 on the locating element 562 first such that the connecting hole 556 thereof is sleeved on the first adaptor 572 of the locating element 562 and is in close fit so as to radially locate the cutting tool 534; then, install the fastener 628 equipped with the cutting tool 534 on the output shaft 532; next, connect the screw portion 632 of the fastener 628 with the tapped blind hole 626, screw the fastener 628, and then the cutting tool 534 can be easily fixed between the matching surface 560 and the pressing plate 630. Thus, the cutting tool 534 is axially fixed. In the installation process, the first adaptor 572 is matched with the connecting hole 556, so the cutting tool 534 does not move randomly.

It can be understood that the locating element 562 in the ninth embodiment is installed on the output shaft 532, and the cutting tool 534 can also be fixed on the output shaft 532 with the fastener 628. Similarly, this embodiment just illustrates the fit between the first adaptor 572 and the cutting tool 534. The fit between the other adaptors of the locating element 562 and other different types of cutting tools is identical with that described in the ninth embodiment and therefore is not repeatedly described.

The invention claimed is:

1. An oscillatory power tool comprising:

a replaceable cutting tool including a securing section having a surface and a connecting hole having a center;

an output shaft defining a longitudinal axis and having a driving end, the driving end having a matching surface for engaging with the surface of the securing section of the cutting tool, the output shaft defining a depression;

a locating element comprising a form-fit portion at least partially received in the depression of the output shaft for aligning the center of the connecting hole with the longitudinal axis and for transporting torque from the output shaft to the cutting tool, wherein the locating element further comprises an adapting portion comprising a first adaptor and a second adaptor to be received in the connecting hole to align the center of the cutting tool with the longitudinal axis, wherein the first adaptor and the second adaptor on a plane normal to the longitudinal axis of the output shaft are different in a projection shape; and a fastener passing through the locating element to engage with a fastening element for fastening the cutting tool to the driving end.

2. The oscillatory power tool according to claim 1, further comprising an elastic element disposed between the depression and the locating element to drive the locating element to always axially move towards a direction for contacting the cutting tool.

3. The oscillatory power tool according to claim 2, wherein the locating element is disposed in the output shaft.

4. The oscillatory power tool according to claim 1, wherein the locating element comprises a plate body, wherein the form-fit portion is formed as a radial outward extension of the outer circumference of the plate body, the first adaptor and the second adaptor are formed by portions protruded from a side of the plate body.

5. The oscillatory power tool according to claim 4, wherein the form-fit portion comprises at least two form-fit elements extended from the outer circular peripheral of the plate body along the radial outward extension of the outer circumference of the plate body.

6. The oscillatory power tool according to claim 5, wherein the second adaptor is disposed on one side of the first adaptor, wherein a radial dimension of the first adaptor is not equal to a radial dimension of the second adaptor.

7. An oscillatory power tool comprising:

a replaceable cutting tool including a securing section having a surface and a connecting hole having a center;

an output shaft defining a longitudinal axis and having a driving end, the driving end of the output shaft having a matching surface for engaging with the securing section of the cutting tool, the output shaft defining a depression;

a locating element comprising a form-fit portion at least partially received in the depression for centering the cutting tool relative to the output shaft and for transporting torque from the output shaft to the cutting tool, wherein the locating element further comprises an adapting portion comprising a first adaptor and a second adaptor, wherein the first adaptor and the second adaptor are shaped differently; and a fastener passing through the locating element to engage with a fastening element for fastening the cutting tool to the driving end.

* * * * *